US008094143B2

(12) United States Patent
Kamada et al.

(10) Patent No.: US 8,094,143 B2
(45) Date of Patent: Jan. 10, 2012

(54) IMAGE PROCESSING METHOD AND LIQUID-CRYSTAL DISPLAY DEVICE USING THE SAME

(75) Inventors: Tsuyoshi Kamada, Kawasaki (JP); Hidefumi Yoshida, Kawasaki (JP); Yoshio Koike, Kawasaki (JP); Toshiaki Suzuki, Kawasaki (JP); Tetsuya Kobayashi, Kawasaki (JP); Yasutoshi Tasaka, Kawasaki (JP); Masakazu Shibasaki, Kawasaki (JP); Kunihiro Tashiro, Kawasaki (JP); Kazuya Ueda, Kawasaki (JP); Katsuyoshi Hiraki, Kawasaki (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 12/620,311

(22) Filed: Nov. 17, 2009

(65) Prior Publication Data

US 2010/0103206 A1 Apr. 29, 2010

Related U.S. Application Data

(63) Continuation of application No. 10/812,847, filed on Mar. 30, 2004.

(30) Foreign Application Priority Data

Mar. 31, 2003 (JP) ..... 2003-093793
Mar. 31, 2003 (JP) ..... 2003-096860

(51) Int. Cl.
*G09G 5/00* (2006.01)

(52) U.S. Cl. ..... 345/204; 345/55; 345/87; 345/89

(58) Field of Classification Search ..... 345/89, 345/87, 55

See application file for complete search history.

(56) References Cited

U.S. PATENT DOCUMENTS

| | | | | |
|---|---|---|---|---|
| 5,610,739 | A | 3/1997 | Uno et al. | |
| 5,847,688 | A | 12/1998 | Ohi et al. | |
| 6,617,797 | B2 * | 9/2003 | Higuchi et al. | 315/169.1 |
| 6,952,192 | B2 | 10/2005 | Ohmuro et al. | |
| 7,133,101 | B2 | 11/2006 | Koma | |
| 7,205,970 | B2 * | 4/2007 | Kim et al. | 345/89 |
| 2002/0118153 | A1 | 8/2002 | Kimura | |
| 2003/0107538 | A1 | 6/2003 | Asao et al. | |
| 2003/0210256 | A1 * | 11/2003 | Mori et al. | 345/690 |
| 2004/0061711 | A1 | 4/2004 | Kurumisawa et al. | |

(Continued)

FOREIGN PATENT DOCUMENTS

JP 01-214898 8/1989

(Continued)

*Primary Examiner* — Richard Hjerpe
*Assistant Examiner* — Leonid Shapiro
(74) *Attorney, Agent, or Firm* — Greer, Burns & Crain, Ltd.

(57) ABSTRACT

This invention relates to an image processing method for improving the quality of an image to be displayed on a display device and to a liquid-crystal display device using the same, and aims at providing an image processing method for providing wide viewing angle and excellent tonal-intensity viewing angle characteristic and a liquid-crystal display device using the same. Combined together are a higher-luminance pixel to be driven higher in luminance than the luminance data of an image to be displayed and a lower-luminance pixel to be driven lower in luminance than the luminance data, to determine a luminance on the higher-luminance pixel and luminance on the lower-luminance pixel as well as an area ratio of the higher-luminance and lower-luminance pixels in a manner obtaining a luminance nearly equal to a desired luminance based on the luminance data.

5 Claims, 61 Drawing Sheets

U.S. PATENT DOCUMENTS

2004/0239698 A1 12/2004 Kamada et al.

FOREIGN PATENT DOCUMENTS

| | | |
|---|---|---|
| JP | 03-122621 | 5/1991 |
| JP | 04-348324 | 12/1992 |
| JP | 05-066412 | 3/1993 |
| JP | 05-107556 | 4/1993 |
| JP | 05-113767 | 5/1993 |
| JP | 06-332009 | 12/1994 |
| JP | 07-121144 | 5/1995 |
| JP | 08-201777 | 8/1996 |
| JP | 8-507880 | 8/1996 |
| JP | 08-328043 | 12/1996 |
| JP | H10-116055 | 5/1998 |
| JP | 2000-181439 | 6/2000 |
| JP | 2000-231091 | 8/2000 |
| JP | 2000-338464 | 12/2000 |
| JP | 2001-147673 | 5/2001 |
| JP | 2004-085608 | 3/2004 |
| JP | 2004-233813 | 8/2004 |
| WO | WO 94/19720 | 9/1994 |

* cited by examiner

| | HT PARTITION AREA RATIO | | | | |
|---|---|---|---|---|---|
| | UNPROCESSED | 8:8 | 4:12 | 2:14 | 1:15 |
| IMAGE F | × | × | ○ | ◎ | ○ |
| IMAGE G | × | ○ | ◎ | ○ | × |

FIG.5

| DISTANCE FROM SCREEN (cm) | HT PARTITION AREA RATIO | | | | |
|---|---|---|---|---|---|
| | UNPROCESSED | 8:8 | 4:12 | 2:14 | 1:15 |
| 10 | ◎ | × | × | × | × |
| 20 | ◎ | × | × | × | × |
| 30 | ◎ | × | × | × | × |
| 40 | ◎ | ○ | × | × | × |
| 50 | ◎ | ○ | × | × | × |
| 60 | ◎ | ◎ | ○ | × | × |
| 70 | ◎ | ◎ | ○ | × | × |
| 80 | ◎ | ◎ | ○ | ○ | × |
| 90 | ◎ | ◎ | ◎ | ○ | × |
| 100 | ◎ | ◎ | ◎ | ○ | × |
| 110 | ◎ | ◎ | ◎ | ◎ | ○ |
| 120 | ◎ | ◎ | ◎ | ◎ | ○ |
| 130 | ◎ | ◎ | ◎ | ◎ | ○ |
| 140 | ◎ | ◎ | ◎ | ◎ | ○ |
| 150 | ◎ | ◎ | ◎ | ◎ | ◎ |
| 160 | ◎ | ◎ | ◎ | ◎ | ◎ |

FIG.8

| DISTANCE FROM SCREEN (cm) | HT PARTITION AREA RATIO | | | | |
|---|---|---|---|---|---|
| | UNPROCESSED | 8:8 | 4:12 | 2:14 | 1:15 |
| 10 | ◎ | ○ | × | × | × |
| 20 | ◎ | ○ | ○ | × | × |
| 30 | ◎ | ◎ | ○ | ○ | × |
| 40 | ◎ | ◎ | ◎ | ○ | × |
| 50 | ◎ | ◎ | ◎ | ○ | ○ |
| 60 | ◎ | ◎ | ◎ | ◎ | ○ |
| 70 | ◎ | ◎ | ◎ | ◎ | ○ |
| 80 | ◎ | ◎ | ◎ | ◎ | ○ |
| 90 | ◎ | ◎ | ◎ | ◎ | ◎ |
| 100 | ◎ | ◎ | ◎ | ◎ | ◎ |
| 110 | ◎ | ◎ | ◎ | ◎ | ◎ |

FIG.9

| DISTANCE FROM SCREEN (cm) | HT PARTITION AREA RATIO | | | | |
|---|---|---|---|---|---|
| | UNPROCESSED | 8:8 | 4:12 | 2:14 | 1:15 |
| 10 | ◎ | ◎ | ○ | × | × |
| 20 | ◎ | ◎ | ◎ | ○ | ○ |
| 30 | ◎ | ◎ | ◎ | ○ | ○ |
| 40 | ◎ | ◎ | ◎ | ◎ | ○ |
| 50 | ◎ | ◎ | ◎ | ◎ | ◎ |
| 60 | ◎ | ◎ | ◎ | ◎ | ◎ |
| 70 | ◎ | ◎ | ◎ | ◎ | ◎ |

FIG.21A

| POINT WITHIN DISPLAY REGION | (1) | (2) | (3) | (4) | (5) | (6) | (7) |
|---|---|---|---|---|---|---|---|
| INTENSITY LEVEL ON R PIXEL | 120 | 120 | 120 | 120 | 120 | 120 | 120 |
| INTENSITY LEVEL ON G PIXEL | 117 | 118 | 119 | 120 | 121 | 122 | 123 |
| INTENSITY LEVEL ON B PIXEL | 0 | 0 | 0 | 0 | 0 | 0 | 0 |

| | | | | | | | |
|---|---|---|---|---|---|---|---|
| R-TABLE | GREAT | GREAT | GREAT | MIDDLE | MIDDLE | MIDDLE | MIDDLE |
| G-TABLE | MIDDLE | MIDDLE | MIDDLE | MIDDLE | GREAT | GREAT | GREAT |

FIG.21B

| POINT WITHIN DISPLAY REGION | (1) | (2) | (3) | (4) | (5) | (6) | (7) |
|---|---|---|---|---|---|---|---|
| INTENSITY LEVEL ON R PIXEL | 120 | 120 | 120 | 120 | 120 | 120 | 120 |
| INTENSITY LEVEL ON G PIXEL | 117 | 118 | 119 | 120 | 121 | 122 | 123 |
| INTENSITY LEVEL ON B PIXEL | 0 | 0 | 0 | 0 | 0 | 0 | 0 |

| | | | | | | | |
|---|---|---|---|---|---|---|---|
| R-TABLE | GREAT | GREAT | GREAT-GREAT-MIDDLE | MIDDLE-GREAT | MIDDLE-MIDDLE-GREAT | MIDDLE | MIDDLE |
| G-TABLE | MIDDLE | MIDDLE | MIDDLE-MIDDLE-GREAT | MIDDLE-GREAT | GREAT-GREAT-MIDDLE | GREAT | GREAT |

FIG.27A
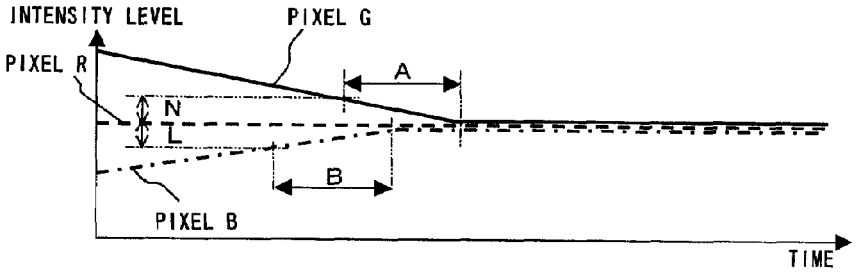
FIG.27B
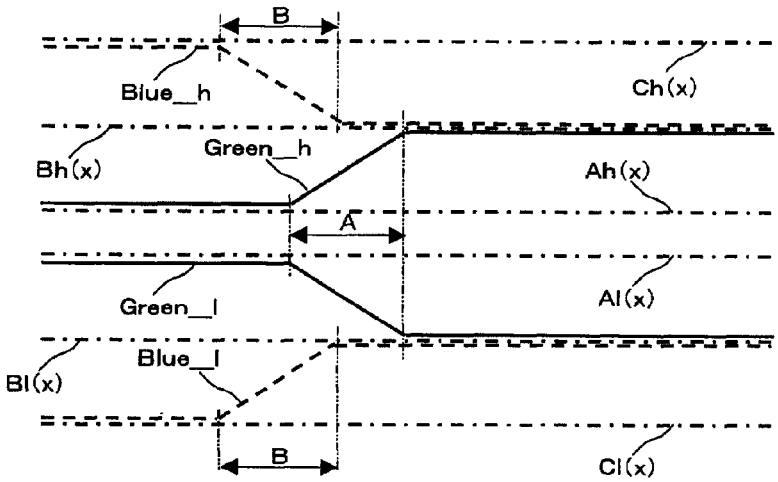
FIG.27C
| N (256 LEVELS) | 1 | 2 | 4 | 8 | 16 | 24 | 32 | 40 | 48 | 56 | 64 | 72 |
|---|---|---|---|---|---|---|---|---|---|---|---|---|
| ABNORMALITY PREVENTIVE | × | △ | △ | ○ | ○ | ○ | ○ | ○ | ○ | ○ | ○ | ○ |
| HTD EFFECT | ○ | ○ | ○ | ○ | ○ | ○ | ○ | △ | △ | × | × | × |

INTENSITY-LEVEL COMBINATION - LUMINECENCE DISTIBUTION

| DISPLAY FLAME | n | n+1 | n+2 | n+3 | n+4 | n+5 | n+6 | n+7 | n+8 |
|---|---|---|---|---|---|---|---|---|---|
| IN | 32 | 32 | 32 | 32 | 32 | 32 | 32 | 32 | 32 |
| HO | 46 | 18 | 40 | 24 | 40 | 24 | 46 | 18 | 46 |
| FL | 18 | 46 | 18 | 40 | 24 | 40 | 24 | 46 | 18 |

| DISPLAY FRAME | n | n+1 | n+2 | n+3 | n+4 | n+5 | n+6 | n+7 | n+8 |
|---|---|---|---|---|---|---|---|---|---|
| IN | 32 | 32 | 32 | 32 | 32 | 32 | 32 | 32 | 32 |
| HO | 46 | 18 | 40 | 24 | 40 | 24 | 46 | 18 | 46 |
| FL | 18 | 46 | 18 | 40 | 24 | 40 | 24 | 46 | 18 |
| OUT | 46 | 18 | 42 | 24 | 40 | 24 | 42 | 16 | 46 |
| OM | 46 | 18 | 40 | 24 | 40 | 24 | 46 | 16 | 46 |
| TRG | | | ○ | | | | ○ | | |
| CO | | | +2 | | | | −4 | | |

IMAGE PROCESSING METHOD AND LIQUID-CRYSTAL DISPLAY DEVICE USING THE SAME

This application is a Continuation of U.S. patent application Ser. No. 10/812,847, filed Mar. 30, 2004.

BACKGROUND OF THE INVENTION

1. Field of the Invention

This invention relates to an image processing method for improving the quality of an image to be displayed on a display device and to a liquid-crystal display device using the same.

2. Description of the Related Art

FIG. 33 shows an example in a structure of a liquid crystal display device of vertically aligned type. FIG. 33A typically shows a sectional structure of a liquid crystal panel 101. The liquid-crystal panel 101 is constructed by a TFT substrate (array substrate) 102 formed with Thin-film transistors (TFTs), etc., an opposite substrate 103 formed with a common electrode and a CF (color filter), and a liquid crystal 104 sealed between those by attaching through a peripheral seal material 105. Between the TFT substrate 102 and the opposite substrate 103, a cell gap is maintained at a predetermined spacing by a spacer 106. Polarizer plates 107 are respectively provided, for example, in a cross Nichol arrangement on the opposite surfaces of the TFT substrate 102 and the opposite substrate 103 to the facing surfaces. Meanwhile, a mounting terminal 108 is formed on the TFT substrate 102, to mount thereon an IC (not shown) for driving the liquid crystal.

FIG. 33B shows a structure of one pixel 113 in a state the liquid-crystal display device of vertically aligned type is viewed in a direction of the normal to a display surface thereof (hereinafter, referred to as "in a frontward direction"). A pixel electrode pattern for driving the liquid crystal is formed on at least one of the substrates, e.g., TFT substrate 102. A plurality of drain bus lines 111 and gate bus lines 112 are formed crossing through an insulation film over the TFT substrate 102, at the interconnection of which are formed pixel-driving TFTs 110 connected with respective pixel electrode 109. Furthermore, each pixel 113 has a storage capacitor electrode 116 for storing charge. Also, the storage capacitor electrode 116 has a lower layer formed with a storage capacitor bus line 117 through an insulation film.

A slit 114 is formed by removal of an electrode material on the pixel electrode 109 while a linear protrusion 115 is formed on the opposite substrate 103 side. The slit 114 and the protrusion 115 serve as an alignment regulating structure for regulating the direction in which the liquid-crystal molecules (not shown) of the liquid crystal 104 are to tilt under the application of voltage. Within the pixel, the domain is partitioned to allow the liquid-crystal molecules to tilt in four directions. By allowing the liquid molecules to tilt in four directions, the deformation in viewing angle is averaged as compared to that of the liquid-crystal display device having a tilt only in one direction. This greatly improves the characteristic of viewing angle. This technology is called alignment partitioning art.

FIG. 34 typically shows a sectional structure of a liquid-crystal display device of vertically aligned type using an alignment partitioning technique. In FIG. 34A, the alignment regulating structural protrusion 115 is formed on both of a pixel electrode 109 film-formed over the TFT substrate 102 and an opposite electrode 118 film-formed over the opposite substrate 103. An alignment film 119 is formed over the TFT substrate 102 and the opposite substrate 103 including over the protrusion 115. Incidentally, although not shown, the protrusion 115 in some cases is provided on one substrate only. FIG. 34A shows a state that voltage is not applied to the liquid crystal 104. FIG. 34B shows a state that voltage is applied to the liquid crystal 104 wherein liquid-crystal molecules 120 are aligned in two directions. Meanwhile, FIG. 34C shows a state that the slit 114 is provided only on the TFT substrate 102 wherein voltage is applied to liquid crystal 104. In this case also, the liquid-crystal molecules 120 are aligned in two directions. Incidentally, the slit 114 in some cases is provided only on the opposite substrate 103 or on both of the TFT substrate 102 and the opposite substrate 103.

Meanwhile, different from the LCD shown in FIGS. 33 and 34, there exists a liquid-crystal display device for a mode that liquid-crystal molecules 120 are nearly parallel with the TFT substrate 102 in the initial state under no application voltage to the liquid crystal 104 but the liquid-crystal molecules 120 rise when voltage is applied. Such liquid-crystal display devices include the TN (Twisted Nematic) type, as an example. In the TN type, a rubbing process is previously performed over the alignment film formed on the TFT substrate 102 and opposite substrate 103, to determine an alignment direction of the liquid-crystal molecules 120. This accordingly does not require slits 114 and protrusions 115. However, for alignment partitioning, there is a need to separate the tilt direction of the liquid-crystal molecules 120 into a certain number. It is a practice to realize alignment partitioning by locally changing the pre-tilt. Besides the TN type, there are various liquid-crystal display modes including IPS (In-Plane Switching) having liquid crystal molecules 120 that do not tilt relative to the TFT substrate 102, ferroelectric liquid-crystal and so on. However, in other liquid-crystal modes other than the IPS and ferroelectric liquid-crystal, there is a common problem of poor viewing-angle characteristic.

FIG. 35 is a figure explaining a problem involved in the liquid-crystal display device on the conventional driving scheme. FIG. 35A shows a characteristic (T-V characteristic) of an application voltage to liquid-crystal layer versus transmissivity on a liquid-crystal display device of vertically aligned type. In the graph, the curve A shown by the solid line having plotting with solid circle marks represents a T-V characteristic in the frontward direction while the curve B shown by the solid line having plotting with asterisk marks represents a T-V characteristic in a direction of azimuth 90 degrees and polar angle 60 degrees relative to the display screen (hereinafter, referred to as "oblique direction"). Here, azimuth is assumable an angle as measured counterclockwise from nearly a center of the display screen with reference to the horizontal direction. Meanwhile, polar angle is an angle defined with a vertical line taken at the center of the display screen.

In the part shown by a virtual circle C in FIG. 35A, there is caused a distortion in luminance change. For example, with a comparatively low luminance at an application voltage of approximately 2.5 V, transmissivity is higher in the oblique direction than in the frontward direction. However, with a comparatively high luminance at an application voltage of approximately 4.5 V, transmissivity is lower in the oblique direction than in the frontward direction. As a result, there is a decrease in the luminance difference within the range of effective drive voltage when viewing in the oblique direction. This phenomenon is to appear the most conspicuous as color changes. Namely, when viewing the display screen obliquely relative to the frontward direction, there is a change of color into white. FIG. 35B represents a tone-level histogram of red (R), green (G) and blue (B) of a video image taken from the front and in the oblique by a digital camera under the same condition. The abscissa represents a tone level (e.g., luminance increases as closer to 0, with 256 levels of 0-255) while ordinate represents an existence percentage (%). It can be seen that, in the frontward direction, the R, G, B distributions are distant from one another whereas, in the oblique direction, the distributions are closer to one another. Due to this, the color in nature is lost.

The methods for improving this phenomenon are disclosed in Patent documents 1 to 7. FIG. 36 shows a basic pixel structure shown in Patent Document 1. FIG. 36A represents a typical view of a pixel structure taken in a normal-line direction to the display screen, FIG. 36B represents an equivalent circuit of a pixel 121 and FIG. 36C represents a sectional structure of the pixel 121. As shown in FIG. 33B, usually one pixel electrode 109 is connected to one TFT 110. However, as shown in FIG. 36A, one pixel is split into four sub-pixels 121*a*, 121*b*, 121*c* and 121*d*. The sub-pixels 121*a*, 121*b*, 121*c* and 121*d* are electrically in a relationship of capacitance coupling. When voltage is applied to the pixel 121 through the TFT 110, charge is distributed in accordance with the capacitance ratio of the sub-pixels 121*a*, 121*b*, 121*c* and 121*d* thus applying different voltages to the sub-pixels 121*a*, 121*b*, 121*c* and 121*d*. Due to this, the distortion on the T-V characteristic shown in FIG. 35A is dispersed by the sub-pixels 121*a*, 121*b*, 121*c* and 121*d*, thereby moderating the white on the screen. Incidentally, the principle of dispersing the distortion in T-V characteristic will be referred to later. Hereinafter, the method of splitting the pixel 121 into the sub-pixels 121*a*, 121*b*, 121*c* and 121*d* is referred to as an HT (halftone grayscale) technique based on capacitance coupling. The HT technique based on capacitance coupling is applied to the display mode of the TN type liquid-crystal display.

[Patent Document 1]
JP-A-3-122621
[Patent Document 2]
JP-A-4-348324
[Patent Document 3]
JP-A-5-66412
[Patent Document 4]
JP-A-5-107556
[Patent Document 5]
JP-A-6-332009
[Patent Document 6]
JP-A-6-519211
[Patent Document 7]
JP-A-2-249025

In the HT technique based on capacitance coupling, the pixel structure is extremely complicated. First, one pixel must be split into a plurality of pixels. In case the sub-pixel is poor in pattern going into a contact, a point defect results. Meanwhile, for capacitance coupling, there is a necessity to arrange three-dimensionally the sub-pixels 121*a*, 121*b*, 121*c* and 121*d* between the opposite electrode 118 and the controlling capacitor electrode 122 formed on the TFT substrate, as shown in FIG. 36C. In the case of an occurrence of short circuit between layers or the like, the entire pixel goes into a point defect. Meanwhile, in the case when capacitance distribution is changed by pattern breakage or so forth, luminance is changed in the entire pixel. In this case, point defect is encountered. Furthermore, splitting as sub-pixels greatly reduces the opening ratio. The HT technique based on capacitance coupling unavoidably suffers the reduction in opening ratio. In order to moderate the opening-ratio reduction to a possible minimum extent, there is a need to make transparent the two layer electrodes forming the capacitance. In this case, because the process increases in film deposition, there is encountered a great effect upon the process, e.g., mounting up of manufacturing cost, process capability lowering, etc.

Meanwhile, the HT technique based on capacitance coupling involves the problem that drive voltage is required to be high. This is attributable to a voltage loss caused in capacitance coupling, i.e., higher drive voltage is required as the number of split sub-pixels increases. Higher drive voltage requires increasing consumption power. Furthermore, high breakdown strength of a drive IC is required which raises cost. Also, because the HT technique based on capacitance coupling is provided with a potential difference by the sub-pixels, the T-V characteristic combined is non-continuous. Display characteristic is inferior to that in the ideal state where the T-V characteristic is continuous in change.

As in the above, although the HT technique based on capacitance coupling has an effect to improve display characteristic, it is not adopted for the liquid-crystal display devices presently available in the market. Meanwhile, the TN liquid-crystal display device, as viewed obliquely, problematically has increased intensity of black thus lowering contrast. The HT technique based on capacitance coupling is an art to correctly represent a neutral tonal intensity. However, under reduced contrast, it is impossible to exhibit the color representation effect at a neutral-tone intensity level.

SUMMARY OF THE INVENTION

It is an object of the present invention to provide an image processing method for providing wide viewing angle and excellent tonal-intensity viewing angle characteristic and a liquid-crystal display device using the same.

According to the present invention, there is provided an image processing method characterized by combining a higher-luminance pixel to be driven higher in luminance than the luminance data of an image to be displayed and a lower-luminance pixel to be driven lower in luminance than the luminance data, and determining a luminance on the higher-luminance pixel and luminance on the higher-luminance pixel as well as an area ratio of the higher-luminance and lower-luminance pixels in a manner obtaining a luminance nearly equal to a desired luminance based on the luminance data.

BRIEF DESCRIPTION OF THE DRAWINGS

FIG. 5 is a figure showing a result of a subjective evaluation as to whether or not a sandiness feeling of pixels is to be visually perceived according to example 1-1 in the first embodiment of the invention;

FIG. 8 is a figure showing a result of a visual evaluation on the effect of sandiness according to example 1-3 in the first embodiment of the invention;

FIG. 9 is a figure showing a result of a visual evaluation on the effect of sandiness on moving-image display according to example 1-3 in the first embodiment of the invention;

FIGS. 21A and 21B are figures explaining an image converting method according to example 2-5 in the second embodiment of the invention;

FIGS. 27A-27C are figures explaining a transition of selecting a tone-level conversion table for an input tone level according to example 3-2 in the third embodiment of the invention;

DESCRIPTION OF THE PREFERRED EMBODIMENTS

First Embodiment

Explanation is made on an image processing method and liquid-crystal display device using the same according to a first embodiment of the present invention, with using FIGS. 1 to 10. Although explained concretely in the embodiment, the liquid-crystal display device, throughout the embodiments, is of the MVA scheme using a liquid-crystal panel in a vertical alignment mode (liquid-crystal display device of a vertically aligned type) capable of suppressing the black intensity low.

EXAMPLE 1-1

Figure 1A:
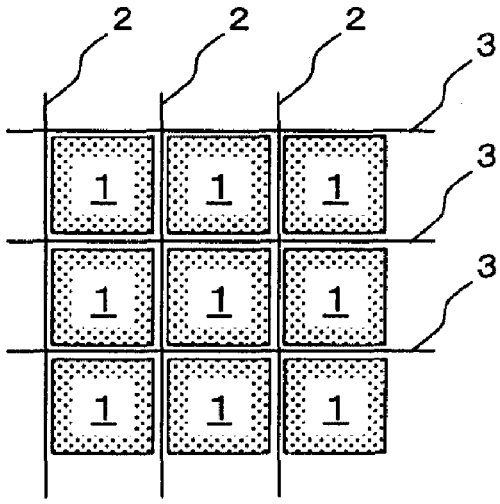
FIGS. 1A and 1B are figures showing an example that light pixels 1*a* and dark pixels 1*b* are set to nine pixels 1 according to example 1-1 in a first embodiment of the present invention.
Figure 1B:
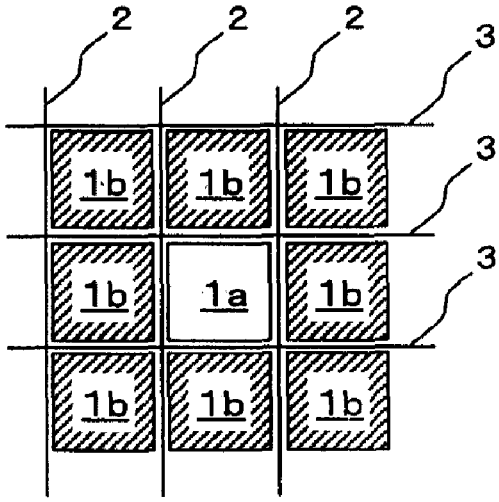

Explanation is made on an image processing method and liquid-crystal display device using the same according to the present example, using FIGS. 1 to 5. First explained is the principle of the image processing method according to this example, by using FIG. 1. In this example, a plurality of pixels are grasped as one unit, to provide higher luminance to part of the plurality of pixels than the luminance of the unprocessed original image (hereinafter, referred to as "unprocessed image") and lower luminance to part or the entire of the remaining pixels than that of the unprocessed image. The pixels to be increased in luminance (hereinafter, referred to as higher-luminance pixels) and the pixels to be decreased in luminance (hereinafter, referred to as lower-luminance pixels) are set in ratio such that the luminance in the frontward direction is unchanged around the image processing and the total area of the pixels to be decreased in luminance is equal to or broader than the total area of the pixels to be increased in luminance. FIG. 1 depicts an example that nine pixels 1 in a 3×3 matrix form are grasped as one unit, to provide one higher-luminance pixel 1*a* and eight lower-luminance pixels 1*b*. In contrast to the luminance on the nine pixels 1 shown in FIG. 1A, those in FIG. 1B are increased in luminance only on the central pixel 1*a* while the remaining surrounding pixels 1*b* are decreased in luminance.

The inventors have found that it is possible to express the magnitude of effect in visual perception of a distortion in the characteristic of application voltage versus transmissivity, (T-V) characteristic, of the vertically-aligned liquid-crystal display device, by a distortion-affection evaluation number (60°)=(T60/T0)×(T60−T0). In the expression, T0 is the luminance as viewed in the frontward direction of the display screen while T60 is the luminance (or lightness) as viewed in the direction at an angle of 60° to the frontward direction (in the oblique 60° direction).

Figure 2A:
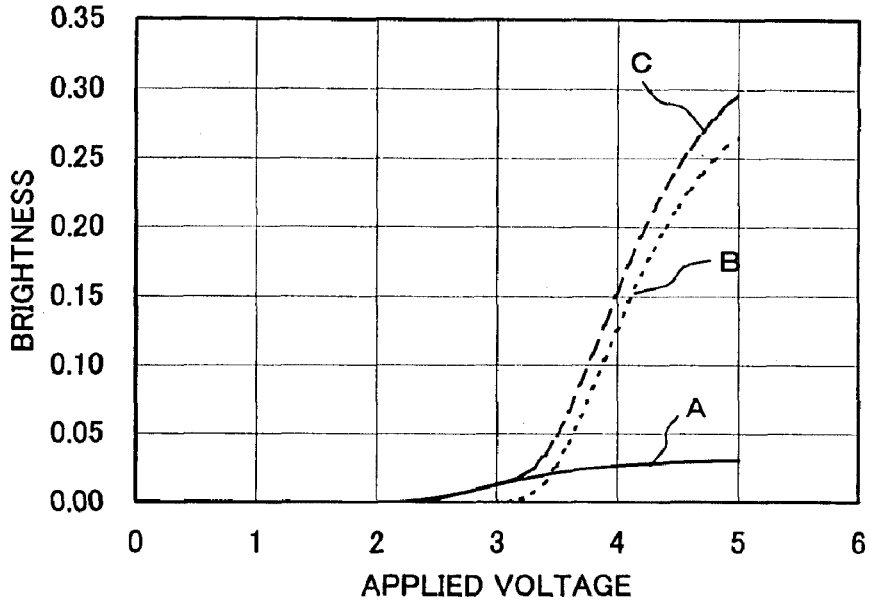
FIGS. 2A and 2B are graphs showing a measurement result of a characteristic of application voltage versus transmissivity in a frontward direction and in a oblique 60° direction according to example 1-1 in the first embodiment of the invention.

FIG. 2 is a graph showing a measurement result of a characteristic of liquid-crystal application voltage versus lightness in the frontward direction and in the oblique 60° direction when an image is displayed on the liquid-crystal display device by using the present example. FIG. 2A shows a characteristic of liquid-crystal application voltage versus lightness obtained in the front of the liquid-crystal panel. The abscissa represents an application voltage to the liquid crystal on the higher-luminance pixel 1*a* while the ordinate represents a lightness (arbitrary unit (a.u.)). The curve A shown by the solid line in the graph represents a characteristic of liquid-crystal application voltage versus lightness on the one higher-luminance pixel 1*a* whereas the curve B shown by the broken line represents a characteristic of liquid-crystal application voltage versus lightness on the eight lower-luminance pixels 1*b*. The curve C shown by the one-dot chain line shows a resultant characteristic of liquid-crystal application voltage versus lightness of the characteristics of curve A and curve B.

The higher-luminance pixel 1*a* is to be applied by a voltage higher than the application voltage to the unprocessed image while the lower-luminance pixel 1*b* is to be applied by a voltage lower than the application voltage to the unprocessed image. Meanwhile, the higher-luminance pixels 1*a* have a total occupation area over the entire display screen narrower than the total area of the lower-luminance pixels 1*b*. The higher-luminance pixel 1*a* has a maximum lightness lower than a total maximum lightness of the eight lower-luminance pixels 1*b*.

Specifically, with respect to the voltage V (volts) to be applied to the liquid crystal on the higher-luminance pixel 1*a*, a voltage V-1 (volts) is applied to the liquid crystal on the lower-luminance pixels 1*b*. Note that, in FIG. 2A, the V-1 (volts) characteristic on the lower-luminance pixel 1*b* is shifted by +1 volt into a shown position of V (volts). Meanwhile, provided that the total area of the higher-luminance pixels 1*a* over the entire display screen is 1, the lower-luminance pixels 1*b* have the total area of 8 (see FIG. 1). As shown by the curves A and B in FIG. 2A, the one higher-luminance pixel 1*a* having an application voltage 5V in displaying white has a luminance of 0.03 (a.u.) whereas the eight lower-luminance pixels 1*b* have a total lightness nine times higher than that, i.e., nearly 0.27 (a.u.).

In such a relationship of the combination of one higher-luminance pixel and eight lower-luminance pixels 1*b*, the characteristic of liquid-crystal application voltage versus lightness the curve C shown by the one-dot chain line is obtained by combining the characteristic of curve A and the characteristic of curve B. The characteristic c shown by the curve C is in a curve nearly the same in form as the frontward characteristic in the application voltage versus transmissivity, (T-V) characteristic, to the liquid layer in displaying the unprocessed image shown in FIG. 35A.

Figure 2B:
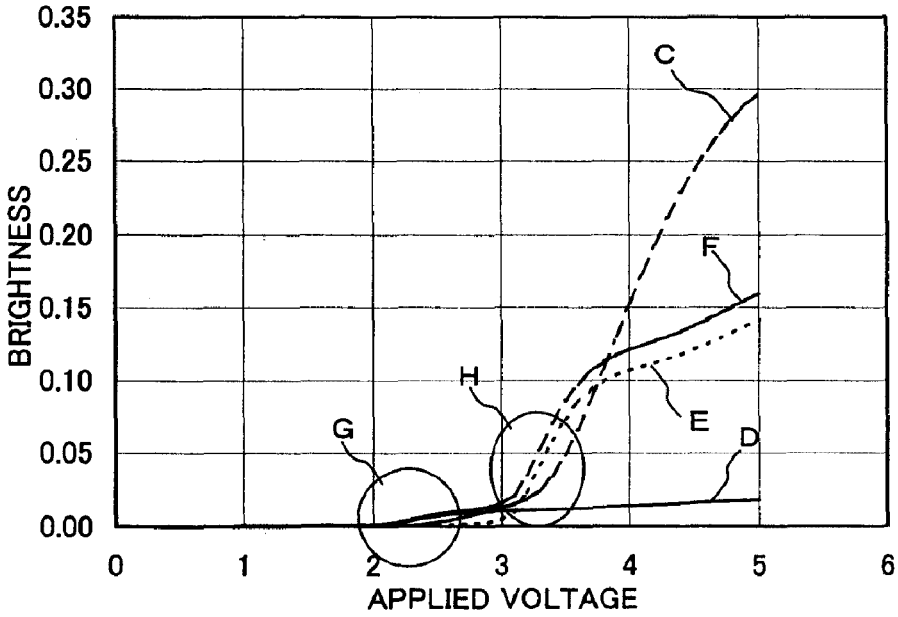

FIG. 2B shows a characteristic change on the liquid-crystal panel having a characteristic of application voltage versus lightness shown in FIG. 2A, as viewed in the oblique 60° direction. The abscissa represents an application voltage to the liquid crystal on the higher-luminance pixel 1*a* for example while the ordinate represents lightness (arbitrary unit (a.u.)). The curve D shown by the solid line in the graph represents a characteristic of liquid-crystal application voltage versus lightness on the one higher-luminance pixel 1*a* in the oblique 60° direction while the curve E shown by the broken line represents a characteristic of liquid-crystal application voltage versus lightness on the eight lower-luminance pixels 1*b* in the oblique 60° direction. The curve F shown by the two-dot chain line represents a characteristic of liquid-crystal application voltage versus lightness in combination of curves D and E, in an oblique 60° direction. The characteristic shown by the curve F is in a curve nearly the same in form as the characteristic in the oblique 60° direction of the application voltage versus transmissivity (T-V) characteristic to the liquid-crystal layer in displaying the unprocessed image shown in FIG. 35A. Incidentally, in FIG. 2B, there is shown also a curve C (one-dot chain line) representing the resultant characteristic of liquid-crystal application voltage versus lightness in the frontward direction, similar to that shown in FIG. 2A.

Comparing between the curve C representing the frontward direction characteristic and the curve F representing the characteristic in the oblique 60° direction, it can be seen as shown in FIG. 2B that the curve F, at two points of virtual circles G and H, is higher in lightness than the curve C. In the virtual circle G, it is the curve D of the curves D, E that is higher in lightness than the curve C. Accordingly, distortion is responsible for the higher-luminance pixel 1*a*. However, because the higher-luminance pixel 1*a* in the virtual circle is sufficiently low in lightness, the distortion cannot be seen by visual observation. This is because the difference is small between the frontward direction lightness TO and the lightness T60 at the oblique 60° direction, i.e., of having an effect to reduce the term (T60−T0) in the expression of distortion influencing evaluation number (60°).

Meanwhile, in the virtual circle H, it is the curve E of the curves D, E that is higher in lightness than the curve C. Accordingly, distortion is responsible for the eight lower-luminance pixels 1*b*. However, because the higher-luminance pixel 1*a* not responsible for the distortion is sufficiently high in total luminance to reach, the ratio of lightness T60 at the oblique 60° direction to a frontward direction lightness T0 approximates 1 closer to the conventional device. Namely, there is an effect to reduce the term (T60/T0) in the expression of distortion influencing evaluation number (60°).

Figure 35A:
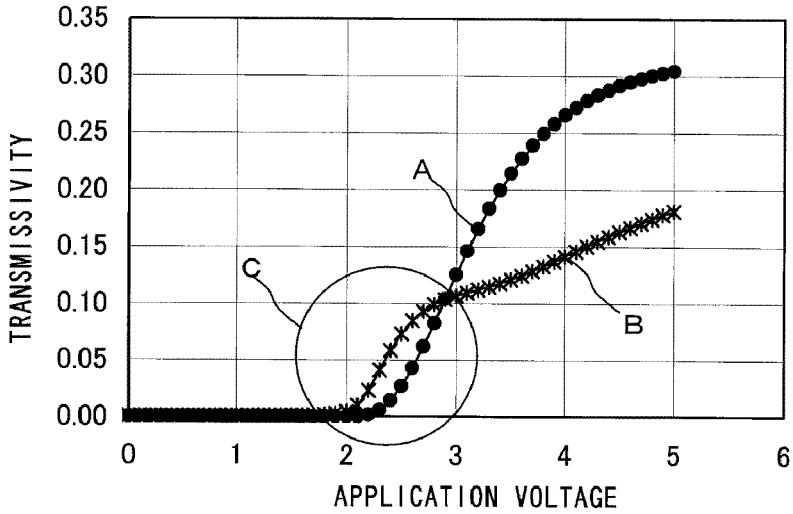
FIGS. 35A and 35B are figures explaining a problem involved by the liquid-crystal display device on the conventional driving.

As shown in FIG. 2B, by using the image processing method of this example, the present example can suppress, to 2 times or smaller, (T60/T0) given in the virtual circle C representing a distortion domain in the T-V characteristic shown in FIG. 35A lying in a level of 3 to 4 times. This can greatly suppress the occurrence of a straw-colored image during viewing in the oblique direction.

Figure 3A:
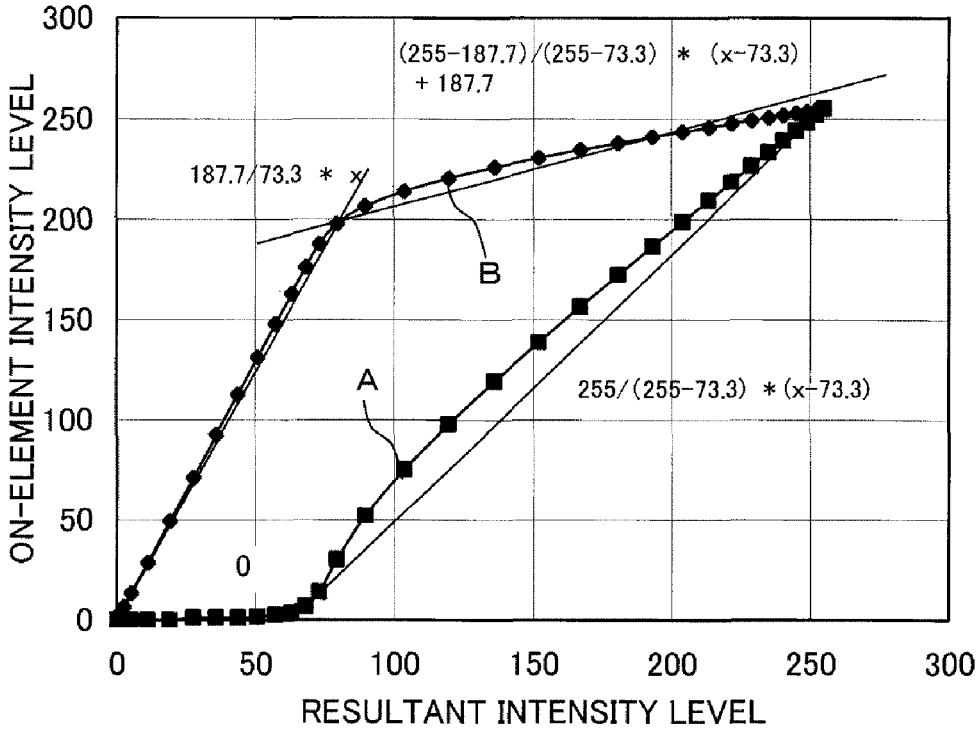
FIGS. 3A and 3B are figures showing an example of tone-level conversion table and an image around a conversion according to example 1-1 in the first embodiment of the invention.

FIG. 3 shows one example of preparing a tone-level conversion table and an image around the change. FIG. 3A shows an example of preparing a tone-level conversion table for determining a tone level for setting to the higher-luminance pixel 1*a* and lower-luminance pixel 1*b* of after image processing on the basis of the tone level of the unprocessed image. FIG. 3A exemplifies a case that the higher-luminance pixel 1*a* and the lower-luminance pixel 1*b* are in a ratio of 1:10 in the number of pixels. The abscissa represents a tone level (combined tone level) on the unprocessed image while the ordinate represents a tone level to be set after conversion. For example, in the case the unprocessed image has a luminance at a tone level 100/255, the post-change luminance to be actually displayed on the liquid crystal panel is at a tone level 70/255 over the pixels of ten out of eleven lower-luminance pixels 1*b* (10/11 pixels), from the curve A shown by the solid line with the plotting of solid-square marks in the graph. Incidentally, the curve A, when the abscissa is taken as x and the ordinate as y, is approximated as $y=0$ (where $0 \leqq x \leqq 73.3$), $y=(255/(255-73.3))\times(x-73.3)$ (where $73.3 \leqq x \leqq 255$).

Furthermore, it can be seen from the curve B shown by the solid line with the plotting of solid-diamond marks that the tone level 215/255 should be provided to one out of eleven higher-luminance pixels 1*a*. Incidentally, the curve B, when the abscissa is taken as x and the ordinate as y, is approximated as $y=(187.7/73.3)\times(x)$ (where $0\times73.3$), $y=((255-187.7)/255-73.3))\times(x-73.3)+187.7$ (where $73.3\times255$).

The lower-luminance pixels 1*b*, in the number of 10 out of 11 pixels, lowers in luminance (lightness) because of being converted from a tone level 100 into a tone level 70. The higher-luminance pixels 1*a*, in the number of 1 out of 11 pixels, are converted from a tone level 100 into a tone level 215 and increased in luminance (lightness), thus compensating for the lowering in luminance on the ten lower-luminance pixels 1*b*. Therefore, the luminance in the frontward direction of after image processing can be maintained at the luminance of the unprocessed image.

Figure 3B:
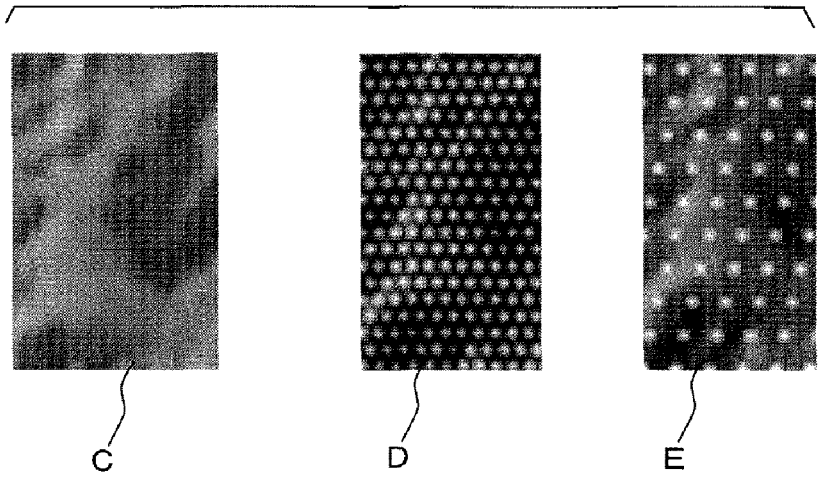

FIG. 3B shows magnifying photographs of pictures at around the conversion. The picture C shows an unprocessed image. The picture D shows a magnification view of a picture due to a conversion in the area ratio of 1:3 of the higher-luminance pixel 1*a* and lower-luminance pixel 1*b*. The picture E shows a magnifying view of an image due to a conversion in the area ratio of 1:15 of the higher-luminance pixel 1*a* and lower-luminance pixel 1*b*.

Figures 4A, 4B:
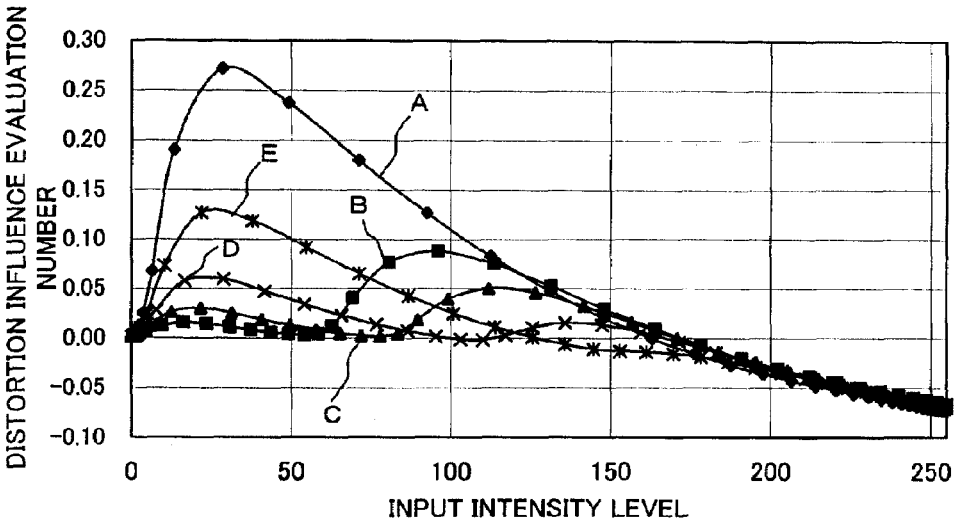
FIGS. 4A and 4B are graphs showing a relationship between a percentage of light and dark pixels and a distortion-effect evaluation number according to example 1-1 in the first embodiment of the invention.

FIG. 4 shows a relationship between an area ratio of the higher-luminance pixel 1*a* and lower-luminance pixel 1*b* and a distortion influence evaluation number. FIG. 4A is a graph showing a relationship between an area ratio of the higher-luminance pixel 1*a* and lower-luminance pixel 1*b* and a distortion influence evaluation number. The abscissa represents a tone level (input tone level) of a video signal inputted to the liquid-crystal display device while the ordinate represents a distortion influence evaluation number. Incidentally, in FIG. 4 and the subsequent, double-circle mark represents a good state, circle mark represents a state of fairly better than the usual, and times mark represents a poor state. On the usual panel not image-processed by this example, there is undergone the influence of distortion, peaked at a tone level 40/255, over a broad range (the curve A shown by the solid line of the plotting with solid diamond marks in the graph). Contrary to this, the image processing of this example, if applied, disperses the influence of distortion into two regions wherein the distortion influence evaluation number is decreased in value (curves B, C, D and E). This means the fact that the influence of distortion is reduced in degree.

FIG. 4B is a result of visual evaluation of the influence of distortion on two kinds of images F and G in the case the higher-luminance pixel 1*a* and the lower-luminance pixel 1*b* are changed in area ratio. Effect is obtained in a broad range over an area ratio of the higher-luminance pixel 1*a* and lower-luminance pixel 1*b* (hereinafter, explained shortly as light/dark area ratio) of from 1:1 to 1:15. Particularly, great effect is obtained in a light/dark area ratio of from 1:7 to 1:3. Incidentally, in a case where the light/dark area ratio falls out of this range, the dispersion of distortion deviates toward one side, making it difficult to obtain the effect. By thus merely processing the image electrically, the influence of distortion dependent upon viewing angle can be greatly relieved without modifying at all the pixel structure of the liquid-crystal panel.

In the meanwhile, the image processing of this example is done after inputting a video signal to the liquid-crystal display device from a system-sided apparatus, such as a personal computer. Specifically, image processing is made on an interface circuit, such as a control IC, mounted on the liquid-crystal display device, to convey the video signal to the source driver IC for driving the liquid-crystal panel. However, the similar image processing is not necessarily made in this stage. For example, by providing the image processing function to a video processing chip provided on a system-sided apparatus, such as a personal computer, price can be lowered. Meanwhile, realization is possible by providing an image processing function on OS or software.

FIG. 5 is a figure showing a result of subjective evaluation whether or not the light-intensity sandiness feeling of light intensity over the pixels can be visually perceived where image processing is made on a liquid-crystal panel having a pixel pitch of 0.3 mm in the widthwise direction. When the viewer goes distant from the screen, sandiness becomes inconspicuous because the difference of luminance between the adjacent pixels are less visible. Meanwhile, when the area ratio nears 1:1, sandiness is inconspicuous because the spacing is reduced between the light pixel and the dark pixel. For the street, public display device, because assumption may be made for the use in a state the human and the display device are distant 1 to 2 m, sufficient effect can be obtained on the panel having a pitch of 0.3 mm. Meanwhile, in the application of personal-computer monitor or the like, because use is in a state the user and the screen is close in distance, it should be assumed to take a distance of approximately 20 cm between the user and the screen. In the case the ratio of pixel lightness and darkness is taken 4:12, sandiness can be visually perceived up to a distance of approximately 60 cm. It can be considered that application is possible in the relevant use if the liquid-crystal panel is made with a pixel pitch of approximately 0.1 mm.

EXAMPLE 1-2

Figure 6:
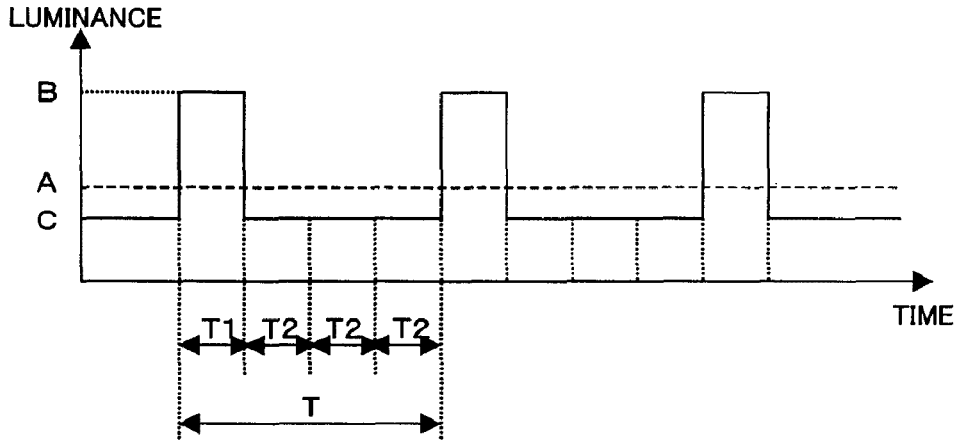
FIG. 6 is a figure showing an image processing method according to example 1-2 in the first embodiment of the invention.

Now example 1-2 of this embodiment is explained by using FIG. 6. Although example 1-1 was so-called the spatial image processing method that higher-luminance pixels and lower-luminance pixels are separately provided within a predetermined pixel region, this example is characterized by so-called an in-time image processing method that lightness is increased and decreased at a predetermined time interval.

FIG. 6 is a figure illustrating the image processing of this example. For certain one pixel, provided are a frame increased in lightness higher than a luminance level A of the unprocessed image (hereinafter, referred to as a higher-luminance frame) T1 and a frame decreased in lightness (hereinafter, referred to as a lower-luminance frame) T2. A luminance level B (luminance level B>luminance level A) is given in the frame T1 while a luminance level C (luminance level C<luminance level A) is given to the frame T2. The luminance level within each frame is set such that the average luminance in combination of the higher-luminance frame T1 and the lower-luminance frame T2 equals the luminance of the unprocessed image. The in-time image processing method of the example can realize the relaxation of the deformation, quite similarly to example 1-1.

FIG. 6 shows an example that luminance conversion is carried out in time at a ratio of 1:3. Lower-luminance frames T2 are made continued three times to one higher-luminance frame T1. Taking the one higher-luminance frame T1 and three lower-luminance frames T2 as one set T, to repeat the set T chronologically. By applying this over the entire screen, sandiness over the screen can be suppressed in a similar manner to example 1-1. This however allows flicker to be visually perceived. It is known that flicker at a 60 Hz component is not to be seen. In the case of driving at a frame frequency of 60 Hz, a 15-Hz component of flicker is visually perceived. By taking a ratio of the higher-luminance frame T1 and lower-luminance frame T2 as 1:1, flicker can be relieved to a considerable low extent because the factor of flicker is reduced to 30 Hz. Furthermore, in case the ratio of the higher-luminance frame T1 and lower-luminance frame T2 is taken as 1:1 and the frame frequency is raised up to 120 Hz, flicker is not to be seen by the human eye because the factor of flicker is 60 Hz.

Incidentally, the image processing method according to this example may be implemented on the LCD side or on the system side, similarly to the explanation in example 1-1.

EXAMPLE 1-3

Now example 1-3 according to the present embodiment is explained by using FIGS. 7 to 9. This example is characterized in that both sandiness and flicker are less to be seen by combining the image processing method of example 1-1 and the image processing method of example 1-2. In this example, splitting is into higher-luminance pixels and lower-luminance pixels within the predetermined pixel unit as in example 1-1, to further cause the light intensity to change frame by frame, instead of changing the light intensity over the entire screen collectively based on the frame as was done in example 1-2.

Figure 7A:
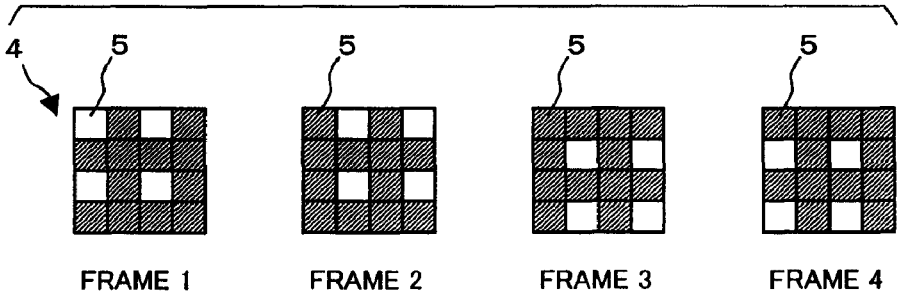
FIGS. 7A and 7B are figures typically showing pixels in a predetermined region according to example 1-3 in the first embodiment of the invention.
Figure 7B:
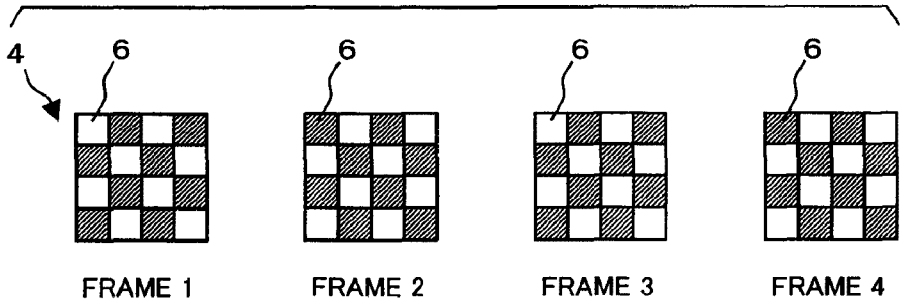

FIG. 7 shows typically a predetermined pixel group in an LCD display area, in order to explain the image processing method of this example. Specifically, shown is an example that 16 pixels in a 4×4 matrix form are taken as one unit, to set the light intensity on each pixel. In FIG. 7A, the light intensity is partitioned on the 16 pixels within the frame in a ratio of 1:3 in a manner not to place adjacent higher-luminance pixels at the end side. In FIG. 7B, the light intensity is partitioned on the 16 pixels in the frame in a ratio of 1:1 in a manner not to place higher-luminance pixels at the end side. Furthermore, the pixel-based light intensity is changed at an interval of a predetermined number of frames. For example, in FIG. 7A, setting is made to change the frame-based light intensity on each pixel with a period of 1:3. For example, putting the eye on pixel 5, the pixel 5 changes as light, dark, dark and dark in the order of from the first frame to the fourth frame.

In FIG. 7B, setting is made to change the frame-based light intensity on each pixel with a period of 1:1. For example, putting the eye on pixel 6, the pixel 6 changes as light, dark, light and dark in the order of from the first frame to the fourth frame.

Setting the ratio in time of light intensity by taking a period of the first to fourth frame at 60 Hz in a ratio of 1:1 thereby confirming display quality, realized was display sufficiently moderated in sandiness feeling without visual perception of flicker.

FIG. 8 is a result of visual evaluation on the influence of sandiness in this example. It can be seen that the sandiness is much moderated as compared to that of FIG. 5. Accordingly, application is possible where the liquid-crystal display device is used close to the user as with the personal-computer monitor. It is possible to obtain an improvement effect high in viewing angle dependence in almost all the applications.

Furthermore, in the case limited to displaying the moving image such as TV applications, it is further difficult to perceive sandiness because of image movement. FIG. 9 is a result of visual evaluation of the influence of sandiness upon displaying a moving image. This result indicates that the image processing method of this example, where applied to the product to limitedly display a moving image, can be used without being conscious of sandiness.

Incidentally, the image processing method according to this example may be implemented on the LCD side or on the system side, similarly to the explanation in example 1-1.

Figure 10:
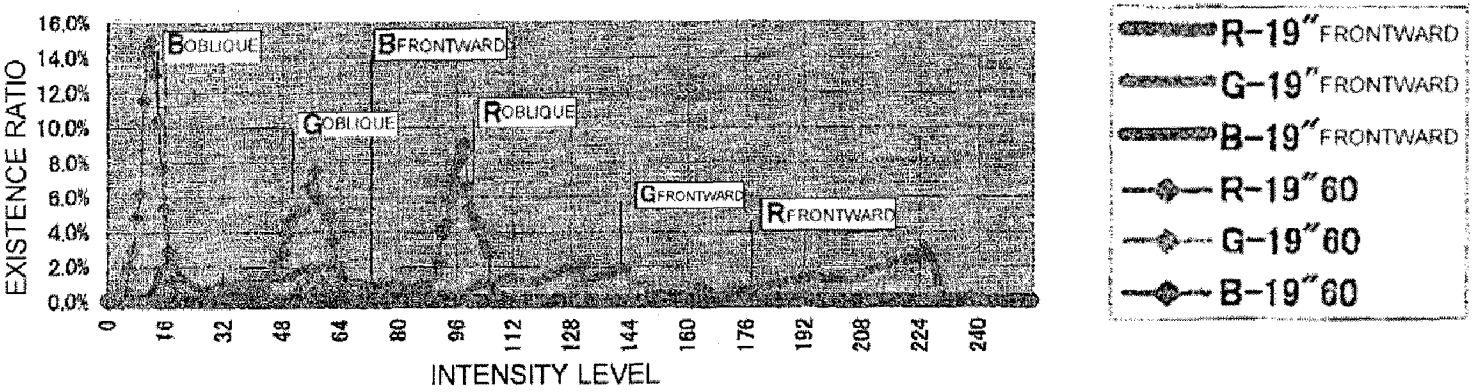
FIG. 10 is a figure showing an effect according to the first embodiment of the invention.
Figure 35B:
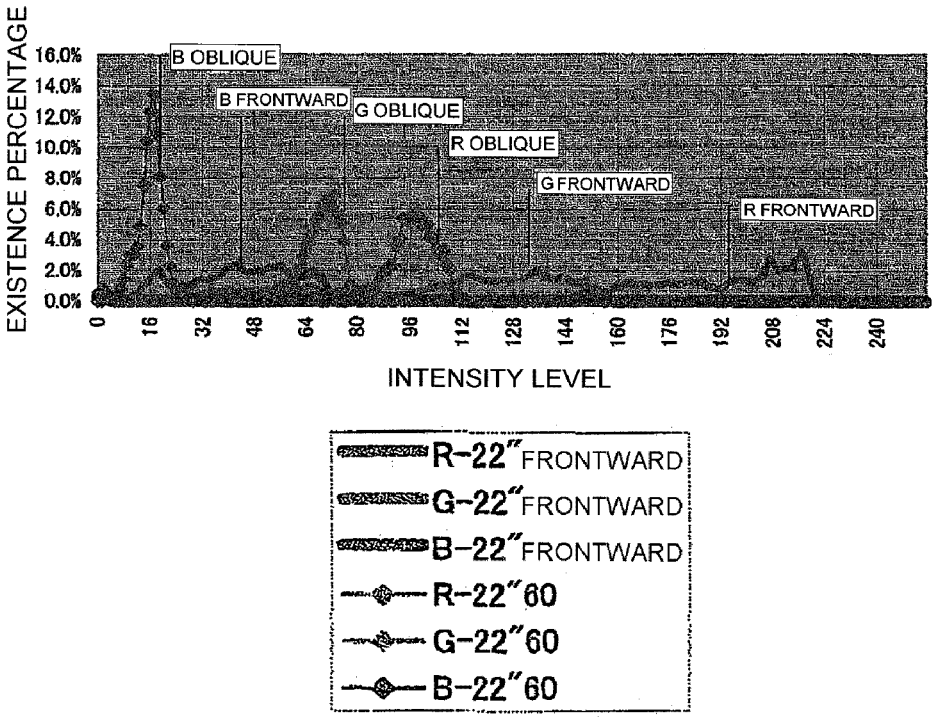
Figure 36A:
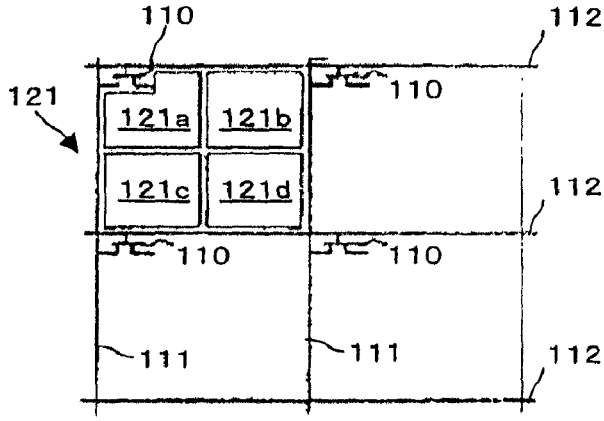
PRIOR ART FIG.36A
FIGS. 36A-36C are figures showing a pixel structure in the prior art.
Figure 36B:
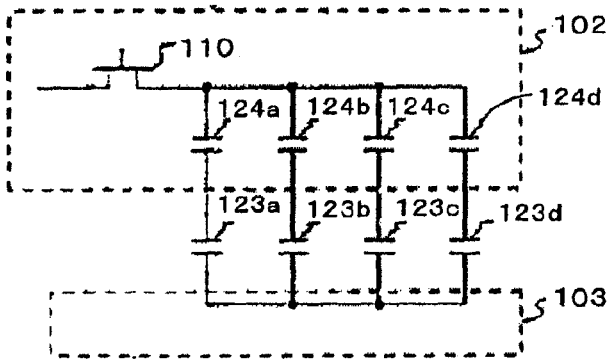
PRIOR ART FIG.36B
Figure 36C:
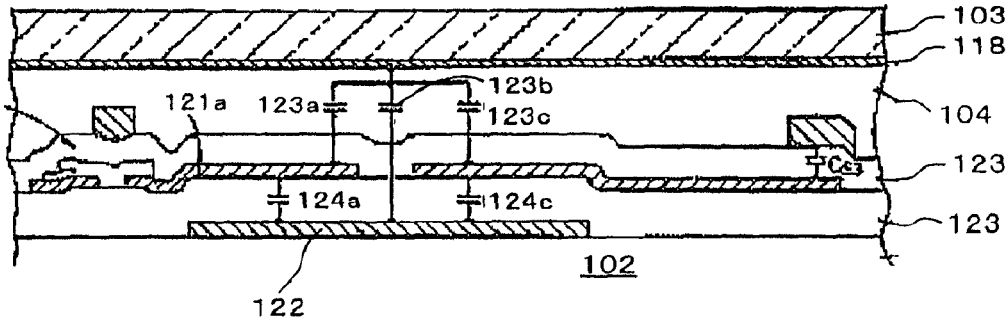
PRIOR ART FIG.36C

FIG. 10 shows a tone-level histogram of three primary colors of red (R), green (G) and blue (B) of the video image taken in the front and oblique directions by a digital camera under the same condition of the same image as that of FIG. 35B displayed on an MVA-LCD. The Abscissa represents a tone level (e.g., 256 levels of 0-255, wherein light intensity increases as 0 is neared) while ordinate represents a ratio of existence (%). Although color distribution in the oblique direction is neared and the colors in nature are lost in the display of FIG. 35B showing the prior art problem, it can be seen that in a case where the present example is applied, green (G), particularly, distributes distant from red (R) and approximates into the color in nature, as shown in FIG. 10. The comparative dark as compared to in the front is because the light-intensity distribution of backlight is obliquely darkened as compared to the frontward direction, but is not due to the LCD itself.

As discussed above, the present example can easily realize an image processing method broad in viewing angle and excellent in color reproduction and a liquid-crystal display device using the same.

Second Embodiment

Now explained is an image processing method and liquid-crystal display device using the same according to a second embodiment, by using FIGS. 11 to 22. This embodiment aims at improving the reproducibility of the neutral tone color by the use of a vertically-aligned liquid-crystal display device that the light intensity in black is to be least influenced depending upon viewing angle. Particularly, this embodiment provides an image processing method that can sufficiently reduce the display change in oblique directions as a defect of the relevant liquid-crystal display device and a liquid-crystal display device using the same.

This embodiment describes an image conversion processing method capable of converting the same tone level of input video signal into a plurality of different tone levels and of easily obtaining a tone-level viewing-angle characteristic improvement effect. First explained is the fundamental principle of the image processing method of this embodiment by again using FIGS. 6 and 7. The image processing method of this embodiment is based on the fundamental concept that partition is made into higher-luminance pixels and lower-luminance pixels within a predetermined pixel unit as in embodiment 1-3 to further change light intensity on a frame-by-frame basis thereby improving the tone-level viewing-angle characteristic, instead of collectively converting frame by frame the light intensity on the entire screen as was done in example 1-2.

Such image processing is used, for example, in outputting from a small number of tone levels, e.g., 6-bit source driver IC, the number of tone levels greater than that output tone levels, e.g., 8-bit multi-tone-level display (256 levels). This is known as the dithering technique. In contrast to the dithering method capable of providing only two tone levels, the image processing method of this embodiment is characterized in that light intensity can be provided with two tone levels or more. Under some conditions, a luminance difference of 250/255 levels can be provided. Thus this is an art quite different from the conventional dithering technique.

Figure 11:
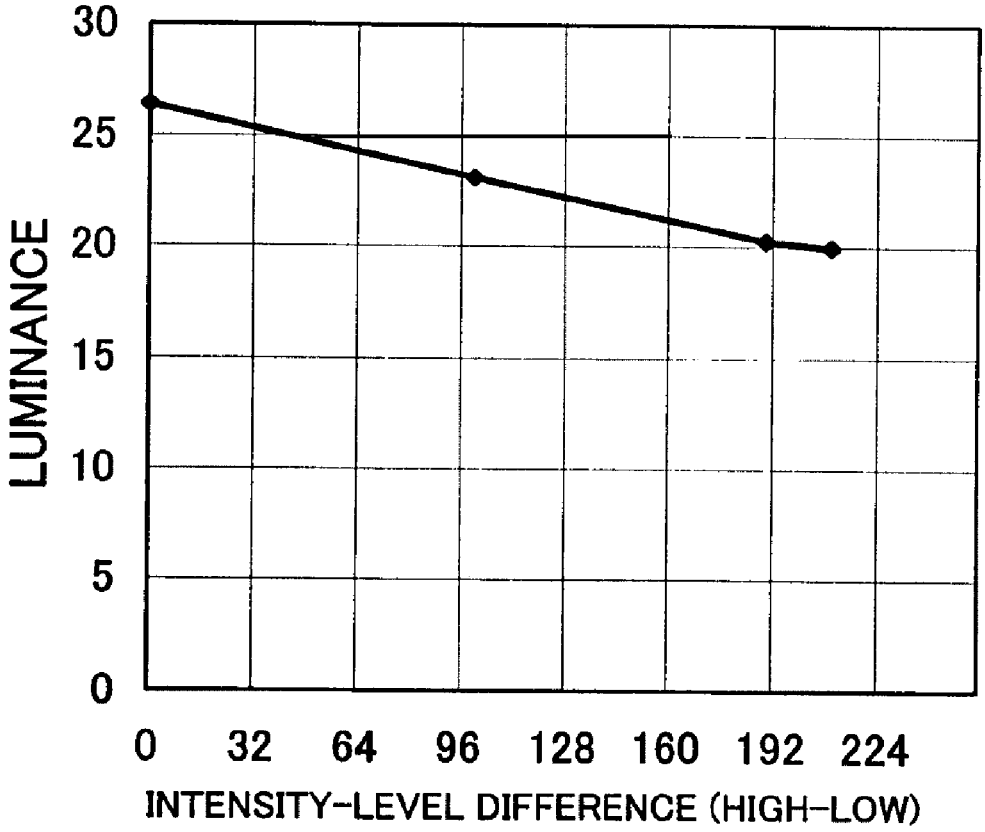
FIG. 11 is a figure showing a result of a luminance measurement in an oblique direction that image-process has been made on an unprocessed image at a tone level 127/255 according to a second embodiment of the invention.

By providing a pixel-to-pixel luminance difference with higher-luminance and lower-luminance pixels, the luminance as viewed obliquely can be changed without changing the luminance in the frontward direction. FIG. 11 shows a measurement result of a luminance obtained obliquely of a screen by making an image processing on an unprocessed image at a tone level 127/255. The abscissa represents a tone-level difference between the higher-luminance pixel and the lower-luminance pixel while the ordinate represents a luminance of the tone level 127/255 in the oblique direction. As is clear from FIG. 11, there is a tendency that the luminance in the oblique direction lowers as the tone-level difference is increased between the higher-luminance pixel and the lower-luminance pixel. In a case where the tone-level difference is controlled between the higher-luminance pixel and the lower-luminance pixel on each tone level of an unprocessed image by utilizing the relevant characteristic, the image quality, as viewed obliquely, can be improved without affecting the image quality in the frontward direction.

Figure 12A:
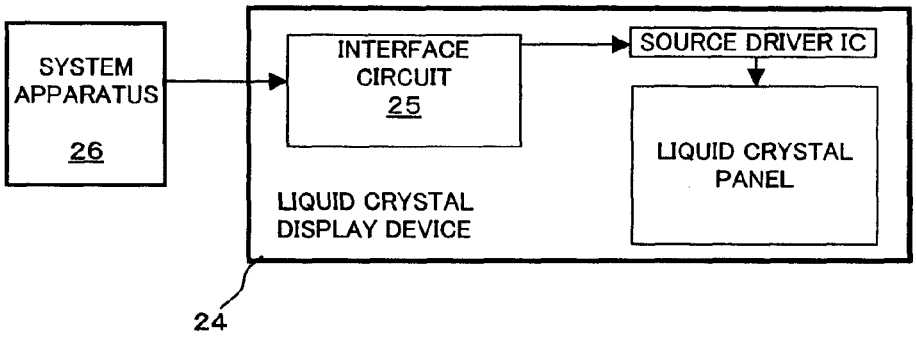
FIGS. 12A-12D are block diagrams of a system apparatus and liquid-crystal display device according to the second embodiment of the invention, explaining a part for carrying out the tone-level conversion process.
Figure 12B:
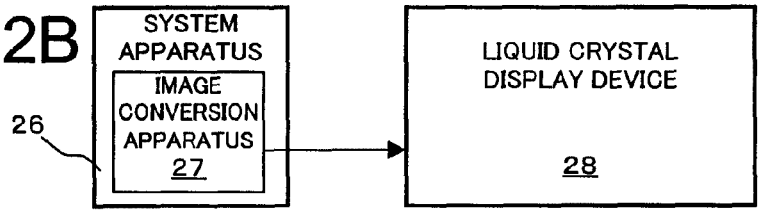
Figure 12C:
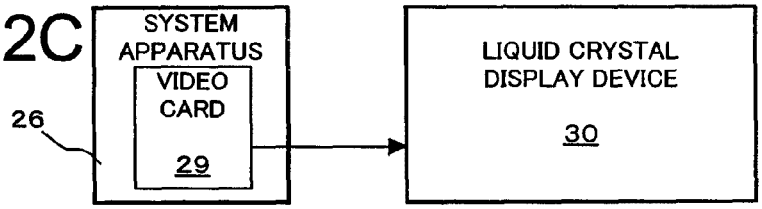
Figure 12D:
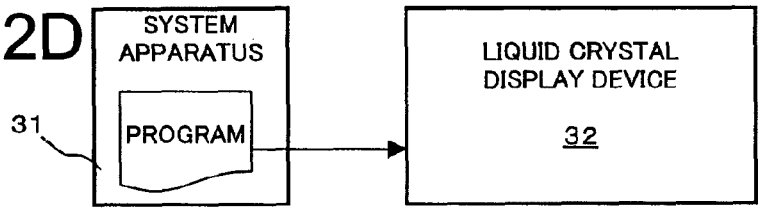

FIGS. 12A-12D are block diagrams having a system-sided apparatus (hereinafter, "system apparatus") such as a personal computer and a liquid-crystal display device, which is a figure to explain a tone-level conversion processing section. FIG. 12A shows an example that tone-level conversion processing is carried out by an interface circuit 25 as a component part of the liquid-crystal display device 24. In this case, because every image processing is made on the liquid-crystal display device 24 side, the system apparatus 26 and the liquid-crystal display device 24 have an interface specification not different from the conventional device, thus allowing the liquid-crystal display device 24 to maintain the compatibility with the conventional liquid-crystal display device 24. FIG. 12B shows an example that image processing is made in an image conversion apparatus 27 provided in a system apparatus 26, to output an video signal of after image-processing to the liquid-crystal display device 28. For example, the internal process of an image processing LSI provided in a personal computer video card, video camera deck or the like is fallen under this example. FIG. 12C is a method for converting the video signal between the liquid-crystal display device 30 and the system apparatus 26 while relaying the same by a video card 29 or the like. FIG. 12D shows an example that processing is made by a program of the system apparatus 31 in a software fashion without having a physical mechanism such as a video card or the like, to thereafter make an output to the liquid-crystal display device 32. In any of the cases of FIGS. 12A to 12D, similar effect is available on the display screen.

This embodiment can obtain the similar effect to that of example 1-1. Namely, by partitioning into a higher-luminance frame and a lower-luminance frame, the influence of distortion is dispersed into two regions. Moreover, because distortion influence evaluating number decreases in value, it is possible to greatly suppress the straw-colored image to be observed as viewed obliquely.

Figure 13:
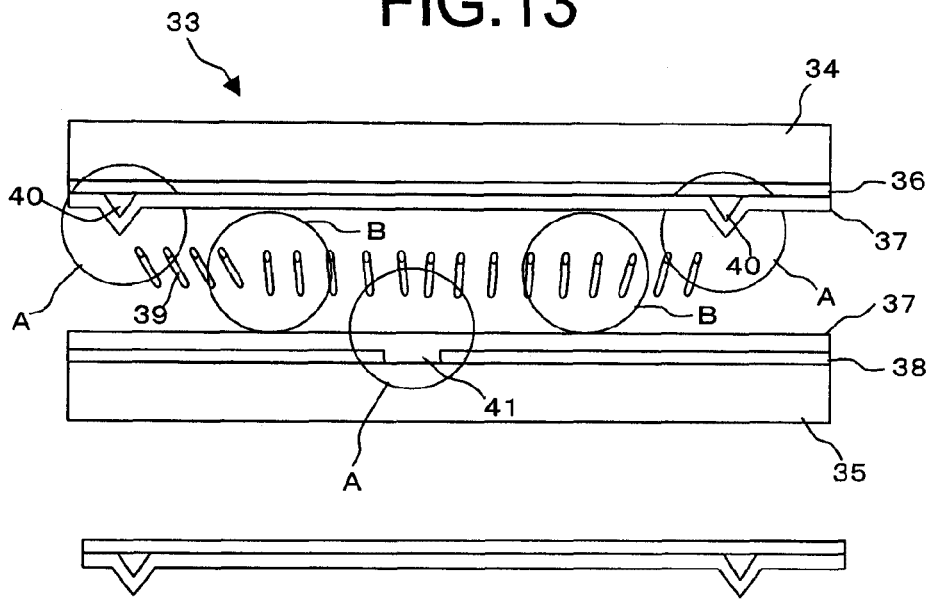
FIG. 13 is a figure explaining another effect according to the second embodiment of the invention, typically showing a sectional structure of a pixel 33.

FIG. 13 is a figure explaining another effect of this example, which is a typical view of a pixel 33 in sectional structure. The pixel 33 of a vertically-aligned liquid-crystal display device has a liquid crystal filled between an opposite substrate 34 and a TFT substrate 35. The opposite electrode 34 is formed with an opposite electrode 36. On the opposite electrode 36, formed is a protrusion 40 for regulating the tilt direction of a liquid-crystal molecule 39. An alignment film 37 is formed on the opposite electrode 36 and protrusion 40. A pixel electrode 38 and an alignment film 37 are overlaid the TFT substrate 35. A slit 41 is formed on the TFT substrate 35 side, to regulate the tilt direction of the liquid-crystal molecule 39 similarly to the protrusion 40. In this pixel 33 structure, when the liquid crystal responds rapidly, there occurs delicately a difference of response within the pixel 33 region, which response difference has an effect upon display quality. In the vicinity of the protrusion 40, slit 41, etc., shown by the virtual circle A, liquid crystal is quick in response because the direction in which the liquid crystal molecule 39 is to incline is definite. However, in the region shown by the virtual circle B distant from the protrusion 40 and slit 41, liquid crystal is slow in response because the direction in which the liquid-crystal molecule 39 is to incline is definite. Consequently, in the case light-intensity is repeatedly increased and decreased at a faster pace, even when applying the same voltage to the pixel 33, the angle the liquid-crystal molecule 39 is to incline within the pixel 33 is different from the ideal state, causing area halftone phenomenon that luminance is segmented into very fine areas. The occurrence of area halftone phenomenon disperses distortion as explained in FIG. 4, thus improving the viewing angle characteristic.

As explained in the above, the present embodiment can suppress the phenomenon that the entire display is white because reduced is the distortion caused by the luminance as viewed in the oblique direction as compared to the luminance as viewed from the frontward direction. Furthermore, the present embodiment can obtain the similar effect by the means of image processing far easier than compared to the conventional HT scheme based on capacitance coupling.

By utilizing the effect of this embodiment, the image quality at an oblique viewing angle can be improved without increase in drive voltage or decrease in opening ratio as encountered in the HT scheme based on capacitive coupling. When converting the unprocessed image into higher-luminance and lower-luminance pixels, luminance difference is changed between the higher-luminance pixel and the lower-luminance pixel. In the present conversion, image freshness can be adjusted by merely changing the light-intensity characteristic in the oblique direction without having an effect upon the display quality in the frontward direction.

Explanation is made more concretely in the below description by using examples.

EXAMPLE 2-1

Figure 14:
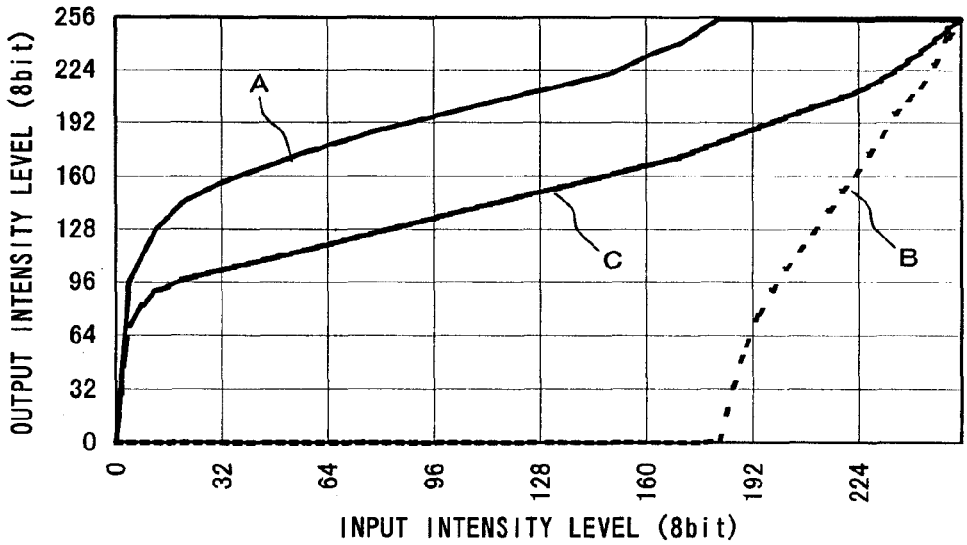
FIG. 14 is a figure showing a tone-level conversion table for determining to what number of levels the unprocessed image is set by an image processing in the case division is into luminance-increasing and luminance-decreasing frame periods in an ratio of frame period of 1:1 according to example 2-1 in the second embodiment of the invention.

Example 2-1 of this embodiment is explained using FIGS. 14 to 18. FIG. 14 is a tone-level conversion table for determining at what tone level the unprocessed image of after image-processing is to be set where the higher-luminance frame period and the lower-luminance frame period are in a ratio of 1:1. In the graph, the curve A shown by the solid line represents a tone-level conversion characteristic in the higher-luminance frame, the curve B shown by the broken line represents a tone-level conversion characteristic in the lower-luminance frame, and the curve C shown by the one-dot chain line represents a Ref (reference). For example, when the unprocessed image has a luminance at a tone level 128/255, the higher-luminance frame is converted by the curve A into a tone level 215/255 while the lower-luminance frame is changed by the curve B into a tone level 0/255. The ratio in the frame periods is 1:1, and the post-conversion luminance to be actually displayed on the liquid-crystal panel is a resulting luminance of both frames. Incidentally, the luminance in the frontward direction, even if conversion is made, is maintained at the luminance of the unprocessed image. Meanwhile, the effect of image conversion process is weakened as the curve C is neared.

Figure 15:
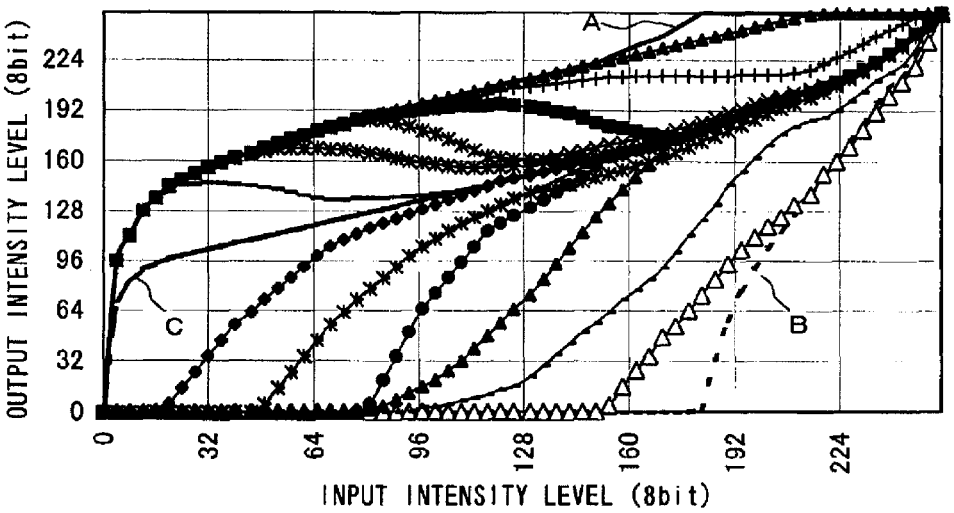
FIG. 15 is a figure showing another conversion table according to example 2-1 in the second embodiment of the invention.

This tone-level conversion table is merely one example. The limitation in tone-level conversion lies only in that the luminance at the front is unchanged at around tone-level conversion. In case this limitation is satisfied, many tone-level conversion tables would exist besides the relevant tone-level conversion table. FIG. 15 shows another tone-level conversion table. The abscissa represents an input tone level while the ordinate represents an output tone level. The curves A, B and C in the figure again show the curves similar to those of FIG. 14. The curve plotted by solid squares or the like, shown between the curves A and C, is a tone-level conversion characteristic for the higher-luminance frame. The curve plotted by solid circles or the like, shown between the curves B and C, is a tone-level conversion characteristic for the lower-luminance frame. FIG. 11, shown before, shows a measurement result of a luminance in an oblique direction of 60° where image processing is made on an unprocessed image at a tone level 127/255. The image processing in FIG. 11 uses the tone-level conversion table of FIG. 15, to set with a luminance difference between the higher-luminance frame and the lower-luminance frame such that the luminance in the frontward direction is maintained at the luminance of the unprocessed image. As is clear in FIG. 11, the luminance in the oblique direction of 60° decreases with an increase of the luminance difference between the higher-luminance and lower-luminance frames, and increases with a decrease of the luminance difference.

Incidentally, although this example sets the higher-luminance frame period and the lower-luminance frame period equal in frame period, the ratio of frame period may be changed, e.g., in case the lower-luminance frame is increased and the higher-luminance frame is shortened, the luminance in the oblique direction can be broadened in adjustment range. However, in case the ratio deviates from 1:1, the frame period corresponding to when the higher-luminance frame and the lower-luminance frame are added together and increased, allows flicker to be seen. In this case, there is a possibility to convey an uncomfortable feeling to the user. Such flicker can be reduced by raising the frame frequency. For example, when the higher-luminance and lower-luminance frames are in a frame ratio of 1:1, 60 Hz is required at the minimum, preferably 70 Hz or higher desired. Meanwhile, in case the ratio is taken 1:3, 120 Hz is required at the minimum, preferably 150 Hz or higher desired.

Figure 16:
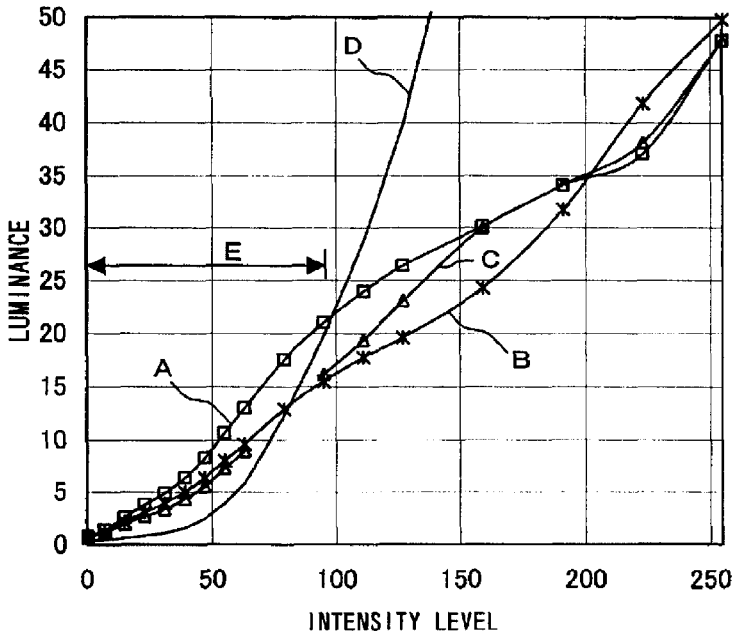
FIG. 16 is a graph showing a tone level versus luminance characteristic as viewed in the frontward direction and in the oblique 60° direction according to example 2-1 in the second embodiment of the invention.

Now explanation is made on an approach for conversion into a further clear image by using a tone-level conversion table. FIG. 16 is a figure showing a tone level versus luminance (G-L) characteristic as viewed in the frontward direction and obliquely at an angle of 60°. The curve A in solid line plotted with the open square marks in the figure represents a G-L characteristic of the unprocessed image, the curve B, C in solid line respectively plotted with the asterisk marks and the open triangle marks in the figure represents a G-L characteristic at an upper oblique angle of 60° wherein conversion has been made by a not-shown tone-level conversion table, and the curve D shown by only the solid line is a G-L characteristic in the frontward direction. Incidentally, the curve B and the curve C have been converted respectively by the different tone-level conversion tables. Comparing the characteristics of the curves A, B and C, the curve A is brightest, and the curve C and the curve B are lower in lightness in the order. Meanwhile, the tone-level conversion table is designed such that, as the tone level is higher, the curve B and C nears the curve A and are increased in luminance. On the curve A not image-processed, the luminance at the oblique direction of 60 degrees is higher than the luminance in the frontward direction in the lower tone level shown by the range E but lower than that in the higher tone level, thus losing image freshness and further lowering in color purity. However, on the curve B and C with conversion using the tone-level conversion table, the luminance is lowered only in the lower tone without lowering in the higher tone, thus maintaining image freshness.

Figure 17A:
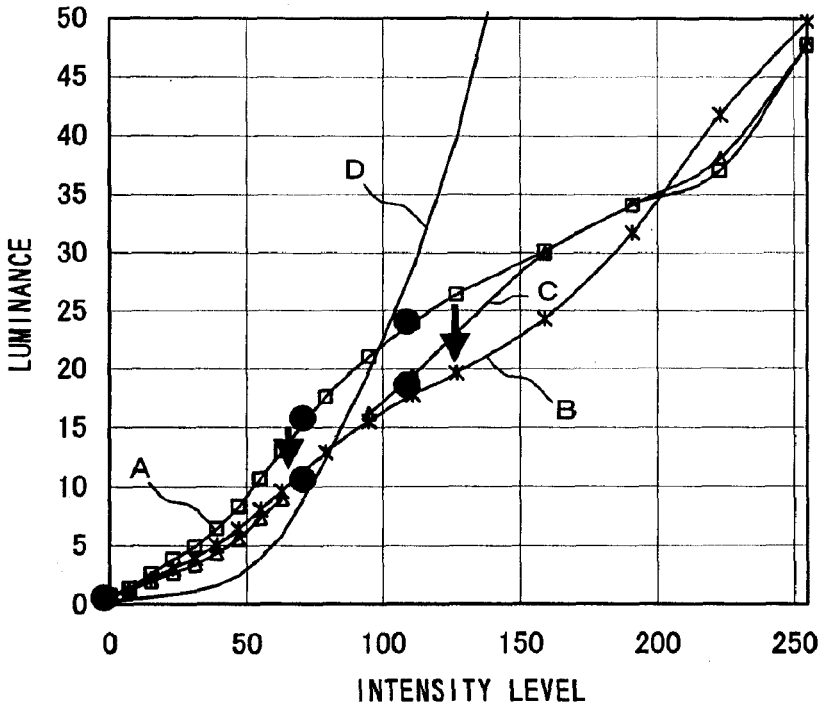
FIGS. 17A and 17B are graphs showing a tone level versus luminance characteristic as viewed in the frontward direction and in the oblique 60° direction according to example 2-1 in the second embodiment of the invention.
Figure 17B:
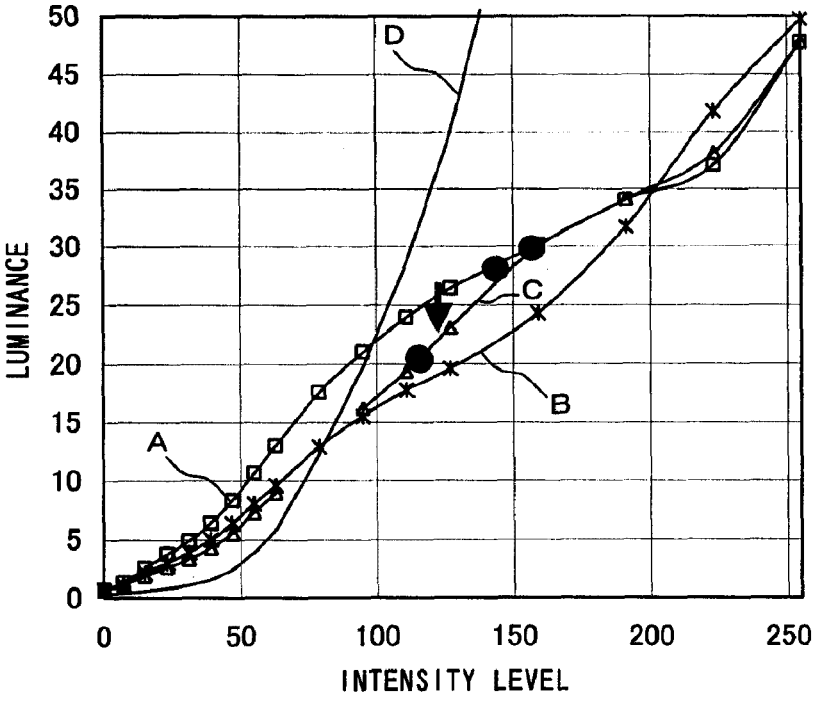
Figure 18A:
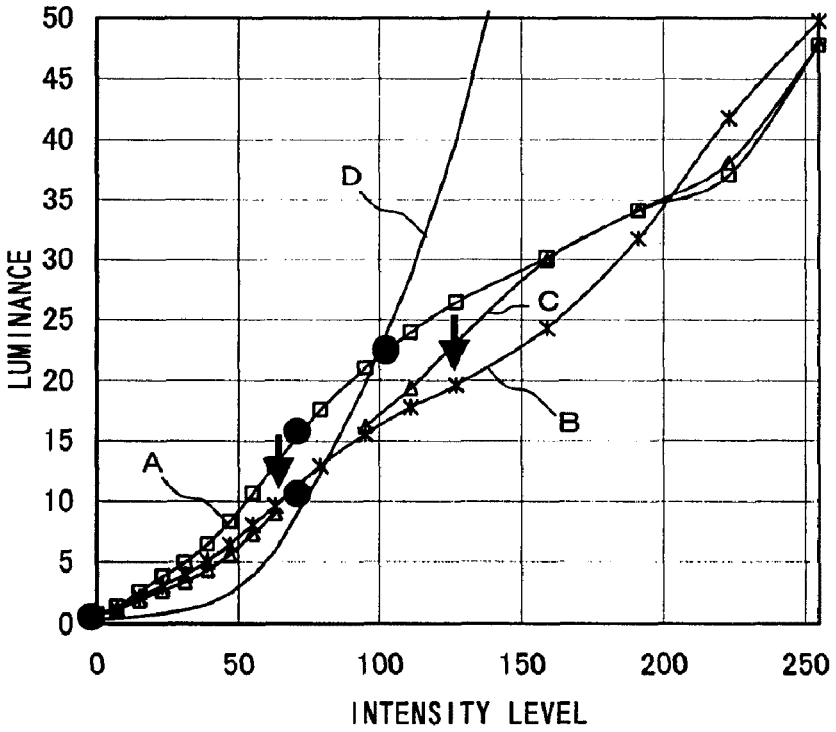
FIGS. 18A and 18B are graphs showing a tone level versus luminance characteristic as viewed in the frontward direction and in the oblique 60° direction in the case a plurality of tone-level conversion tables are used at the same time according to example 2-1 in the second embodiment of the invention.
Figure 18B:
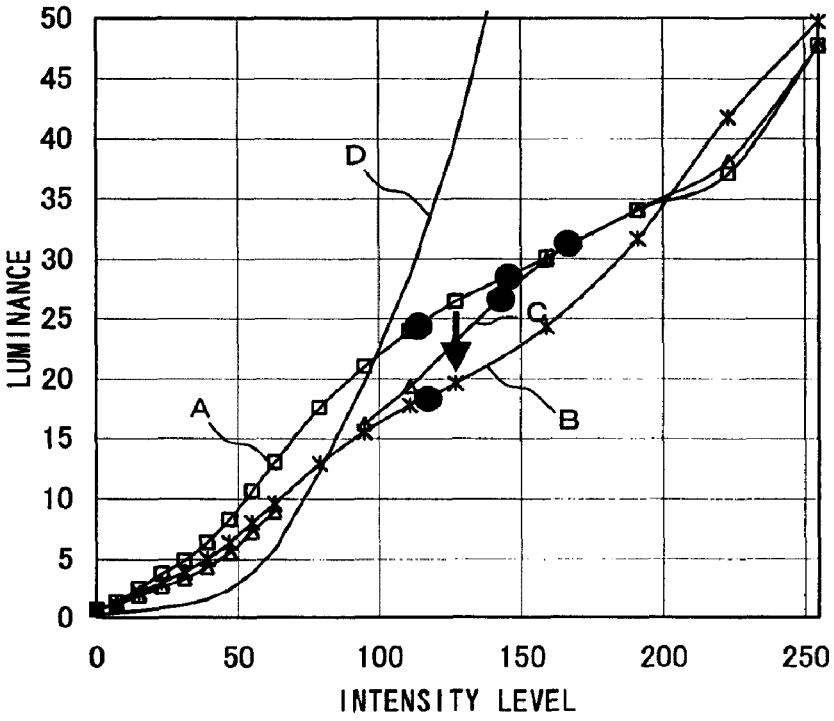

Nevertheless, in the case of an image having a tone level as shown in FIG. 17, the effect of improving image quality is less even if using the tone-level conversion table on which the curves B and C are based. For example, in the case of FIG. 17A, because three tone levels marked with solid circles, in any, have a lowered luminance, the images are not fresh in quality. For improving this, there is a need to use a tone-level conversion table for providing the characteristic further closer to the curve A than to the curve C. However, in this case, because it entirely becomes similar to the curve A as shown in FIG. 17B, no improvement effect is obtained at all. Accordingly, where conversion is done by using one kind of tone-level conversion table, there is a possibility that no improvement effect is available on certain display images. Therefore, this example uses at the same time a plurality of tone-level conversion tables as shown in FIG. 18. By thus changing the magnitude of tone-level conversion in accordance with display image, the freshness the image inherently possesses can be realized even when viewed obliquely.

As explained in the above, according to the present example, by carrying out image processing with using a plurality of tone-level conversion table, the luminance on the lower tone side only can be lowered without decreasing the luminance on the higher tone side. This changes the tone-level characteristic in the oblique direction, making it possible to prevent the straw coloring in the display image as viewed obliquely and hence to obtain a suitable di splay characteristic.

EXAMPLE 2-2

Figure 19:
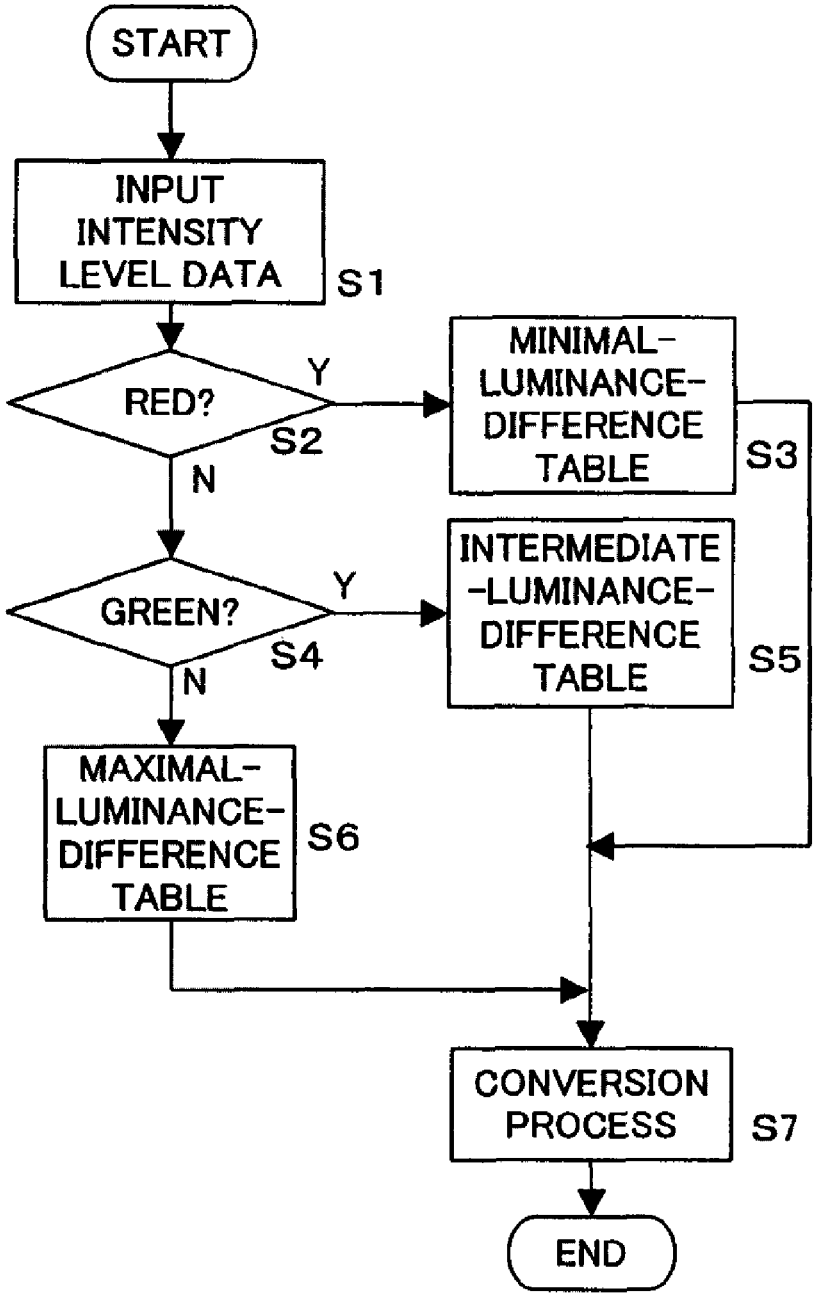
FIG. 19 is a flowchart showing a method of tone-level conversion by changing tone-level conversion tables every RGB according to example 2-2 in the second embodiment of the invention.

Now explained is example 2-2 according to the present example, by using FIG. 19. This example is characterized in that tone-level conversion tables are provided based on each color (red, green, blue: RGB), to carry out an image process while changing the tone-level conversion table based on each RGB. The phenomenon, where the luminance viewed obliquely is raised as compared to that as viewed in the frontward direction, is attributable to birefringence of liquid crystal. The influence of birefringence is different by light wavelength, i.e., influence is greater with lower wavelength. Accordingly, influence is readily undergone in the order of blue, green and red. For this reason, for red is used a tone-level conversion table smallest in luminance difference between the higher-luminance pixel and the lower-luminance pixel. For blue, used is a tone-level conversion table greatest in luminance difference. For green, used is an intermediate tone-level conversion table having a luminance difference greater than that of red but smaller than that of blue. For example, in FIG. 18, conversion is made on red in a manner to obtain a characteristic as the curve A, on green in a manner to obtain a characteristic as the curve B and blue in a manner to obtain a characteristic as on the curve C. Meanwhile, an effect is available if reducing the luminance difference on red only. This is because the human sensitively reacts with the color based on red, such as flesh or skin color. Meanwhile, an effect is available if the luminance difference is increased on green. This is because the human is visually perceptive the most to green. This example can greatly improve image freshness but the image entirety when viewed obliquely is somewhat colored to a particular color. For example, in a case where a conversion is made on red by decreasing the luminance difference in order to enhance the luminance as viewed obliquely, gray or the like is colored red into an impression as red on the whole.

Now concretely explained is a tone-level conversion method of this example by using FIG. 19. FIG. 19 is a flowchart of the tone-level conversion method of this example. At first, a video signal is inputted (step S1). Then, the input video signal is determined for color. In case it is determined red (step S2), selected is a tone-level conversion table minimal in luminance difference on between the higher-luminance pixel and the lower-luminance pixel (step S3), to carry out a conversion process (step S7). In case the input video signal is determined green in color (step S4), selected is a tone-level conversion table intermediate in luminance difference on between the higher-luminance pixel and the lower-luminance pixel (step S5), to make a conversion process (step S7). In case the input video signal is not any of red and green, selected is a tone-level conversion table maximal in luminance difference on between the higher-luminance pixel and the lower-luminance pixel (step S6), to make a conversion process (step S7). The above operation is repeated to implement tone-level conversion.

As explained in the above, according to the present example, because image processing is carried out while changing the tone-level conversion table based on RGB, it is possible to prevent the straw-coloring caused as viewed obliquely and to obtain a display characteristic excellent in color purity.

EXAMPLE 2-3

Figure 20:
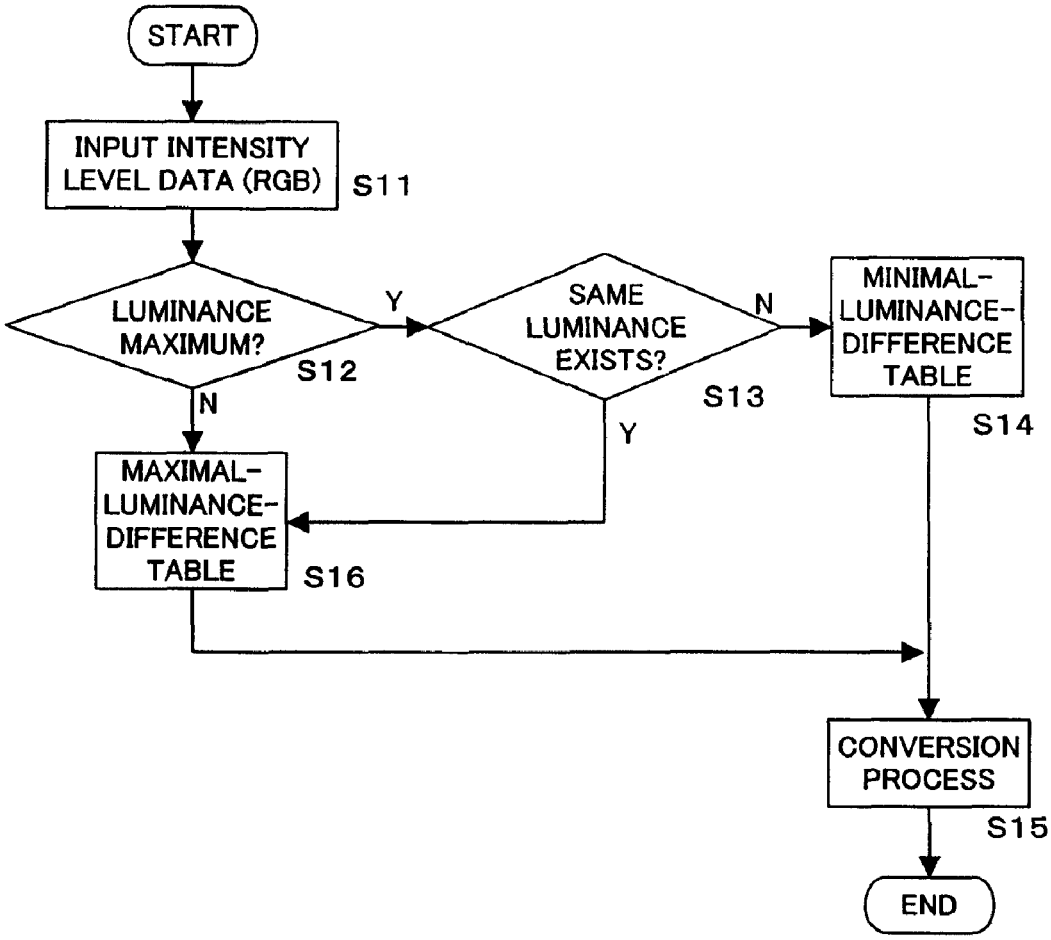
FIG. 20 is a flowchart showing a method of tone-level conversion by changing tone-level conversion tables by RGB luminance difference according to example 2-3 in the second embodiment of the invention.

Now explained is example 2-3 according to the present example by using FIG. 20. This example is characterized in that RGB luminance differences are compared to use tone-level conversion tables color by color. The comparison of RGB luminance differences may be on the screen entirety, in a predetermined range or on the RGB configuring one pixel. For the color of an unprocessed image having the tone levels distributed the most toward high tone, used is a tone-level conversion table minimal in luminance difference between the high tone pixel and the low tone pixel. Where the RGB luminance difference is very great, a conversion process may not be carried out. Meanwhile, for the color other than the relevant color distributed the most toward higher luminance, used is a tone-conversion table having a great luminance difference. Due to this, besides the hue over the screen entirety, freshness increases on every scene, e.g., a screen having a locally different hue, making it possible to obtain a good-looking video image even if viewed obliquely.

Now concretely explained is the tone-level conversion method of this example by using FIG. 20. FIG. 20 is a flowchart of the tone-level conversion method of this example. At first, a video signal is inputted (step S11). Then, determined is a color having a tone level distributed the most toward higher luminance of among the colors of the inputted video signal (step S12). In a case where determined is a color having a tone level distributed the most toward higher luminance in the step S12, the color determined as a color distributed the most toward higher luminance is compared with another color (step S13). In the case there is no color having the same luminance as the other color, selected is a tone-level conversion table minimal in luminance difference on between the higher-luminance pixel and the lower-luminance pixel (step S14), to make a conversion process (step S15). In case there is a color having the same luminance in the step S13, selected is a tone-level conversion table maximal in luminance difference on between the higher-luminance pixel and the lower-luminance pixel (step S16), to carry out a conversion process (step S15). For the other color not determined as a color distributed the most toward high tone in the step S12, selected is a tone-level conversion table maximal in luminance difference between the higher-luminance pixel and the lower-luminance pixel (step S16), to carry out a conversion process (step S15). The above operation is repeated to implement tone-level conversion.

As explained in the above, according to the present example, because image processing is carried out by comparing between RGB luminance differences and separately using the tone-level conversion tables on a color-by-color basis, it is possible to prevent the straw coloring caused as viewed obliquely and to obtain a display characteristic excellent in color purity.

EXAMPLE 2-4

Now explained is example 2-4 according to the present example. This example carries out the similar process not based on RGB color but on the luminance on a particular pixel for a luminance distribution in a predetermined range. Otherwise, this is characterized in that luminance difference is changed by the relationship between a luminance on a certain pixel and a luminance over the adjacent pixels in the number of 1 to n to the relevant pixel. This example is effective where emphasis is placed upon the tone level of grayscale lightness without emphasis upon color. Meanwhile, this is also effective for an image displayed in gray or an image device for black-and-white display not having RGB pixels.

EXAMPLE 2-5

Figure 22:
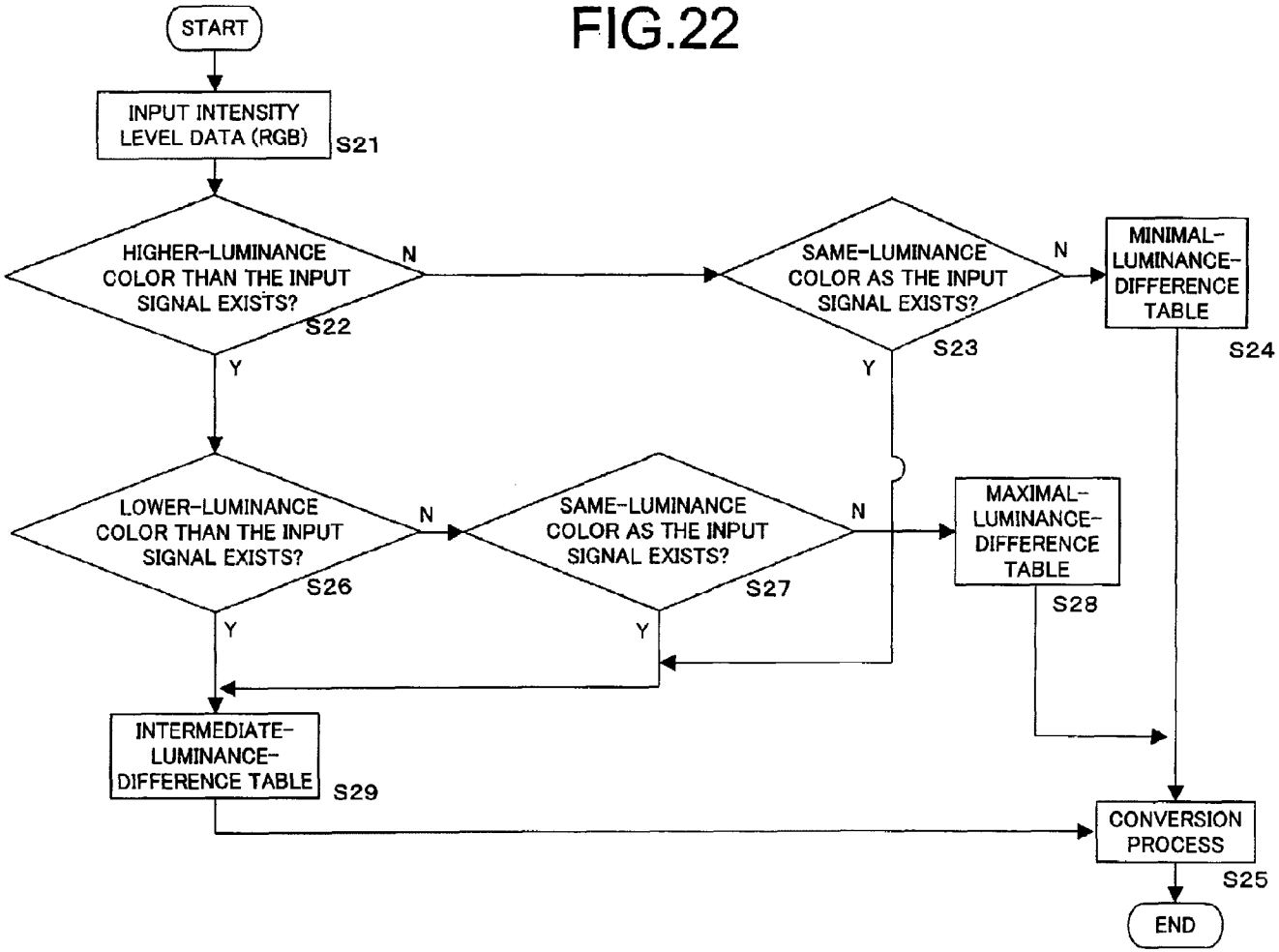
FIG. 22 is a flowchart showing a method of tone-level conversion by changing tone-level conversion tables by RGB luminance difference according to example 2-5 in the second embodiment of the invention.

Now explained is example 2-5 according to the present example by using FIGS. 21 and 22. This example is characterized in an image conversion method optimal for the case that tone level is changed in the relationship of magnitude within a range where the unprocessed image is extremely small in tone-level difference. FIG. 21 is a figure explaining an image conversion method. As shown in FIG. 21A, because red tone level is 1 to 3 higher than green tone level in a predetermined position (1), (2) and (3) of a display area, conversion is made on red by a tone-level conversion table great in luminance difference between the high tone pixel and the low tone pixel while conversion is made on green by a tone-level conversion table intermediate in luminance difference. In the predetermined position (4) of display area, because red and green is equal in luminance, conversion is made on both red and green by a tone-level conversion table intermediate in luminance difference. In the predetermined position (5), (6) and (7) of the display area, because green tone level is 1 to 3 times greater than the red tone level, conversion is made on green by the tone-level conversion table great in luminance difference while conversion is made on red by the tone-level conversion table intermediate in luminance difference. In the case of such an image that the tone-level conversion table is replaced in a range having small tone-level difference of RGB, the luminance difference due to change of the tone-level conversion table at a certain tone level is greater as compared to the tone-level difference in nature, possibly resulting in unnatural display. For example, there is a case that the screen, when viewed obliquely, displays a stripe of green, red, green and red. In FIG. 21A, the luminance at the position (4) is lower than the luminance at the position (3) and (5), resulting in unnatural display. For this reason, where RGB is small in tone-level difference as in FIG. 21B, used is the intermediate tone-level conversion table. In a case where the tone-level conversion table at around RGB-tone-level change is gradually changed, the luminance of after tone-level change does not become greater than the luminance in nature. Thus, display abnormality can be prevented from occurring.

The tone-level conversion tables may be previously prepared in the storage section of the liquid-crystal display device. Otherwise, computation may be made to the tone-level difference. Because previous preparation of a tone-level table requires a large scale of storage capacity for tone-level conversion tables, they are desirably derived by computation. Meanwhile, such conversion can be easily realized by providing function to output a suitable value out of the combinations of higher-luminance and lower-luminance pixels selectable for an previously inputted tone level. For example, the function may be a conversion equation approximated by a quadratic equation or the like. Otherwise, tone-level conversion tables may be previously provided in the storage section.

Now explained concretely a tone-level conversion method of this example by using FIG. 22. FIG. 22 is a flowchart of the tone-level converting method of this example. At first, a video signal is inputted (step S21). Then, it is determined whether there is a color higher in lightness than the color of the inputted video signal (step S22). If it is determined at the step S22 that there is no color higher in lightness than the color of the inputted video signal, the process moves to step S23 where it is determined whether or not there is a color equal in luminance. In the case that there is no color equal in luminance, selected is a tone-level conversion table minimal in luminance difference between the higher-luminance pixel and lower-luminance pixel (step S24), to carry out a conversion process (step S25).

In the case in the step S23 that there is a color equal in luminance, selected is a tone-level conversion table intermediate in luminance difference between the higher-luminance pixel and lower-luminance pixel (step S29), to carry out a conversion process (step S25).

If it is determined at the step S22 that there is a color higher in lightness than the color of the inputted video signal, the process moves to step S26 where it is determined whether or not there is a color lower in lightness than the color of the inputted video signal. In the case that there is a color lower in lightness than the color of the inputted video signal, the step moves to step S29, and selected is a tone-level conversion table intermediate in luminance difference between the higher-luminance pixel and lower-luminance pixel, to carry out a conversion process (step S25).

In the case, at step S26, that there is no color lower in lightness than the color of the input video signal, the process moves to step S27 where luminance is compared between the color determined as a color highest in luminance and another color. In the case there is a color equal in luminance to the other color, selected is a tone-level conversion table intermediate in luminance difference between the higher-luminance pixel and lower-luminance pixel (step S29), to carry out a conversion process (step S25). In the case there is no color equal in luminance in the step S27, selected is a tone-level conversion table maximal in luminance difference between the higher-luminance pixel and lower-luminance pixel (step S28), to carry out a conversion process (step S25).

As explained above, according to this example, by gradually changing the tone-level conversion table at around changing RGB tone level, the luminance of after tone-level change does not increase greater than the luminance in nature, preventing display abnormality from occurring.

As in the above, the present example can realize an image processing method and liquid-crystal display device capable of greatly reducing the display change in the oblique direction as a disadvantage of the liquid-crystal display device.

Third Embodiment

Now explained is a third embodiment of the invention by using FIGS. 23 to 32. This embodiment aims at providing an image processing method that is broad in viewing angle in moving image display and excellent in color reproducibility and a liquid-crystal display device using the same.

As explained in the second embodiment, the luminance as viewed obliquely can be controlled without changing the luminance in the frontward direction by separating the luminance into two values based on the tone-level conversion table shown in FIG. 14 and assigning the separated one of luminance to the pixels on the screen or by repeatedly displaying the separated one of luminance with a predetermined frame period. This new technology is hereinafter referred to as half tone drive (HTD) technique. The tone-level conversion tables, for converting the tone level, is exemplified in FIG. 15 shown before. Besides those, there exist countless others in number. Furthermore, in the HTD technique, tone level is compared based on the RGB pixel for color display, to carry out a conversion such that the lower in lightness of a pixel the greater the luminance difference is taken in the image processing while the higher in lightness color of a pixel the smaller the luminance difference is taken. This increases the color-based luminance difference as viewed obliquely, to make it possible to reproduce the fresh color viewed from the front even when viewed obliquely. Furthermore, flicker can be prevented by the combination of HTD technique and drive polarity. Incidentally, the principle of improvement effect on HTD technique is similar to example 2-1 explained using FIG. 18 and the like.

Figure 23A:
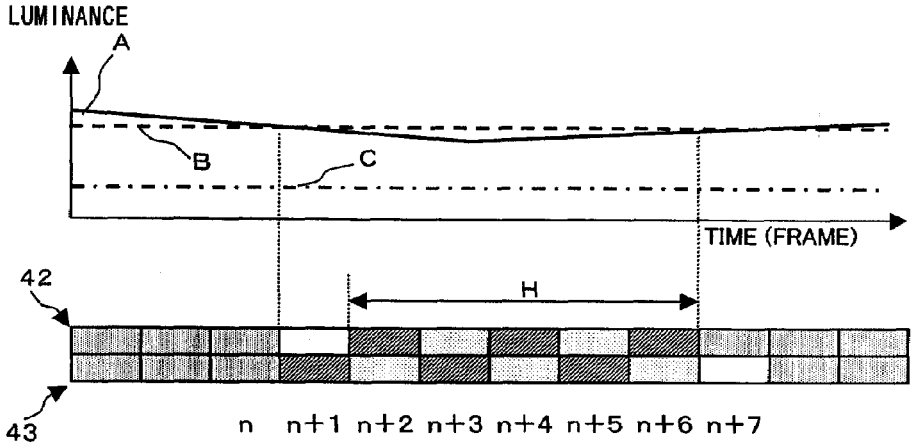
FIGS. 23A and 23B are figures explaining the principle of occurrence of a display abnormality to be corrected in a third embodiment of the invention.

The HTD technique greatly improves the phenomenon of color missing of an image as viewed obliquely. However, when a moving image is displayed, there is a case that abnormality occurs in part of the image. FIG. 23 is a figure explaining the occurrence principle of the display abnormality. FIG. 23A is a figure showing the luminance transitional change in time on the RGB pixels and the luminance change on the G pixel 42, 43. The abscissa represents a time (frame) while the ordinate represents a luminance. Meanwhile, the straight line A shown by the solid line in the figure represents a luminance change on the G pixel, the straight line B shown by the broken line represents a luminance change on the R pixel and the straight line C shown by the one-dot chain line represents a luminance change on the B pixel.

As shown in FIG. 23A, there is an image that RGB have luminance levels higher in the order of green, red and blue wherein the luminance difference is great between red and green and blue. The image partly includes a moving image that the luminance of green gradually lowers and becomes equal to the luminance of red and thereafter becomes lower than the luminance of red. When the n-th frame is changed into the (n+1)-th frame during moving of the moving image on the screen, the G pixel in a particular position suddenly changes from a state having the highest luminance within the screen into a state having a luminance second highest in lightness.

Up to the n-th frame where the G pixel has the highest in lightness luminance, used is a tone-level table small in luminance difference between the higher-luminance pixel and the lower-luminance pixel, to carry out an HT process. However, in the (n+1)-th to (n+6)-th frame where the G pixel has a luminance the second highest in lightness, used is a tone-level table great in luminance difference between the higher-luminance pixel and the lower-luminance pixel, to carry out an HT process. Accordingly, in case the n-th frame is changed to the (n+1) frame, there is an abrupt change in HT-process tone-level conversion, to change luminance difference between the higher-luminance pixel and the lower-luminance pixel from small to great.

Figure 23B:
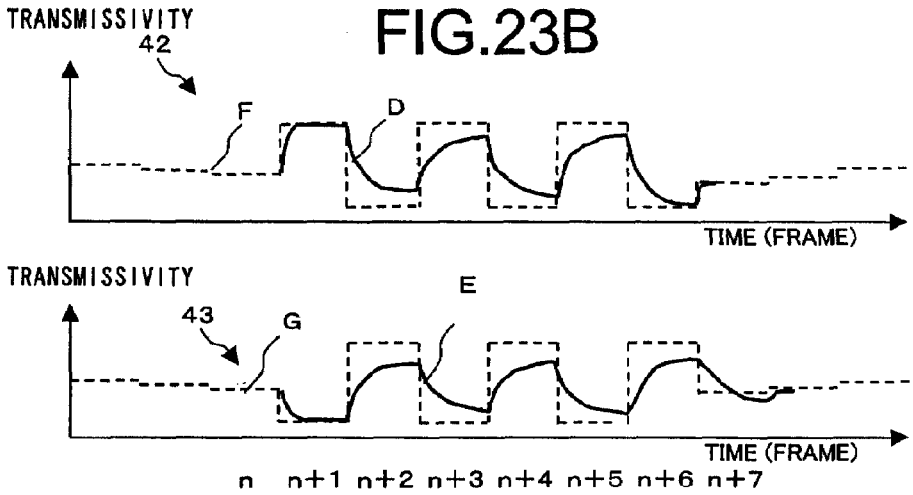

FIG. 23B shows an optical response characteristic of the liquid crystal over the G pixel 42, 43. The abscissa represents a time (frame) while the ordinate represents a transmissivity. In the figure, the curves D, E in solid line represent the optical response of the G pixel 42, 43 while the straight lines F, G in broken line represent an ideal luminance level on the G pixel 42, 43. As shown in FIG. 23B, in the period H that the luminance difference is great between the higher-luminance pixel and the lower-luminance pixel, the response of liquid crystal cannot completely follow in speed the frame-based luminance change.

However, because the luminance difference between the higher-luminance pixel and the lower-luminance pixel is small in the n-th frame, the actual luminance is high even in the lower-luminance pixel, to reduce the actual luminance difference between the n-th frame and the (n+1) -th frame. In the (n+1) -th frame, the response of liquid crystal can follow in speed the frame-based luminance change, raising the luminance higher than that in the period H subsequent to the relevant frame. Consequently, bright abnormal uneven display is displayed on the display screen when the tone-level conversion table is changed. In the (n+7)-th frame green becomes again brighter than red, abnormality occurs in display due to the similar cause.

In this manner, poor display takes place at a point where the conversion table is changed abruptly with a slight tone-level difference between the pixels of RGB. Meanwhile, because the image at a lower-luminance level has a luminance difference naturally reduced between the higher-luminance pixel and the lower-luminance pixel, there is a problem that reduced is the effect to prevent the phenomenon the luminance in the oblique direction increases rather than the luminance in the frontward direction and color is missed as white.

This example is characterized in that, in the image having such a moving image that color-based tone levels moderately approach into a change in the order, improvement can be made on the display abnormality as caused by an abrupt change in luminance difference between the higher-luminance pixel and the lower-luminance pixel converted for the same input tone level.

Explanation is made more concretely by examples.

EXAMPLE 3-1

Figure 24:
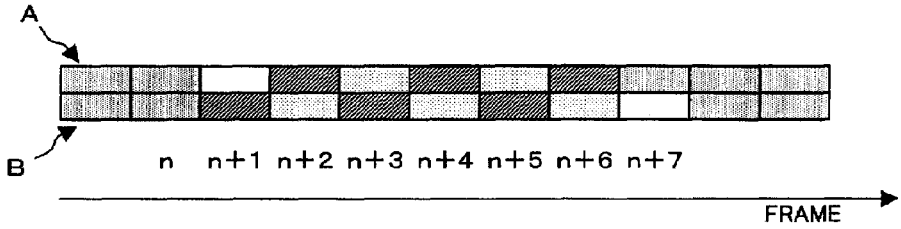
FIG. 24 is a figure explaining the principle of image conversion according to example 3-1 in the third embodiment of the invention.

Explained is example 3-1 according to a third embodiment of the invention, by using FIGS. 24 and 25. FIG. 24 is a figure for explaining the principle of image conversion in example 3-1. Where the pixel A in the n-th frame higher in luminance than the pixel B becomes lower in luminance than the pixel B in the (n+1)-th frame, the occurrence of poor display can be prevented by carrying out a process of suppressing low the luminance change in the (n+1)-th frame in order not to greatly change the pixel A the luminance difference between the higher-luminance pixel and lower-luminance pixel. In order to prevent against poor display of a moving image, it is important not to cause an abrupt luminance difference between the higher-luminance pixel and the lower-luminance pixel.

Figure 25A:
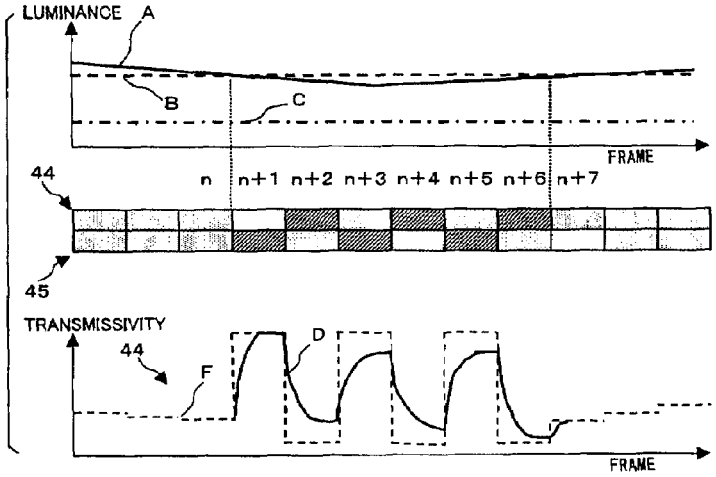
FIGS. 25A-25D are figures explaining an image processing method according to example 3-1 in the third embodiment of the invention.

In this example, in order to moderate the abrupt change in luminance between frames, a frame memory is utilized to evaluate the change manner of tone level in the preceding and succeeding frames, thereby moderating the luminance change in one frame or a plurality of frames without greatly changing the luminance difference. FIG. 25 is a figure for explaining an image conversion processing method of this example in an image that the moving image having a RGB luminance level higher in the order of green, red and blue and a quite great luminance difference between red and green and blue gradually lowers in green luminance below the luminance of red. FIG. 25A shows an optical response of a liquid crystal subjected to the conventional HT processing. The abscissa represents a frame while the ordinate represents a luminance. Meanwhile, the straight line A shown by the solid line in the figure represents a luminance change on the G pixel, the straight line B shown by the broken line in the figure represents a luminance change of the R pixel, and the straight line C shown by the one-dot chain line in the figure represents a luminance change of the B pixel. The curve D shown by the solid line in the figure represents an optical response of the G pixel 44 while the straight line F shown by the broken line represents a luminance level of the G pixel 44.

Figure 25B:
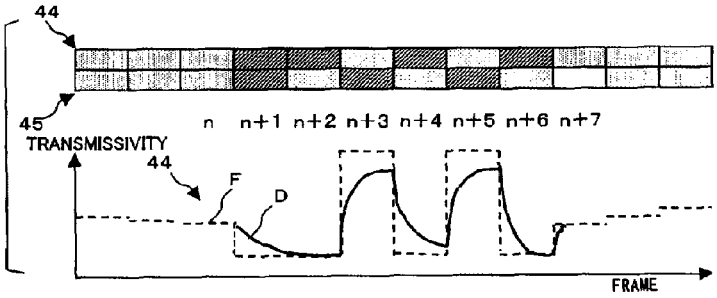
Figure 25C:
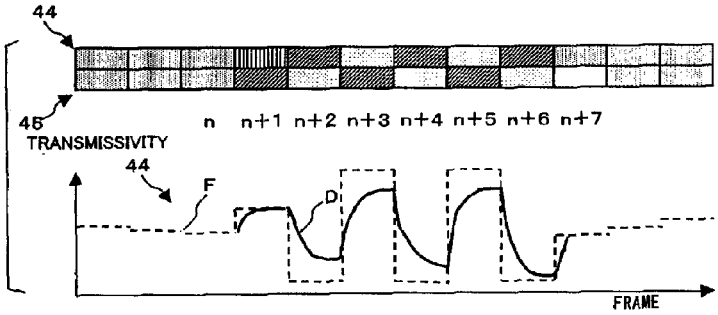
Figure 25D:
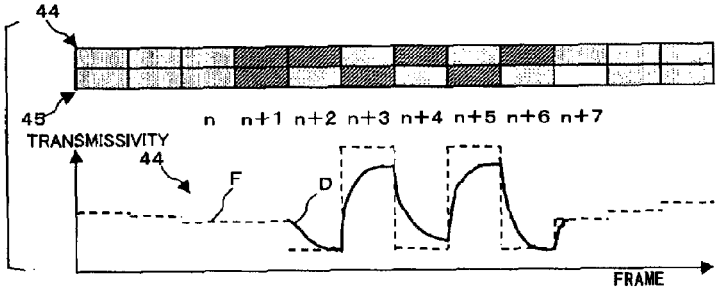

As was explained using FIG. 23, there occurs abnormal uneven display such that luminance rises in the n-th frame where the order in luminance is replaced. Consequently, in the case that the image data within the frame memory is compared and, between frames, the luminance of a certain color lowers in the order to increase the luminance difference between higher-luminance pixel and lower-luminance pixels of the tone-level conversion table, a process is forcibly made to lower the luminance as shown in FIGS. 25B to 25D. In the first technique, the pixel to be put into a higher-luminance pixel is forcibly made in a dark state in the (n+1)-th frame immediately after changing the tone-level conversion table, as shown in FIG. 25B. By doing so, the relevant pixel remains in a dark state up to the (n+3)-th frame where it is next put into a higher-luminance pixel.

In the second technique, the luminance of the higher-luminance pixel is lowered in the (n+1)-th frame immediately after changing the tone-level conversion table, as shown in FIG. 25C. In the third technique, as shown in FIG. 25D, in the (n+1)-th frame immediately after changing the tone-level conversion table, HT processing is omitted by one frame despite to be inherently put to a higher-luminance pixel, thereby making an outputting at a luminance of the inputted tone level. In case any of these techniques is implemented, poor display is not observed even if there is movement of a moving image having a part where the tone level is to be changed. Incidentally, on the (n+7)-th frame, display abnormality can be prevented by the similar technique.

As explained above, according to this example, it is possible to suppress the display abnormality caused upon changing the order in luminance on RGB pixels wherein RGB are near in luminance for the pixels. Thus, a favorable display characteristic can be obtained.

EXAMPLE 3-2

Figure 26:
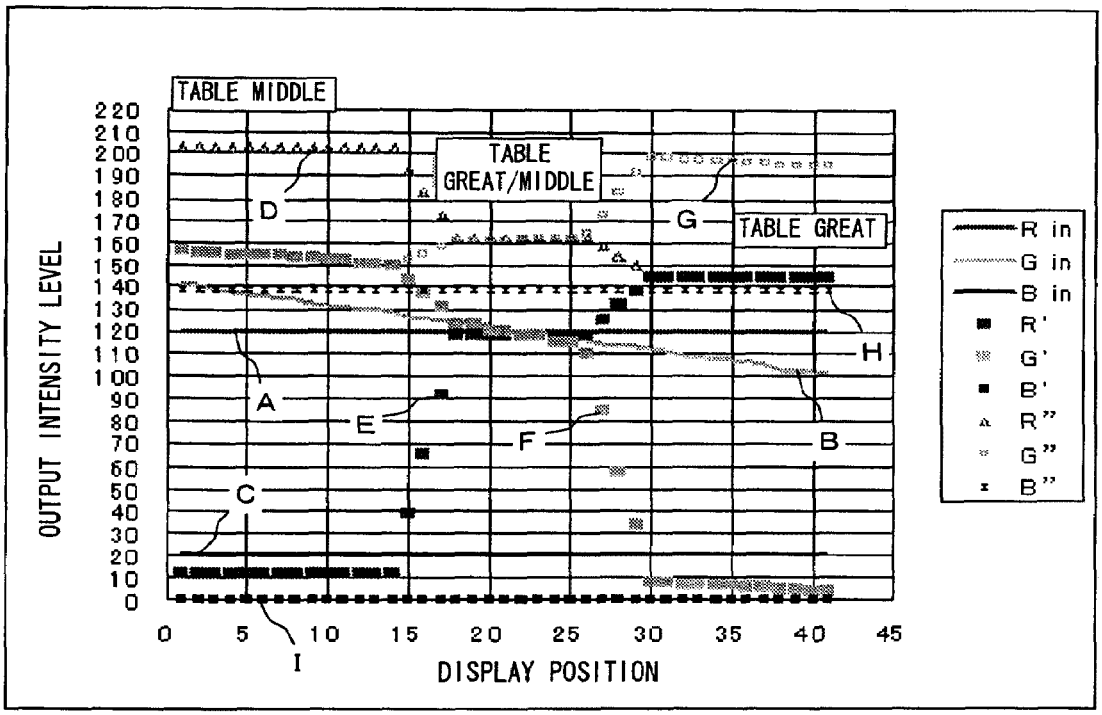
FIG. 26 is a figure explaining an image processing method according to example 3-2 in the third embodiment of the invention.

Example 3-2 according to the present embodiment is explained by using FIGS. 26 to 28. This example, causes the luminance difference to change between a higher-luminance pixel and a lower-luminance pixel of tone-level conversion in the order of RBG pixel luminance similarly to the conventional device, is characterized in that, as the RGB pixels approach in luminance difference, the luminance difference of the conversion is gradually varied. FIG. 26 is a figure for explaining an image conversion processing method in this example. In FIG. 26, the curve A shown by the solid line represents a tone level of an input video signal to the R pixel, the curve B shown by the broken line represents a tone level of an input video signal to the G pixel and the straight line C shown by the one-dot chain line represents a tone level of an input video signal to the B pixel. Furthermore, in the figure, the curves D, E plotted with solid triangle marks and open triangle marks represent a tone level on the R pixel after HT processing. The curves F, G plotted with solid square marks and open square marks represent a tone level on the G pixel after HT processing. The curves H, I plotted with times marks and asterisks represent a tone level on the B pixel after HT processing. As shown in FIG. 26, it can be seen that, because the luminance difference between higher-luminance and lower-luminance pixels is gradually changed at display positions 15 to 30, the tone level after HT processing is changed gradually. Incidentally, where tone levels are sufficiently distant, used is a basis tone-level conversion table.

This example moderates the display abnormality of an image to spatially abruptly change in luminance. Namely, tone-level conversion is made taking account of not only the order of RGB color luminance but also luminance difference.

Tone-level difference is decreased as luminance difference is smaller, thereby making it possible to moderate abrupt change.

FIG. 27 is a figure for explaining the transition in selecting atone-level conversion table for an input tone level. FIG. 27A shows a tone-level distribution of the colors of RGB of a certain image. The abscissa represents a time while the ordinate represents a tone level. Meanwhile, the straight line shown by the solid line in the figure represents a tone-level change of the G pixel, the straight line shown by the broken line represents a tone-level change of the R pixel and the straight line shown by the one-dot chain line represents a tone-level change of the B pixel. FIG. 27B shows a method of changing over the tone-level conversion table in the case the tone levels of the colors gradually go near as in FIG. 27A. In this example, three sets of tone-level conversion tables, totaling six tables, are prepared to meet the RGB three colors. The tone-level conversion tables for use on the highest in lightness color are higher-luminance sided Ah(x) and lower-luminance sided Al(x). The tone-level conversion tables are set in a manner to minimize the luminance difference as compared to the other tone-level conversion tables. The tone-level conversion tables for use on the lowest in lightness color are higher-luminance sided Ch(x) and lower-luminance sided Cl(x), which are set in a manner to maximize the luminance difference as compared to the other tone-level conversion tables. The tone-level conversion tables for use on the second highest in lightness color are higher-luminance sided Bh(x) and lower-luminance sided Bl(x). These tone-level conversion tables are set such that the luminance difference is greater than the luminance difference between the higher-luminance sided Ah(x) and the lower-luminance sided Al(x) but smaller than the luminance difference between higher-luminance sided Ch(x) and the lower-luminance sided Cl(x).

In case the G pixel and the R pixel are fully distant in luminance difference, for the G pixel is used the tone-level conversion tables of higher-luminance sided Ah(x) and lower-luminance sided Al(x). However, as shown in FIG. 27A, in case the G pixel and the R pixel gradually nears in tone level and the G pixel and the R pixel become a setting value N or smaller in tone-level difference n, the conversion value on the G pixel nears to that of the R pixel (period A). Provided that the conversion value on the G pixel at the higher-luminance side is Green_h, then $Green_h=Bh(x)-\{Bh(x)-Ah(x)\}\times n/N$ is given. Meanwhile, provided that the same at the lower-luminance side is Green_l, then $Green_l=Bl(x)+\{Al(x)-Bl(x)\}\times n/N$ is given. Accordingly, the higher-luminance sided Green_h and the lower-luminance sided Green_l, if linearly interpolated by a tone-level difference n into n=0, converges to intermediate Bh(x) and Bl(x) of tone-level conversion tables, as shown by the solid line in the figure.

In case the R pixel and the B pixel are fully distant in luminance difference, for the B pixel is used the tone-level conversion tables of higher-luminance sided Ch(x) and lower-luminance sided Cl(x). However, as shown in FIG. 27A, in case the R pixel and the B pixel gradually nears in tone level and the R pixel and the B pixel become a setting value L or smaller in tone-level difference n, the conversion value on the B pixel nears to that of the R pixel (period B) as shown in FIG. 27B. Provided that the conversion value on the B pixel at the higher-luminance side is Blue_h, then $Blue_h=Bh(x)+\{Ch(x)-Bh(x)\}\times n/L$ is given. Meanwhile, provided that the same at the lower-luminance side is Blue_l, then $Blue_l=Bl(x)-\{Bl(x)-Cl(x)\}\times n/L$ is given. Accordingly, the higher-luminance-sided Blue_h and the lower-luminance-sided Blue_l, if linearly interpolated by a tone-level difference n into n=0, converges to intermediate Bh(x) and Bl(x) of tone-level conversion tables, as shown by the broken line in the figure.

Namely, when the RGB tone levels goes near, the tone-level conversion tables on all the colors use intermediate tone-level conversion tables Bh(x) and Bl(x). Also, the tone-level conversion tables, as the tone-level difference increases, linearly go near any of the tone-level conversion tables Ah(x) and Al(x) for light color and the tone-level conversion tables Ch(x) and Cl(x) for dark color. As a result, because there is no abrupt increase of luminance difference in HT tone-level conversion tables even on a moving picture liable to cause display abnormality, display abnormality could not take place. Because the greater the setting value N and L, the more moderately the tone-level conversion table changes, thus causing less display abnormality but weakening the effect of HTD. FIG. 27C shows a result of visual evaluation on the relationship between a setting value N and a poor-display preventing effect and HTD effect. In the figure, the open circle mark represents to obtain favorable display for every image, the open triangle mark represents to possibly cause display abnormality on particular images and times mark represents to cause display abnormality on every image. It can be considered that the setting value N for 255-level display has a preferable range of 2 or greater and 64 or smaller.

As explained above, the present example can suppress the display abnormality to be caused when the RGB pixels are near in luminance and the order of luminance is replaced on the RGB pixels. Thus, suitable display characteristics can be obtained.

Figure 28A:
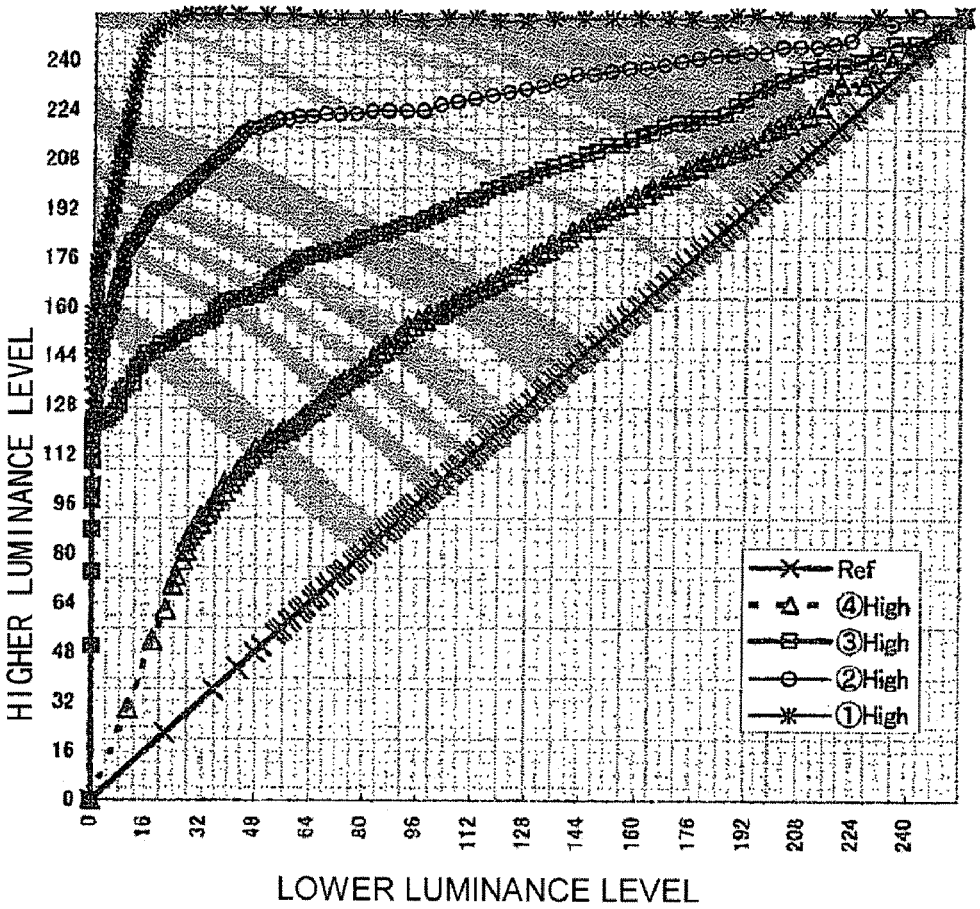
FIGS. 28A and 28B are figures showing a simulation result of equi-luminance distribution of combinations of high-and-low luminance differences under setting conditions according to example 3-2 in the third embodiment of the invention.
Figure 28B:
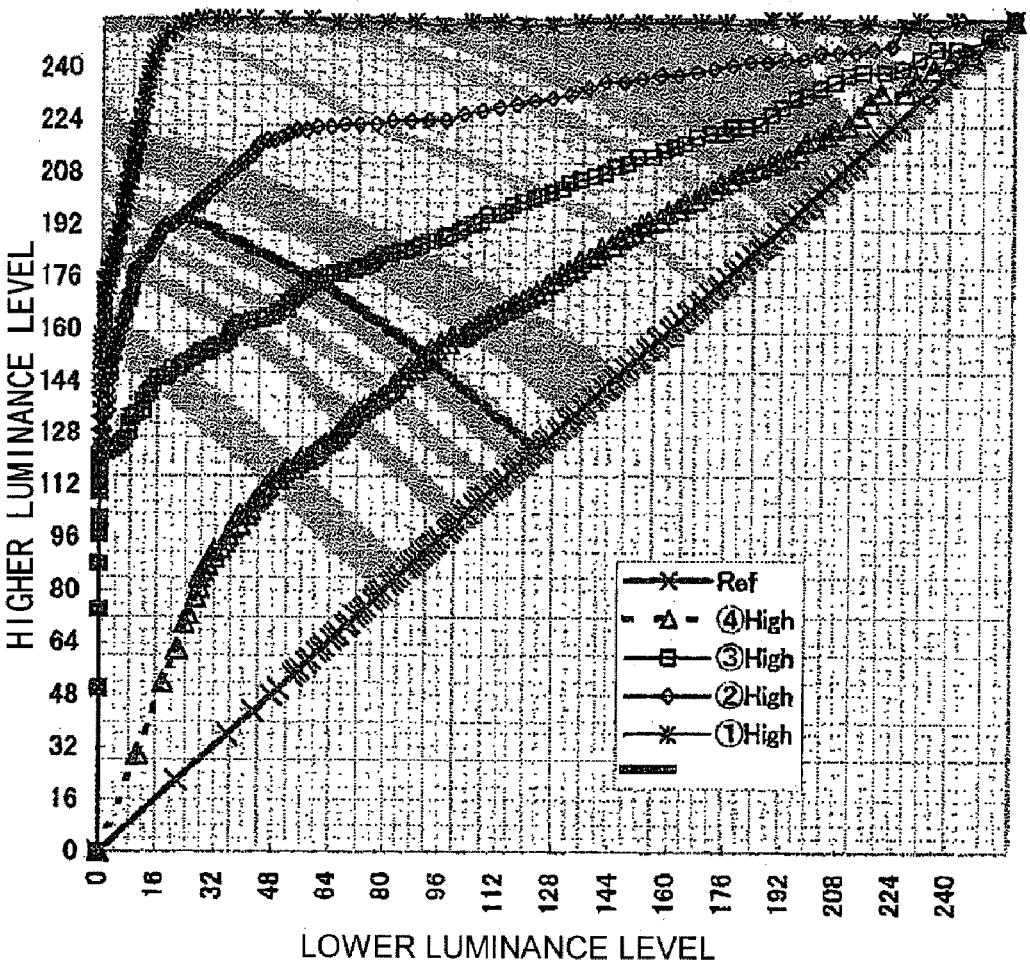

There are cases that the mere use of the tone-level conversion tables for linearly interpolation, such as Green_h is considered not sufficient. FIG. 28 shows a measurement result of equi-luminance distribution by the combination of luminance differences of lightness/darkness under a certain setting condition. As shown in FIG. 28A, the equi-luminance distribution is in a curvature to a considerable extent. As shown in FIG. 28B, with a linear interpolation, setting value is to linearly move in the luminance distribution, it transverses some strips, causing the luminance at the front and resulting in an occurrence of display nonuniformity.

The abscissa represents a tone level on the lower luminance side while the ordinate represents a tone level on the higher luminance side. The strip group in the upper left in the figure represent a luminance distribution to be obtained by the combination of a lower luminance sided tone level and a higher luminance sided tone level. The region in the same strip means uniform in luminance in the frontward direction. Incidentally, the region in a combination of lower tone levels is omitted to show because of complexity in the graph. Meanwhile, because the higher luminance sided tone level is equal to or higher than the lower luminance sided tone level, no data exists in the lower right region. Should data exist, the higher luminance sided tone level and lower luminance sided tone level shown by Ref in the figure is in a characteristic symmetric about the common line.

As discussed above, within the strip, the luminance in the frontward direction is uniform but the luminance in the oblique direction is different. Because the tone-level difference of lightness/darkness increases as going to the upper left, display is dark within the same strip. Accordingly, in order to realize display free of display nonuniformity, some approaches are explained in example 3-3 and the subsequent.

EXAMPLE 3-3

Figure 29:
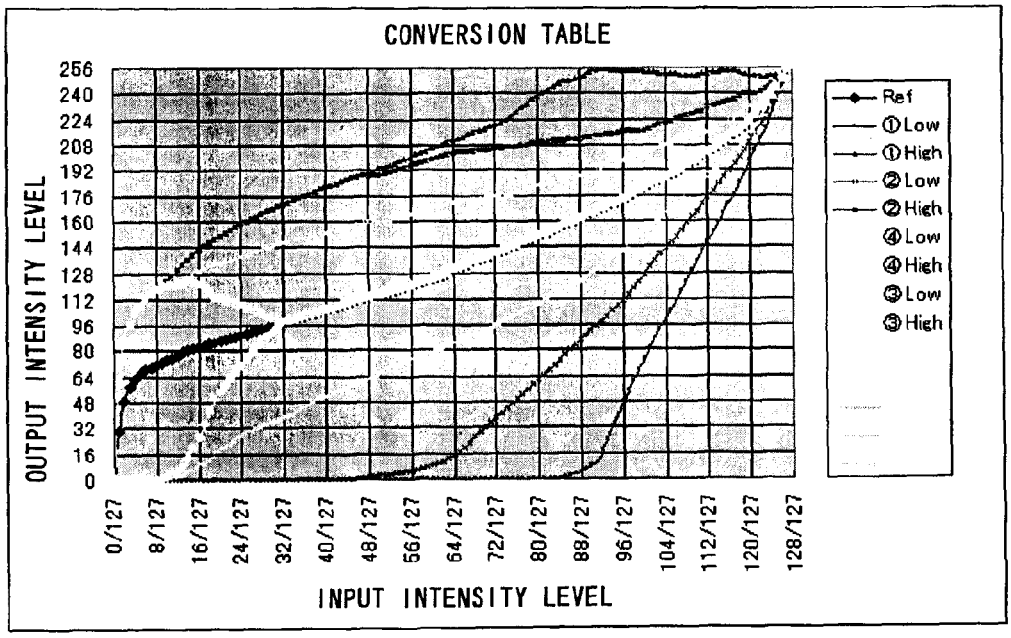
FIG. 29 is a figure showing a tone-level conversion table according to example 3-3 in the third embodiment of the invention.

Now example 3-3 according to the present embodiment is explained by using FIG. 29. This example is characterized in that intermediate tone-level conversion tables are further set between the tone-level conversion table for the maximum luminance and the tone-level conversion table for the intermediate luminance thus having four sets, or eight tables, besides the three sets or six tone-level conversion tables. As shown in FIG. 29, as the tone-level conversion tables as increased in number, the interpolation distance is shortened, obtaining a great effect that errors decrease even where there is a curve. Accordingly, it is considered as an extremely effective approach to increase the tone-level conversion tables in number. In this example, the tone-level conversion tables in plurality must be provided in the storage section. This imaging process, if implemented on an interface circuit, increases the capacity of the storage section, leading to cost increase. Meanwhile, in a case of not having the tone-level conversion tables, the interpolation with two or more straight lines or with curve lines is possible by a computation algorithm. This can provide the similar effect to the case of the image processing with a plurality of tone-level conversion tables.

As explained above, in this example, because of using a plurality of tone-level conversion tables, there is no possibility to transverse the equi-luminance distribution strip where the equal tone-level data of after tone-level conversion is curved. Thus, display nonuniformity can be prevented from occurring.

EXAMPLE 3-4

Figure 30A:
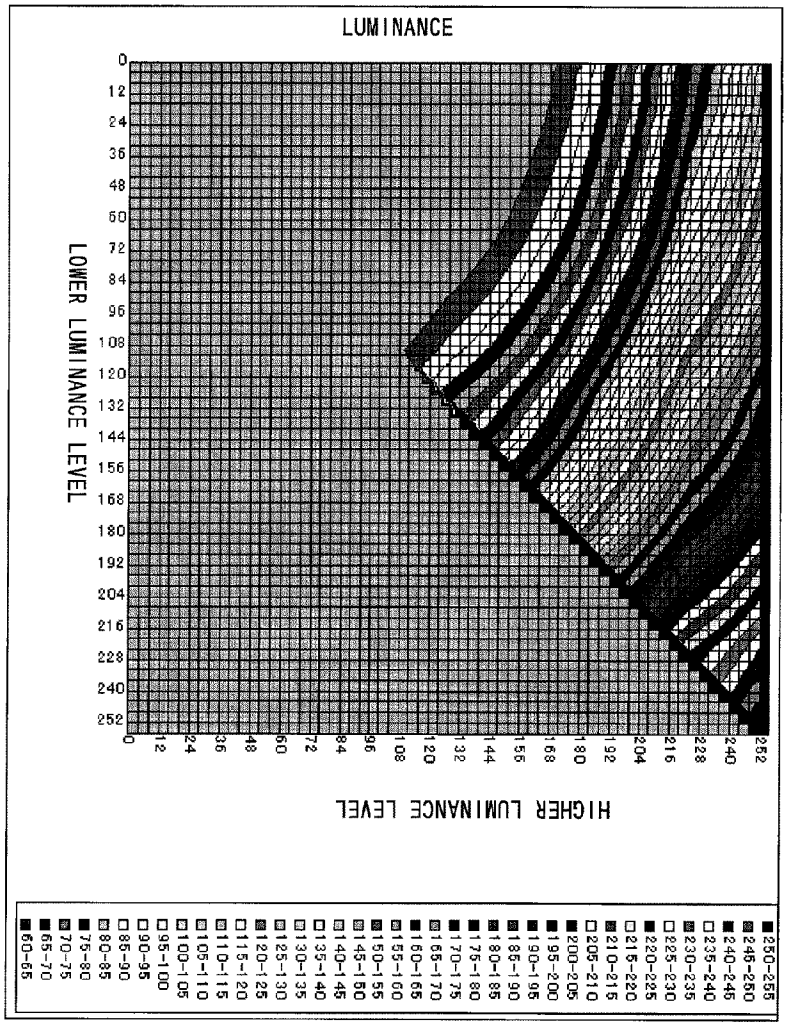
FIGS. 30A and 30B are figures showing a result of a simulation of equi-luminance distribution around adjustment of an output tone level versus luminance characteristic of a source driver IC according to example 3-4 in the third embodiment of the invention.
Figure 30B:
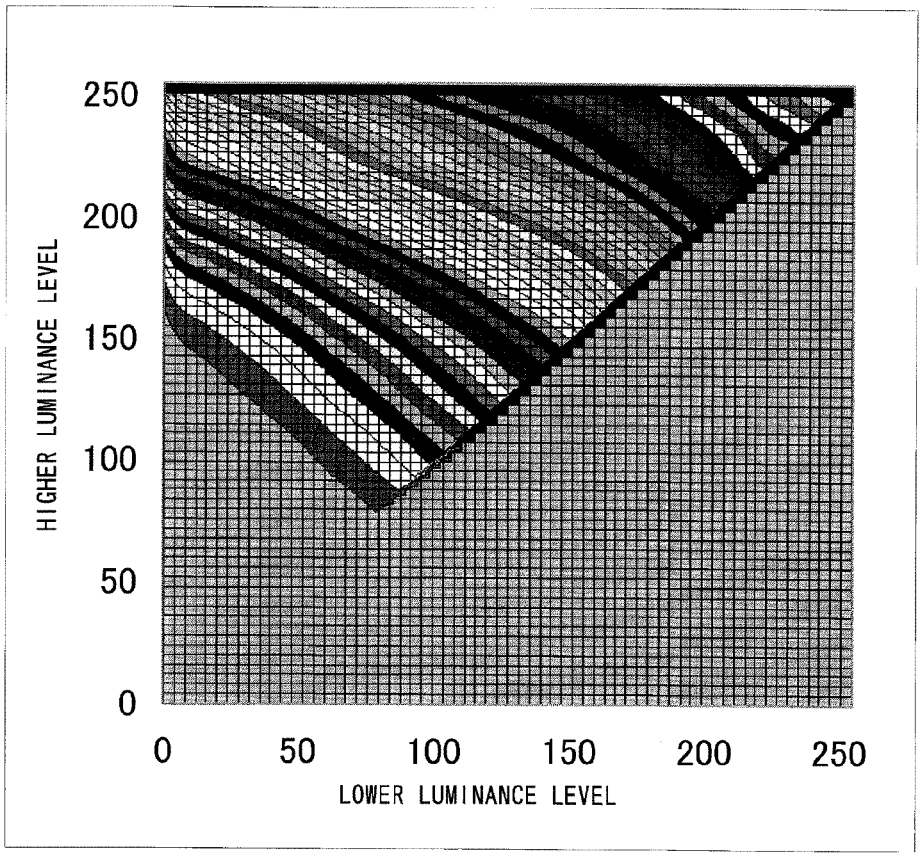
Figure 31:
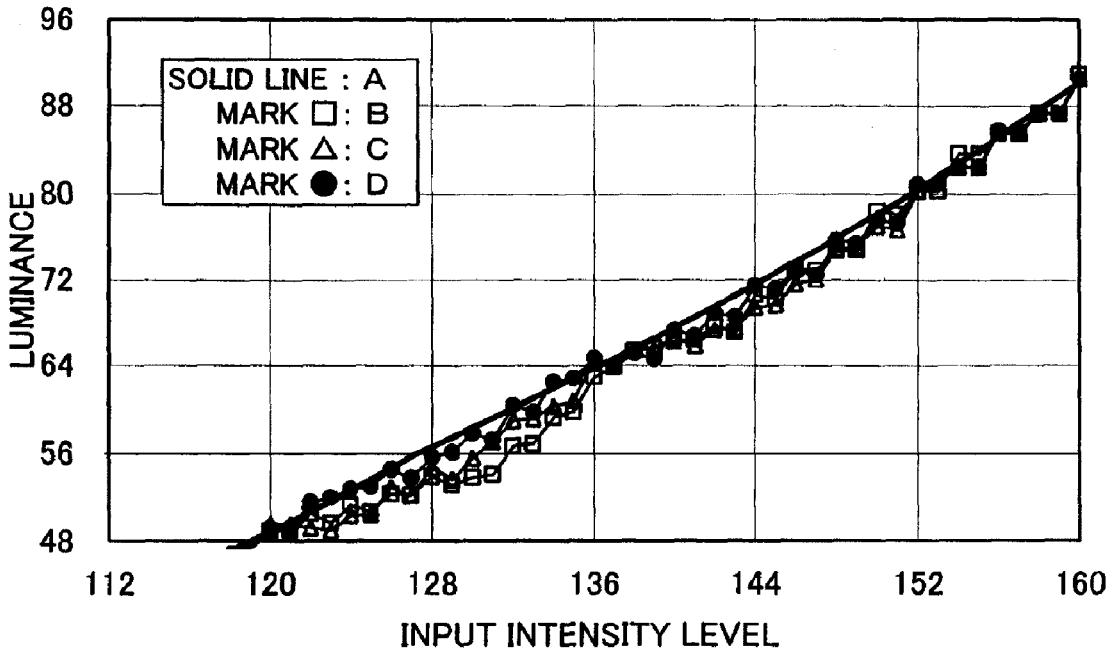
FIG. 31 is a graph showing a result of a measurement of luminance change on the G pixel when displaying an image having R at a tone level 136/255, B at a tone level 0/255 and G moving from an image end to end while changing from a tone level 0/255 to tone level 255/255 according to example 3-4 in the third embodiment of the invention.

Now example 3-4 according to the present embodiment is explained by using FIGS. 30 and 31. This example is characterized in that, in order not to change luminance by linear interpolation, the source driver IC for driving the liquid-crystal panel is adjusted in the characteristic of output tone level versus luminance thereby making the luminance distribution in a straight-line form. FIG. 30A shows a luminance distribution of before adjusting the characteristic of output tone level versus luminance while FIG. 30B shows a luminance distribution of after adjusting the same. With linear luminance distribution, the tone-level conversion table for linear interpolation does not transverse the equi-luminance distribution strip. The storage section or computation algorithm is not imposed by a great burden, thus facilitating realization. In case a luminance deviation is settled within 10%, preferred display is available with the moving image.

Now explained is the effect by an adjustment of the input tone-level versus luminance characteristic of the source driver IC. i.e., gamma characteristic correction. FIG. 31 is a result of a measurement that in what way the luminance on the G pixel changes when displaying an image having the R pixel at a tone level 136/255, the B pixel at a tone level 0/255 and the G pixel moving from an end to an end on the screen while changing from a tone level 0/255 to a tone level 255/255. The curve A shown by the solid line in the figure represents the usual (unprocessed) luminance, the curve B plotted with open square marks represents a luminance the gamma characteristic is unadjusted, the curve C plotted with open triangle marks represents a luminance of after optimizing the gamma characteristic, the curve D plotted with solid circle marks represents a luminance that the gamma characteristic is optimized and the tone-level conversion tables are increased in number. When the G pixel passes a tone level 136/255, the G pixel and the R pixel are inverted in magnitude relationship to thereby switch the tone-level conversion table. At around a tone level 136/255, an interpolation process as in the example is carried out. In the case that the luminance distribution is in a curvature in the relationship between a tone-level combination and a luminance distribution (curve B), the luminance lowers by 10% or more hence causing abnormality in the image. On the curve C the gamma characteristic is optimized, there is reduction of luminance decreasing. On the curve D the gamma characteristic is optimized and the tone-level conversion tables are increased in the number or so to narrow the spacing between the tone-level conversion tables and facilitate linear interpolation, it can be seen that the lowering in luminance is greatly improved into an approximation to the straight line A at usual luminance. Incidentally, as the smaller the lowering in luminance, the less the effect on the image. Thus it is suppressed to 10% or less.

As explained above, this example adjusts the characteristic of output tone-level versus luminance of the source drive IC, to make the luminance distribution linear. In spite of linear tone-level conversion, there is no possibility that the same tone-level data of after tone-level conversion transverse the equi-luminance distribution, preventing display nonuniformity from occurring.

EXAMPLE 3-5

Figure 32A:
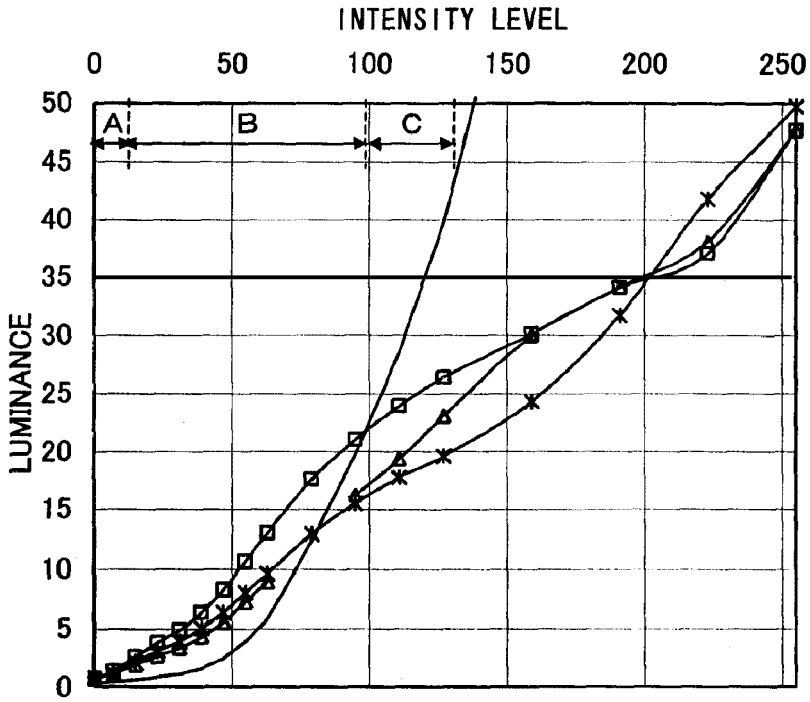
FIGS. 32A and 32B are figures explaining a tone-level setting method around a low tone level in an HTD technique according to example 3-5 in the third embodiment of the invention.

Now example 3-5 according to the present embodiment is explained by using FIG. 32. This example is characterized in that HTD technique is enhanced in effect around low tone level. Although the higher-luminance pixels and lower-luminance pixels are taken in a ratio of 1:1 in the higher tone-level region, as tone level is lower the higher-luminance pixels are thinned out to increase the ratio of the lower-luminance pixels. This naturally increases the luminance difference. As the luminance difference increases, there is a reduced utilization of intermediate level of luminance that is poor in viewing characteristic.

Figure 32B:
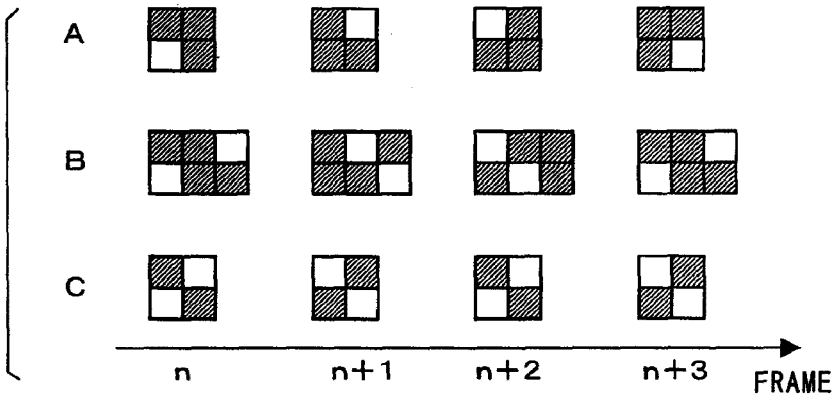
Figure 33A:
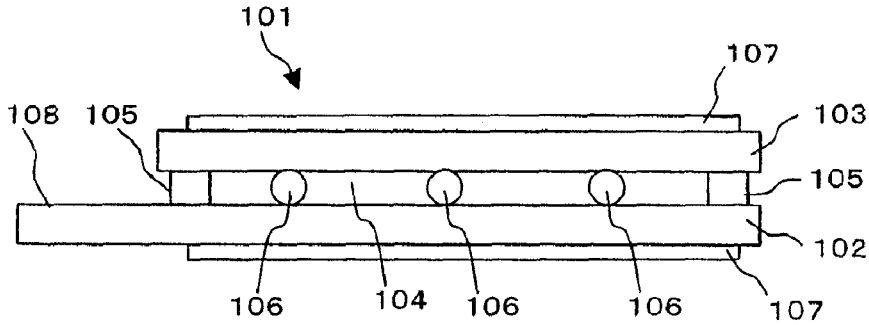
PRIOR ART FIG.33A
FIGS. 33A and 33B are figures showing an arrangement of a liquid-crystal display device of a vertically aligned type in the prior art.
Figure 33B:
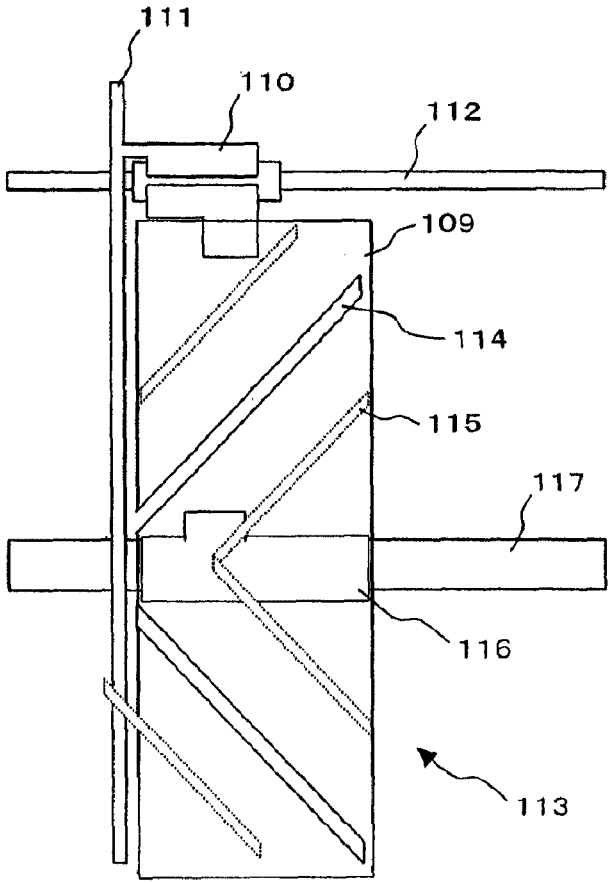
PRIOR ART FIG.33B
Figure 34A:
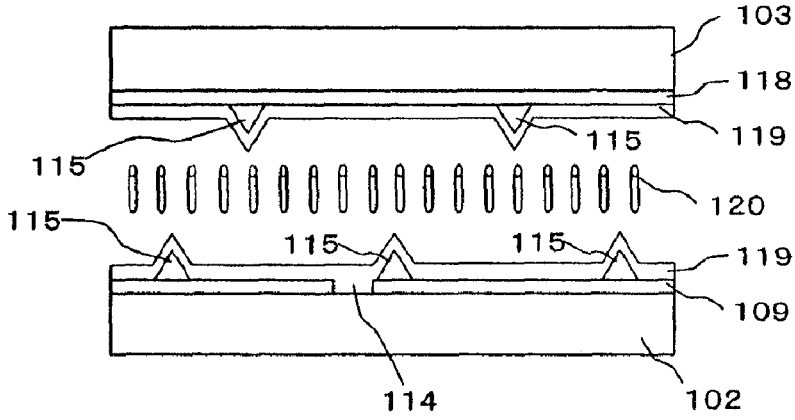
PRIOR ART FIG.34A
FIGS. 34A-34C are figures typically showing a sectional structure of a liquid-crystal display device of a vertically aligned type using an alignment partitioning technique in the prior art.
Figure 34B:
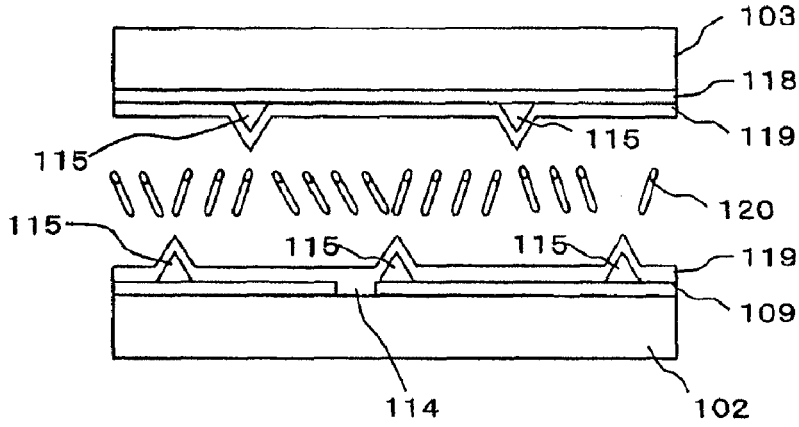
PRIOR ART FIG.34B
Figure 34C:
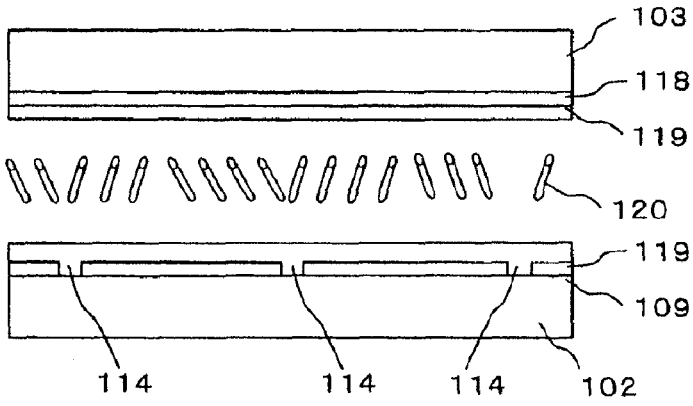
PRIOR ART FIG.34C

FIG. 32 is a figure explaining a tone-level setting method for enhancing the effect of HTD technique at around low tone level. The higher-luminance pixels and the low tone pixels are changed in the existence ratio and HTD is varied depending upon an input tone level, e.g., 1:3 in an extremely low tone (range A) of a tone level 0/128 to a tone level 16/128, 1:2 in a low tone (range B) of a tone level 17/128 to a tone level 99/128, and 1:1 in an intermediate tone (range C) of a tone level 100/128 or higher. FIG. 32B typically shows an existence ratio of higher-luminance and lower-luminance pixels around the low tone level. In the case the higher-luminance pixel is reduced in existence ratio, the luminance of the high tone pixels can be increased to increase the luminance difference between the higher-luminance and lower-luminance pixels in order to maintain, at the existence ratio, the luminance of before reducing the existence ratio. This can suppress the luminance at an oblique viewing angle from increasing. The reason of reducing the existence ratio only in the low tone level side is because, should the existence ratio be reduced in the higher tone level side, flicker would become very conspicuous. Because the absolute luminance is low on the lower tone level side, an adverse effect will not be exerted to the image. In order to suppress flicker, it is desired to provide higher-luminance and lower-luminance pixels at an existence ratio of 1:1. However, in this case, HT effect is weakened at the lower tone level. Accordingly, it is effective to change the existence ratio within the range the image is less exerted by bad effects, as in the present example.

As explained above, according to the present example, because image processing can be made only on the lower tone level side without having an effect upon the higher tone-level side, the luminance in the oblique direction can be suppressed from increasing with little or no flicker. As a result, it is possible to greatly reduce the straw coloring occurring when viewed in an oblique direction and to obtain a suited display characteristic.

As in the above, the present embodiment can suppress the display abnormality on the moving image and improve the characteristic on the lower tone-level side, by the use of the HTD technique capable of improving the display change of straw coloring as viewed obliquely.

As in the above, the first to third embodiments can realize an image processing method that broad in viewing angle and excellent in tone-level viewing angle characteristic and a liquid-crystal display device using the same.

Fourth Embodiment

A fourth embodiment of the invention is concerned with an image processing method for improving the quality of an image displayed on a display device, and a liquid-crystal display device using the same.

Recently, the active-matrix liquid-crystal display devices (hereinafter, "TFT-LCD"), having thin film transistors (TFTs) as switching elements, are broadly used in all sorts of display applications. In such a situation, it is desired to improve the display quality on the TFT-LCD. Particularly, there is a desire for a TFT-LCD having a wide viewing angle that a preferred display is available even if viewed in an oblique direction.

The MVA (multi-domain vertical alignment) type liquid-crystal display device is placed in practical use as a wide viewing angle TFT-LCD. The MVA-LCD has an overwhelming wide viewing angle as compared to the TN (twisted nematic) LCD or the like. However, the MVA-LCD involves a problem that, when observing the screen displaying a neutral tone in an oblique direction of upper/lower and left/right, the halftone color is increased in luminance. For example, where the human face is displayed or so, when viewing it in an oblique direction of upper, lower, left or right with respect to the normal to the screen, the skin color in nature looks a white, flat color.

There is known the halftone driving technique (hereinafter, referred to as "HT driving") for resolving that phenomenon. HT driving is the technique that, when displaying a certain tone-level color, luminance-increased display and luminance-decreased display are repeated alternately every other frame, to display the color in nature through the afterimage effect of the human eye.

Figure 64:
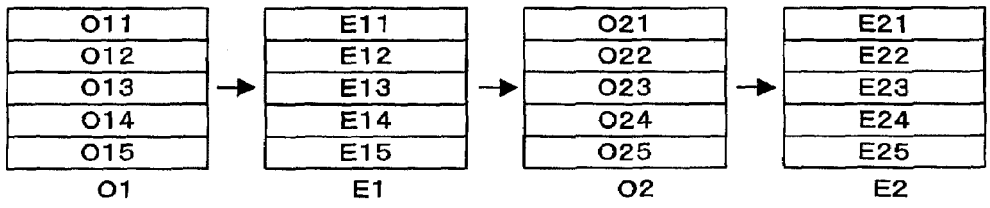
FIG. 64 is a figure typically showing a transmission state of an image signal of an interlaced scheme.

In the meanwhile, it remains unsettled to display, on a liquid-crystal display device by HT driving, a video image inputted under the interlaced scheme from the system side. In the usual television display, in order to economize broadcast band, video data is comb-removed to use an interlaced driving for display the odd-numbered lines and even-numbered lines alternately. FIG. 64 typically shows a transmission procedure of an image signal under the interlaced scheme. Under the interlaced scheme, a video signal O11-O15 for a first odd field 01 (exemplified five lines, similar hereinafter) is first sent from the transmission side to the television receiver. Then, a video signal E11-E15 for a first even field E1 is sent, then a video signal O21-O25 for a second odd field O2 is sent and then a video signal E21-E25 for a second even field E2 is sent.

Figure 65:
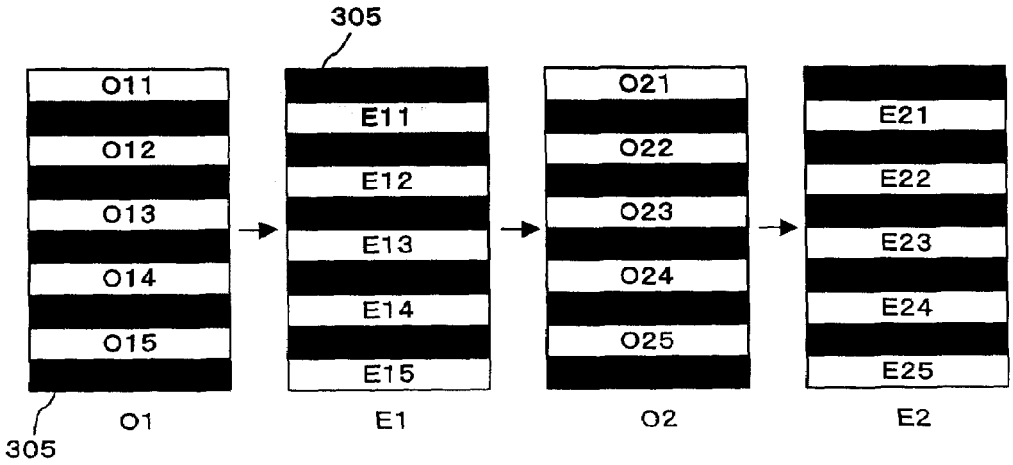
FIG. 65 is a figure typically showing a state an interlaced-schemed video signal is displayed on a CRT.

FIG. 65 typically shows a state of displaying an image on a CRT (cathode ray tube) with using an interlace-schemed video signal shown in FIG. 64. At first, a video signal O11 for first odd-field O1 is written to the beginning (first line) of the horizontal line. To the odd-numbered lines subsequent to that, written are video signals O12-O15 sequentially. At this time, the video signal is not written to the even-numbered line E11-E15. Because the CRT is a spontaneous-emission display device, black display 305 is made on the even-numbered line E11-E15. Thus, the odd field O1 is displayed.

Then, a video signal E11 for first even-field E1 is written to a second horizontal line. To the even-numbered lines subsequent to that, written are video signals E12-E15 sequentially. At this time, the video signal is not written to the odd-numbered line O11-O15, providing black display 305. Thus, the even field E1 is displayed.

The first odd field O1 and the first even field E1 constitute a first frame. Writing the first frame displays one screen. Subsequently, the second frame and the subsequent are displayed similarly.

Figure 66:
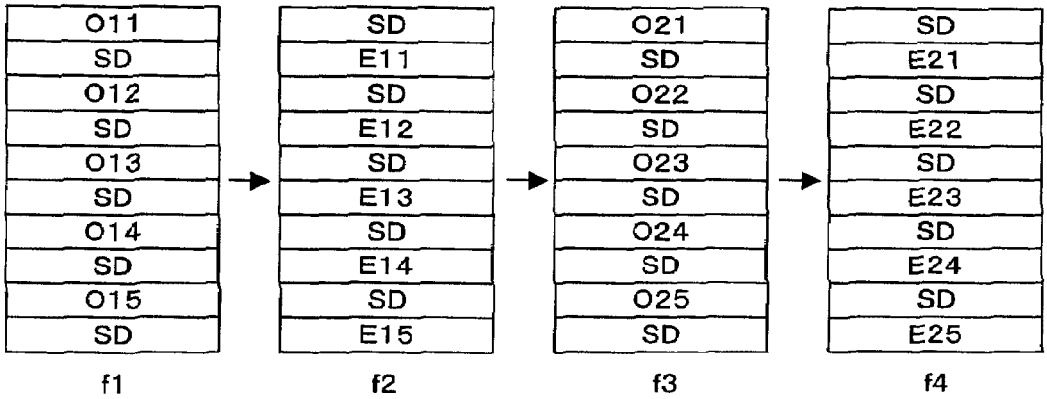
FIG. 66 is a figure typically showing a conventional technique for displaying an interlaced-schemed video signal on a liquid-crystal panel.

FIG. 66 typically shows a general technique for displaying an image on the TFT-LCD by using an interlace-schemed video signal shown in FIG. 64. At first, a video signal O11 for first odd-frame f1 is written to the beginning (first line) of the horizontal line. To the odd-numbered lines subsequent to that, written are video signals O12-O15 sequentially. In this odd frame f1, to the even-numbered lines of the second line and the subsequent are written interpolation video signals SD generated on the basis of the odd-lined video signals O1*n* and O1*n*+1 adjacent preceding and succeeding odd-numbered lines.

Then, a video signal E11 for first even-frame f2 is written to a second line. To the even-numbered lines subsequent to that, written are video signals E12-E15 sequentially. In this even frame f2, to the odd-numbered lines are written interpolation video signals SD generated on the basis of the even-lined video signals E1*n* and E1*n*+1 adjacent preceding and succeeding odd-numbered lines. Incidentally, as for the first line, a video signal E11 for example is written. Subsequently, images of second and the subsequent of odd frames f(2n+1) and even frames f(2n) are displayed sequentially in the similar manner.

However, the display method as shown in FIG. 66 has a disadvantage that, when an image is displayed on the TFT-LCD, the information included in nature in the video signal is reduced in amount. Although the non-write line is written by an interpolation video signal SD to have an increased information amount, this information is nothing more than predicted, inaccurate information. In writing to an odd frame f(2n+1), the true video signal to be written to the even-numbered line has been erased. Because this is true for the even-numbered frame f(2n), the information to be erased corresponds to a half of the information in entirety.

This embodiment aims at providing an image processing method capable of displaying an image excellent in color reproducibility at a wide viewing angle even when an interlace-schemed video signal is inputted, and a liquid-crystal display device using the same.

The above object can be achieved by an image processing method characterized by generating higher-luminance data and lower-luminance data from an image signal inputted under the interlace scheme, and mixing the higher-luminance data and the lower-luminance data in at least one of time or space thereby displaying an image.

Figure 37:
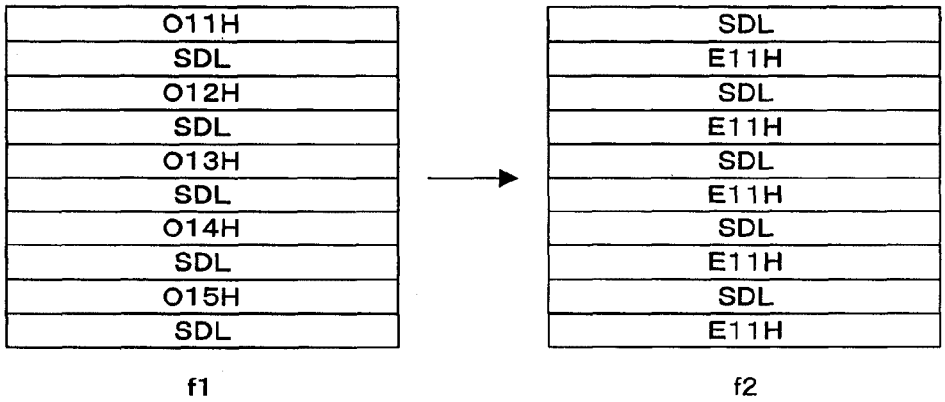
FIG. 37 is a figure showing the operation principle of an image processing method according to a fourth embodiment of the invention.

The image processing method according to the present embodiment and the liquid-crystal display device are explained by using FIGS. 37 to 46. The image processing method of the present embodiment is characterized in that an improved halftone driving technique is utilized in inputting an interlace-schemed video signal to the MVA-LCD, and displaying an image thereon. Using FIG. 37, explained is the operation principle of the image processing method of this embodiment. FIG. 37 typically shows a method for displaying an image on the MVA-LCD, by exemplifying a video signal in an interlace scheme shown in FIG. 64.

At first, generated is a video signal O11H having a luminance raised higher than the tone level in nature relative to a video signal O11 for the first odd frame f1, which is written to the beginning (first line) of the horizontal line. Then, an interpolation video signal SDL lowered in luminance than the video signal O11 is generated and written onto the second line. For the third line and the subsequent of odd-numbered lines, generated is a video signal raised higher in luminance than its tone level in nature, which is written thereto. For the fourth line and the subsequent of even-numbered lines, generated is an interpolation video signal SDL lower in luminance than the luminance for the forward-staged adjacent odd line, which is written thereto.

After an image of the first odd-numbered frame f1 is displayed, an interpolation video signal SDL lower in luminance than the luminance of the first even-numbered frame f2 of video signal E11 is generated and written onto the first line. Then, concerning the video signal E11, a video signal E11H raised in luminance higher than the luminance in nature is generated and written onto the second line. For the fourth line and the subsequent of even-numbered lines, generated is a video signal raised in luminance higher than its tone level in nature, which is written thereto. For the third line and the subsequent of odd-numbered lines, generated is an interpolation video signal SDL lower in luminance than the rear-staged adjacent even-numbered line, which is written thereto.

Subsequently, sequentially displayed are images of the second and subsequent of odd-numbered frames f(2n+1) and even-numbered frame f(2n), in the similar manner. Because HT drive is made possible in time and space by implementing the image display method of this example, it is possible to make an image representation wide in viewing angle and excellent in reproducibility upon making an display on the MVA-LCD an interlace-schemed video signal inputted.

First Driving Method

Figure 38:
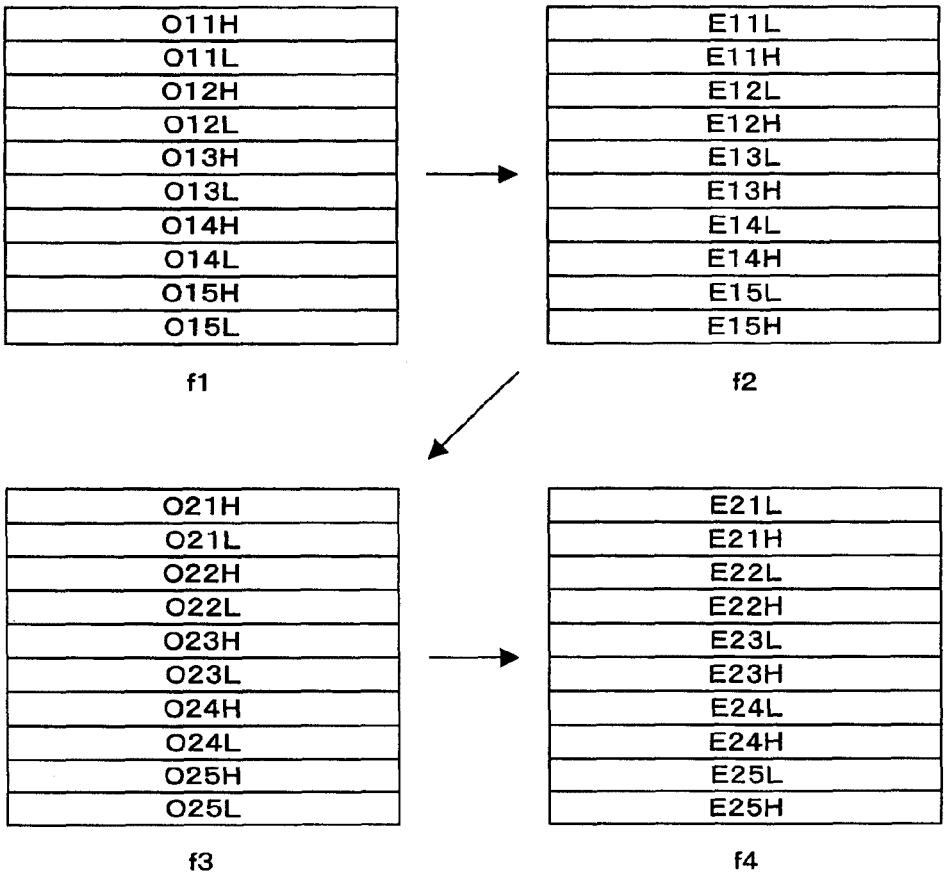
FIG. 38 is a figure showing a first driving method in an image processing method according to the fourth embodiment of the invention.

Now explained is a first driving method for displaying an image based on an interlace-schemed video signal on the liquid-crystal display device by using HT drive, in the image processing method according to the present embodiment. FIG. 38 typically shows a method of displaying an image on the MVA-LCD by exemplifying the interlace-schemed video signal of FIG. 64. In FIG. 38, the reference O represents an odd-numbered frame (Odd frame), the reference E represents an even-numbered frame (even frame), the reference H represents that the luminance is raised higher than its tone level in nature and the reference L represents that the luminance is reduced lower than its tone level in nature. Furthermore, two suffixes following the reference O represent an order of a frame among odd-numbered frames and an order of a line among odd-numbered lines. Meanwhile, two suffixes following the reference E represent an order of a frame among even-numbered frames and an order of a line among even-numbered lines. For example, "O21H" represents that the video signal at a first line in a second odd-numbered frame is written at a luminance higher than the tone level in nature on the relevant pixel.

At first, generated is a video signal O11H raised in luminance higher than the tone level in nature relative to the video signal O11 for first odd-numbered frame, which is written to the beginning (first line) of the horizontal line. Then, generated is an interpolation video signal O11L reduced in luminance lower than the video signal O11 such that a resulting luminance with the generated video signal O11H is nearly equal to the luminance to be caused by the video signal O11, which is written onto the second line. For the third line or subsequent of odd-numbered line, generated are video signals O1*n*H raised in luminance higher than the tone level in nature, which are respectively written thereto. For the fourth line and subsequent of even-numbered lines, generated are interpolation video signals O1*n*L lower in luminance than the luminance on the forward-staged adjacent odd-numbered line, which are written thereto.

After the first odd-numbered frame f1 of image is displayed, then generated is a video signal E11H raised in luminance higher than the tone level in nature of the video signal E11 for first even-numbered frame f2. Then, generated is an interpolation video signal E11L reduced in luminance lower than the video signal E11 such that a resulting luminance with the generated video signal E11H is nearly equal to the luminance to be caused by the video signal E11, which is written onto the first line. To the second line, the video signal E11H is written. For the fourth line and subsequent of even-numbered lines, generated are interpolation video signals E1*n*H raised in luminance higher than the tone level in nature, which are written respectively. For the third line and subsequent of odd-numbered lines, generated are interpolation video signals E1*n*L lower in luminance than the rear-staged adjacent even-numbered line, which are written respectively.

Subsequently, the second and subsequent of odd-numbered frames f(2n+1) and even-numbered frame f(2n) of images are displayed in order, in the similar manner. Because HT drive is enabled in time and space by implementing the image display method of this example, it is possible to make an image representation wide in viewing angle and excellent in reproducibility upon making an display on the MVA-LCD by inputting an interlace-schemed video signal. Incidentally, the above is not limited to in the combination whether to raise or lower than the luminance in nature when writing a signal to the odd-numbered or even-numbered line. It can be suitably modified during displaying an image on the MVA-LCD.

Second Driving Method

Figure 39:
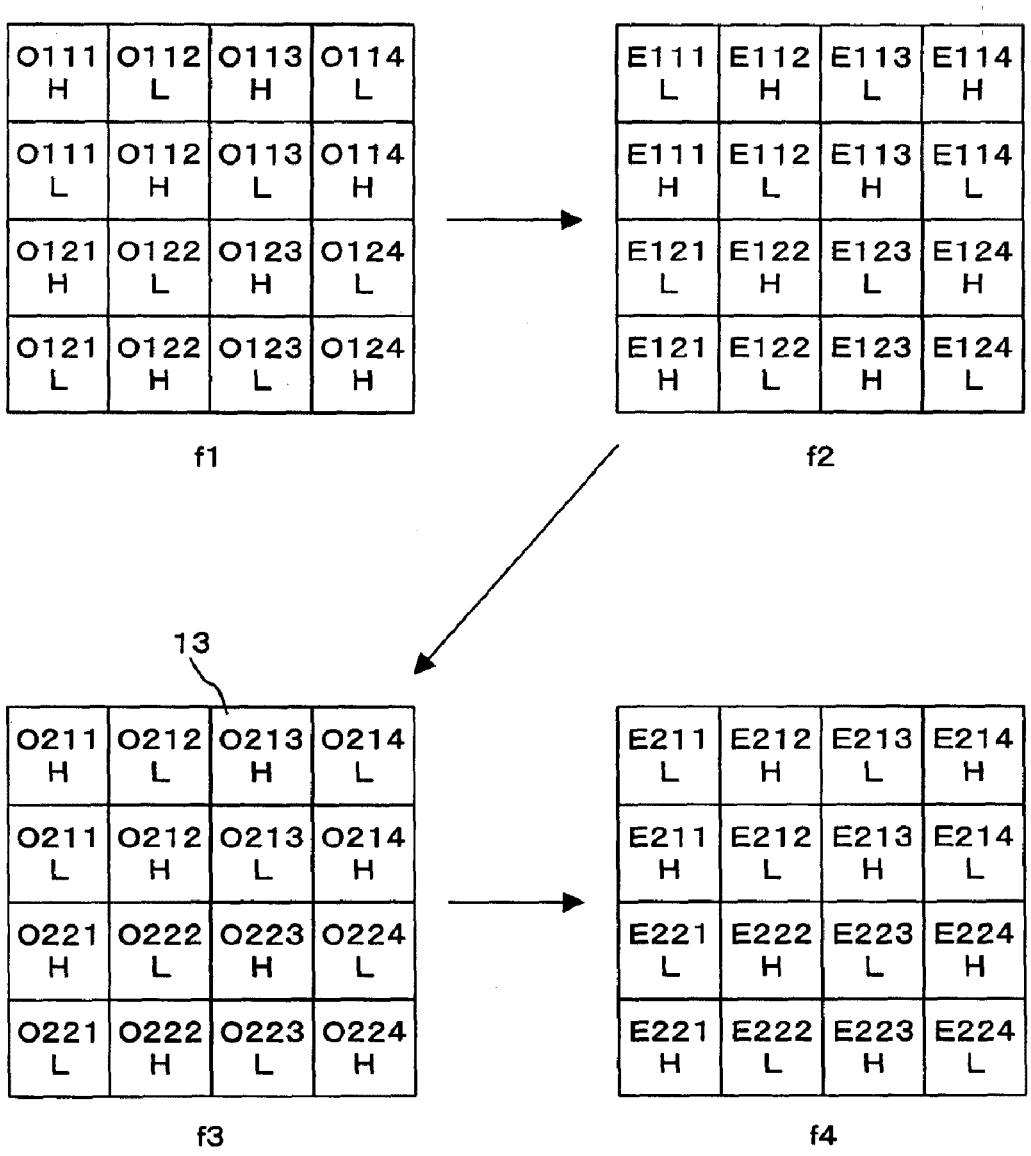
FIG. 39 is a figure showing a second driving method in an image processing method according to the fourth embodiment of the invention.

Now explained is a second driving method for displaying an image based on an interlace-schemed video signal on the MVA-LCD by using HT driving, in the image processing method according to the present embodiment. The present driving scheme is characterized in that luminance is changed relative to the tone level in nature, for the odd-numbered column line and even-numbered column line. FIG. 39 typically shows a second driving method, exemplifying 16 pixels on the (first to fourth) rows×(first to fourth) columns of the pixel regions having n rows×m columns on the MVA-LCD. In FIG. 39 and subsequent, the reference O represents an odd-numbered frame (Odd frame), the reference E represents an even-numbered frame (even frame), the reference H represents that the luminance is raised higher than the tone level in nature, and the reference L represents that the luminance is reduced lower than the tone level in nature. Furthermore, three suffixes following the reference O represent, in order, an order of a frame among odd-numbered frames, an order io of a line among odd-numbered horizontal lines and an order j of a line among the vertical lines. Meanwhile, three suffixes following the reference E represent, in order, an order of a frame among even-numbered frames, an order ie of a line among odd-numbered horizontal lines and an order of a line j among the vertical lines. For example, "O213H" represents that, in a second odd-numbered frame, a video signal at i=1st odd-numbered horizontal line and j=3rd vertical line is written at a raised luminance higher than the tone level in nature of the relevant pixel.

As shown in FIG. 39, in the first odd-numbered frame f1, explanation is as a pixel on row ie, column (2j−1) of even-numbered horizontal line (hereinafter, pixel (ie, (2j−1)).

Meanwhile, ie is an order of a line among the even-numbered horizontal lines, wherein a video signal having ie=1, 2, . . . , (n−1)/2, n/2 and j=1, 2, . . . , (m−1)/2, m/2 uses a video signal O1*io* (2j−1) for a pixel (io, (2j−1)) on io row of the forward-staged odd-numbered horizontal line, where io is an order of a line among the odd-numbered lines, where io=1, 2, . . . , (n−1)/2, n/2. Meanwhile, the video signal on a pixel (ie, 2j) uses a video signal O1*io* (2j) for the forward-staged pixel (io, 2j).

Meanwhile, the pixel (io, (2j−1)) is written by a video signal O1*io* (2j−1)H raised in luminance higher than the tone level in nature relative to the video signal O1*io* (2j−1). On the other hand, the pixel (ie, (2j−1)) is written by a video signal O1*io* (2j−1)L lowered in luminance than the tone level in nature of the video signal O1*io* (2j−1).

Meanwhile, the pixel (io, (2j)) is written by a video signal O1*io* (2j)L lowered in luminance than the tone level in nature relative to the video signal O1*io* (2j). On the other hand, the pixel (ie, (2j)) is written by a video signal O1*io* (2j)H raised in luminance higher than the tone level in nature of the video signal O1*io* (2j).

Accordingly, concerning the luminance of the video signals to be written to the pixels, the pixels raised in luminance higher than the tone level in nature and the pixels lowered in luminance than the tone level in nature are arranged alternately in vertical and horizontal directions (checkerwise).

Next, in the first even-numbered frame f2, the video signal on a pixel (io, (2j−1)) uses a video signal E1*ie* (2j−1) for the rear-staged pixel (ie, (2j−1)). Meanwhile, the video signal on a pixel (io, 2j) uses a video signal E1*ie* (2j) for the rear-staged pixel E1*ie*, (ie, 2j).

Meanwhile, the pixel (io, (2j−1)) is written by a video signal E1*ie* (2j−1) L lowered in luminance than the tone level in nature relative to the video signal E1*ie* (2j−1). On the other hand, the pixel (ie, (2j−1)) is written by a video signal E1*io* (2j−1)H raised in luminance higher than the tone level in nature relative to the video signal E1*ie* (2j−1).

Meanwhile, the pixel (io, (2j)) is written by a video signal E1*ie* (2j)H raised in luminance higher than the tone level in nature relative to the video signal E1*ie* (2j). On the other hand, the pixel (ie, (2j)) is written by a video signal E1*ie* (2j)L lowered in luminance than the tone level in nature of the video signal E1*io* (2j).

Accordingly, concerning the luminance of the video signals to be written to the pixels, the pixels raised in luminance higher than the tone level in nature and the pixels lowered in luminance than the tone level in nature are arranged alternately in vertical and horizontal directions (checkerwise). By the similar operation, the present driving method is applied, in order, to the second odd-numbered frame f3, the second even-numbered frame f4 and the subsequent frames. This makes it possible to make an image display wide in viewing angle and excellent in color reproducibility.

Third Driving Method

Figure 40:
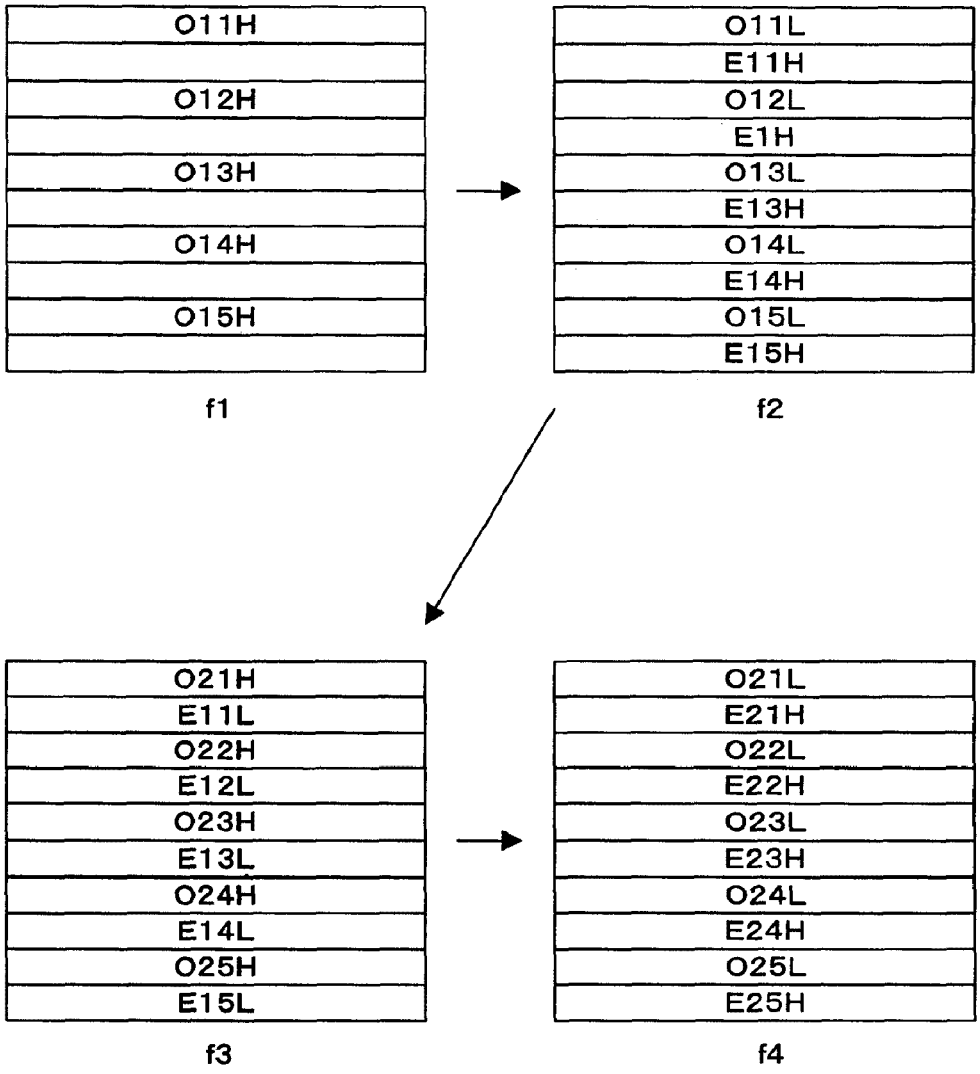
FIG. 40 is a figure showing a third driving method in an image processing method according to the fourth embodiment of the invention.

Now explained is a third driving method for displaying an image based on an interlace-schemed video signal on the MVA-LCD by using HT driving, in the image processing method according to the present embodiment, by using FIG. 40. FIG. 40 typically shows a method for displaying an image on the MVA-LCD by exemplifying the interlace-schemed video signal shown in FIG. 64.

At first, generated are video signals O11H-O15H raised in luminance higher than the tone level in nature relative to the video signals O11-O15 for first odd-numbered frame f1, which are written to the display lines starting at the beginning (first line) of the horizontal line.

After an image of the first odd-numbered frame f1 is displayed, then, in the first even-numbered frame f2, generated are video signals E11H-E15H raised in luminance higher than the tone level in nature relative to the video signals E11-E15 for even-numbered frame f2 as well as video signals O11L-O15L lowered in luminance than the tone level in nature relative to the video signals O11-O15 for the first odd-numbered frame f1. These video signals O11L-O15L and E11H-E15H are written, in order, to predetermined horizontal lines, respectively.

After an image of the first even-numbered frame f2 is displayed, then, in the second odd-numbered frame f3, generated are video signals O21H-O25H raised in luminance higher than the tone level in nature relative to the video signals O21-O25 for odd-numbered frame f3 as well as video signals E11L-E15L lowered in luminance than the tone level in nature relative to the video signals E11-E15 for the first even-numbered frame f2. These video signals E11L-E15L and O21H-O25H are written, in order, to predetermined horizontal lines, respectively.

After an image of the second odd-numbered frame f3 is displayed, then, in the second even-numbered frame f4, generated are video signals E21H-E25H raised in luminance higher than the tone level in nature relative to the video signals E21-E25 for even-numbered frame f4 as well as video signals O21L-O25L lowered in luminance than the tone level in nature relative to the video signals O21-O25 for second odd-numbered frame f3. These video signals O21L-O25L and E21H-E25H are written, in order, to predetermined horizontal lines, respectively.

In this manner, although the video signals Okio (k=1, 2, 3, 4, . . . ) and the video signals Ekie are sent with a delay of 1 frame one after another, the odd-numbered line and the even-numbered lines can be written by the video signals to be written in nature. Furthermore, it is possible to write alternately a video signal raised in luminance higher than the luminance in nature and a video signal lowered in luminance than the luminance in nature. By doing so, HT driving is possible in time and in space.

Fourth Driving Method

Figure 41:
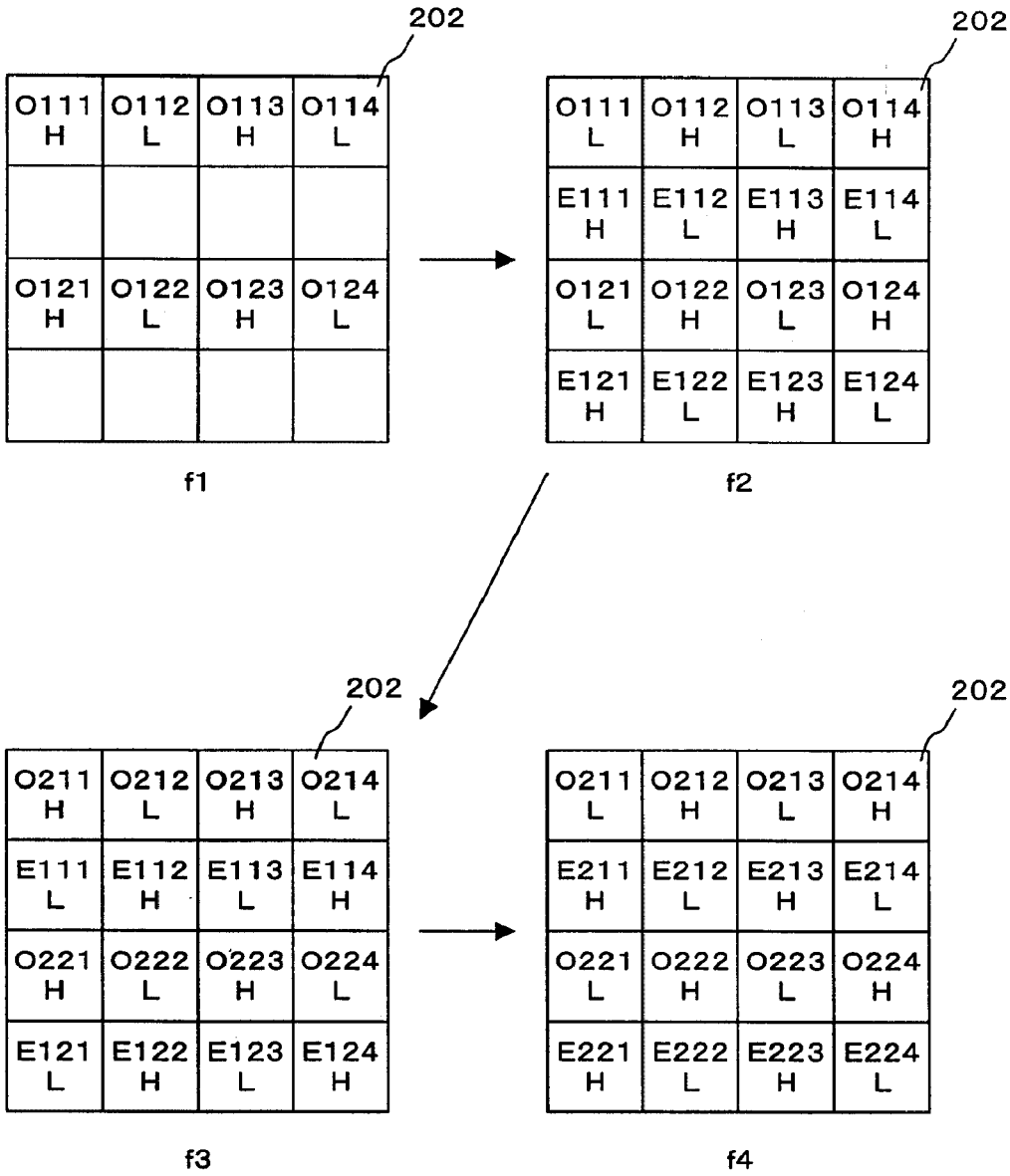
FIG. 41 is a figure showing a fourth driving method in an image processing method according to the fourth embodiment of the invention.

Now explained is a fourth driving method for displaying an image based on an interlace-schemed video signal on the MVA-LCD by using HT driving, in the image processing method according to the present embodiment, by using FIG. 41. FIG. 41 shows a fourth driving method, exemplifying 16 pixels on the (first to fourth) rows×(first to fourth) columns of the pixel regions having n rows×m columns on the MVA-LCD.

At first, generated are a video signal O1*io* (2j−1)H raised in luminance higher than the tone level in nature relative to the video signal O1*io* (2j−1) for first odd-numbered frame f1 as well as a video signal O1*io* (2j)L lowered in luminance than the tone level in nature relative to the video signal O1*io* (2j). The video signal O1*io* (2j−1)H is written to the pixel (io, (2j−1)) while the video signal O1*io* (2j)L is written to the pixel (io, 2j).

After the image of the first odd-numbered frame f1 is displayed, then generated are a video signal E1*ie* (2j−1)H raised in luminance higher than the tone level in nature relative to the video signal E1*ie* (2j−1) for first even-numbered frame f2 as well as a video signal E1*ie* (2j)L lowered in luminance than the tone level in nature relative to the video signal E1*ie* (2j). Furthermore, generated are a video signal O1*io* (2j)L lowered in luminance than the tone level in nature relative to the video signal O1*io* (2j−1) for first odd-numbered frame f1 and a video signal O1*io* (2j)H raised in luminance higher than the tone level in nature relative to the video signal O1*io* (2j).

The video signal O1*io* (2j−1)L is written to the pixel (io, (2j−1)) while the video signal O1*io* (2j)H is written to the pixel (io, 2j). The video signal E1*ie* (2j−1) H is written to the pixel (ie, (2j−1)) while the video signal E1*ie* (2j)L is written to the pixel (ie, (2j)).

After the image of the first even-numbered frame f2 is displayed, then generated are a video signal O2*io* (2j−1)H raised in luminance higher than the tone level in nature relative to the video signal O2*io* (2j−1) for second odd-numbered frame f3 as well as a video signal O2*io* (2j)L lowered in luminance than the tone level in nature relative to the video signal O2*io* (2j). Furthermore, generated are a video signal E1*io* (2j−1)L lowered in luminance than the tone level in nature relative to the video signal E1*io* (2j−1) for first even-numbered frame f2 and a video signal E1*io* (2j)H raised in luminance higher than the tone level in nature relative to the video signal E1*io* (2j).

The video signal O2*io* (2j−1)H is written to the pixel (io, (2j−1)) while the video signal O2*io* (2j)L is written to the pixel (io, 2j). Furthermore, the video signal E1*io* (2j−1)L is written to the pixel (ie, (2j−1)) while the video signal E1*io* (2j)H is written to the pixel (ie, (2j)).

After the image of the second odd-numbered frame f3 is displayed, then generated are a video signal E2*ie* (2j−1)H raised in luminance higher than the tone level in nature relative to the video signal E2*io* (2j−1) for second even-numbered frame f4 as well as a video signal E2*ie* (2j)L lowered in luminance than the tone level in nature relative to the video signal E2*ie* (2j). Furthermore, generated are a video signal O2*io* (2j−1)L lowered in luminance than the tone level in nature relative to the video signal O2*io* (2j−1) for second odd-numbered frame f3 as well as a video signal O2*io* (2j)H raised in luminance higher than the tone level in nature relative to the video signal O2*io* (2j).

The video signal O2*io* (2j−1)L is written to the pixel (io, (2j−1)) while the video signal O2*io* (2j)H is written to the pixel (io, 2j). The video signal E2*ie* (2j−1)H is written to the pixel (ie, (2j−1)) while the video signal E2*ie* (2j)L is written to the pixel (ie, (2j)).

In the write operation, a video signal Okioj for odd-numbered line is written to the odd-numbered line while a video signal Ekiej for even-numbered line is written to the even-numbered line. For example, putting the eye on the pixel 202, it is to be written by the video signal O114H for raising luminance higher than the luminance in nature and the video signal O114L for lowering luminance, over two frames. Meanwhile, on the odd-numbered lines, write operation is started at the odd-numbered frame f1 the video signal O1*ioj* for odd-numbered line has s been sent while on the even-numbered lines, write operation is started at the even-numbered frame f2 the video signal E1*iej* for even-numbered line has been sent. Accordingly, the odd-numbered line and the even-numbered line are deviated in writing by one frame. Incidentally, if viewing the screen entirely, concerning the luminance of the video signals to be written to the pixels, the pixels raised in luminance higher than the tone level in nature and the pixels lowered in luminance in the vertical and horizontal directions (checkerwise).

Effect of the First to Fourth Driving Methods

In the case of using the first driving method explained in FIG. 38, there are no video signals to be discarded at all. Furthermore, because the pixels raised in luminance higher than the tone level in nature and the pixels lowered than that are arranged alternately line by line, there is no possibility to cause flicker. As shown in FIG. 38, the odd-numbered line is written, without exception, by a video signal OkioH (or OkioL) raised (or lowered) in luminance from the tone level in nature of the video signal Okio for odd-numbered line while the even-numbered line is written, without exception, by a video signal EkieL (or EkieH) lowered (or raised) in luminance from the tone level in nature of the video signal Ekie for even-numbered line. In this case, the display raised in luminance, to assume a center of the display screen, is written to the pixel to be naturally written, suppressing the lower of resolution to the minimum extent. Furthermore, as in the second driving method explained in FIG. 39, it is possible to arrange the pixel raised in luminance higher than the tone level in nature and the pixel lowered alternately in vertical and horizontal directions over the screen entirety. The intensity of luminance on the relevant display is provided as checkerwise, and hence flicker is not to be visually perceived. Furthermore, it is possible to prevent particular poor display such as horizontal strip.

In the first and second driving method explained in FIGS. 38 and 39, despite the video signal itself is not discarded, the information to be written to the odd-numbered line is also written to the even-numbered line, thus having a possibility to lower the definition of image.

In case using the third driving method explained on FIG. 40, the video signal is not discarded at all wherein the video signal Okio for odd-numbered line is displayed, without exception, on the odd-numbered line while the video signal Ekie for even-numbered line is displayed, without exception, on the even-numbered line, not causing resolution lowering. Furthermore, because the pixel raised in luminance higher than the tone level in nature and the pixel lowered therefrom are arranged alternately line by line, no flicker is caused. Also, if viewing limitedly to one line, there are displayed alternately a pixel raised in luminance in time and a pixel lowered, hence providing display free of unsuited feeling.

In the fourth driving method explained on FIG. 41, it is possible to arrange the pixel raised in luminance higher than the tone level in nature and the pixel lowered alternately in vertical and horizontal directions over the screen entirety. The intensity of luminance on the relevant display is as checkerwise, and hence flicker is not to be visually perceived. Furthermore, it is possible to prevent particular poor display such as horizontal strip, providing further quality of display.

Example of First Driving Method

Figure 42:
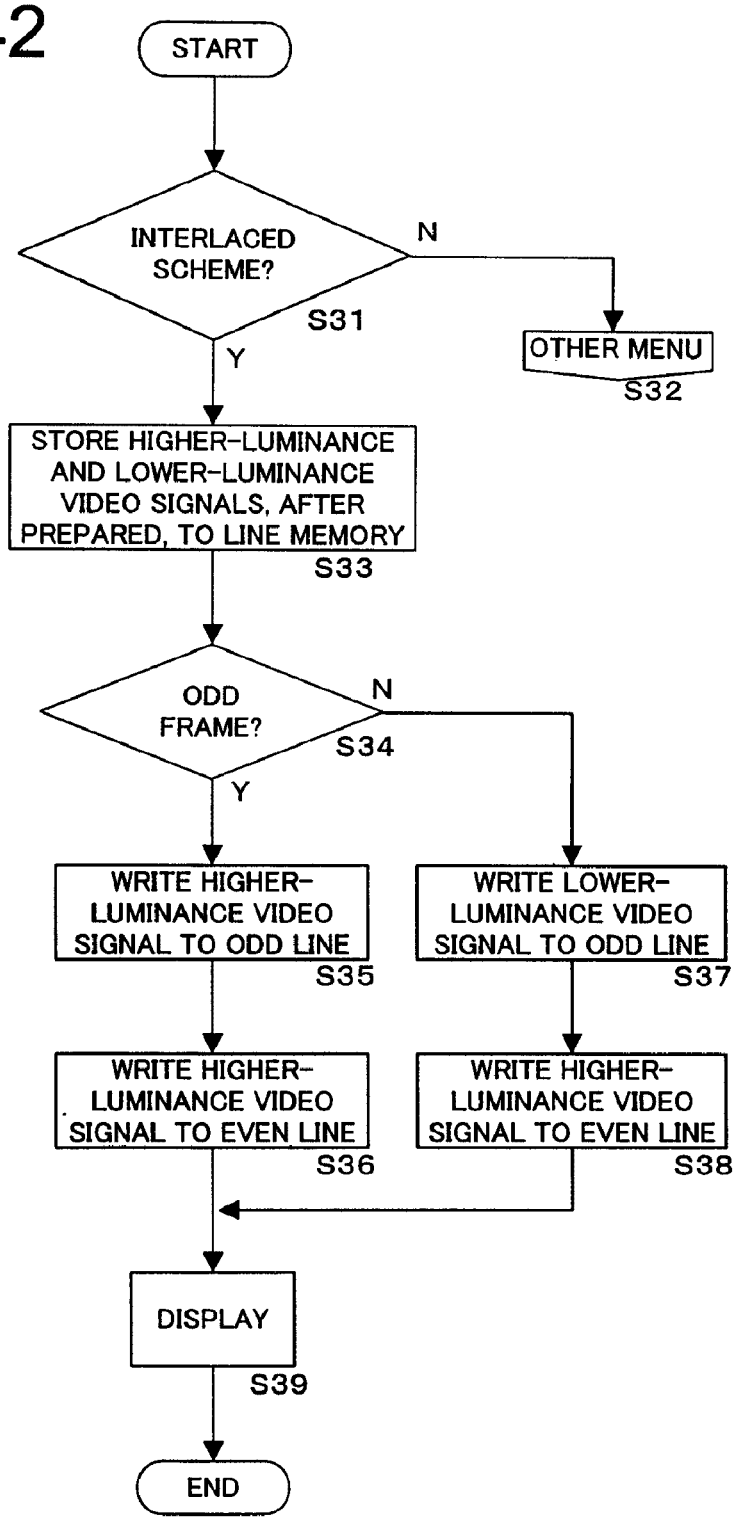
FIG. 42 is a flowchart showing an image display operation in one frame in the first driving method of an image processing method according to the fourth embodiment of the invention.

FIG. 42 shows a flowchart of a 1-frame image display operation in the first driving method. At first, it is determined whether the signal inputted to the liquid-crystal display device is of an interlace scheme or a non-interlace scheme (step S31). In the case the signal is of an interlace scheme, signal processing is made on a separate menu (step S32). Incidentally, the step S32 is omitted to explain. In the case the signal is of an interlace scheme, the tone-level conversion table is locked up on a pixel-by-pixel basis, to prepare a video signal of after conversion for raising luminance higher than the luminance in nature (hereinafter, referred to as a "higher-luminance video signal") and a video signal of after conversion for lowering luminance than the luminance in nature (hereinafter, referred to as a "lower-luminance video signal"). The prepared video signals are stored to the line memory (step S33).

Then, it is determined whether an odd-numbered frame or an even-numbered frame (step S34). In the case determined as an odd-numbered frame, the higher-luminance video signal is written to the odd-numbered line (step S35). Then, the lower-luminance video signal is written to the even-numbered line (step S36). On the other hand, when determined as an even-numbered frame in the step S34, the lower-luminance video signal is written to the odd-numbered line (step S37) and then the higher-luminance video signal to the even-numbered line (step S38). Depending upon the written video signal, an image is displayed on the liquid-crystal display device (step S39), thus ending the 1-frame image display. Incidentally, the next frame of display operation is made by repetition from the step S33.

By this operation, the higher-luminance video signal for odd-numbered line is written to the odd-numbered line while the higher-luminance video signal for even-numbered line is written to the even-numbered line. Because the higher-luminance video signal is strongly perceived as a factor determining resolution by the human eye, resolution reduction can be suppressed to the minimum extent. Incidentally, it is possible to change the combination of higher-luminance and lower-luminance video signals in the odd-numbered and even-numbered frames. Meanwhile, the combination may be changed frame by frame.

Example of Second Driving Method

Figure 43:
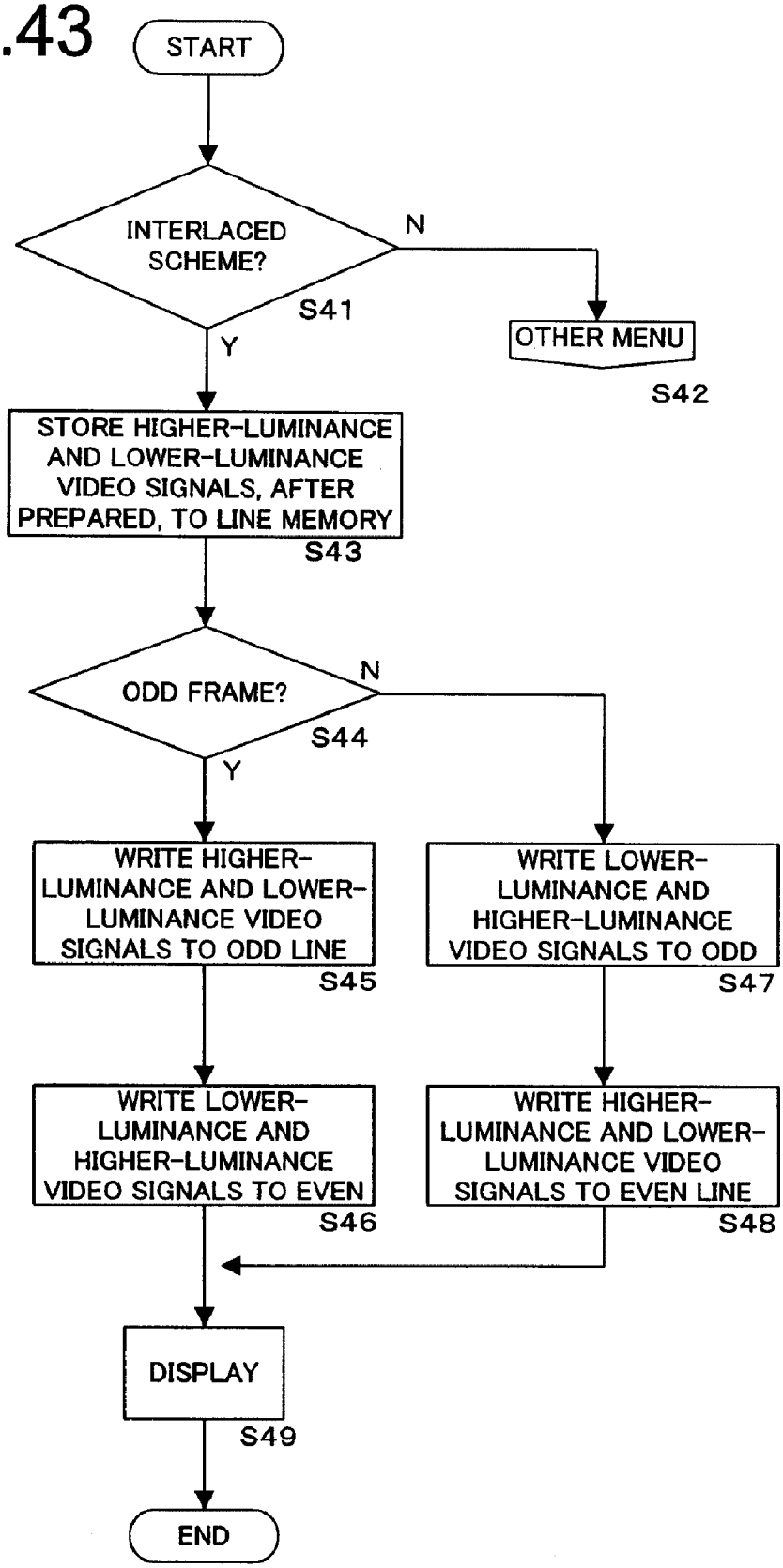
FIG. 43 is a flowchart showing an image display operation in one frame in the second driving method of the image processing method according to the fourth embodiment of the invention.

FIG. 43 shows a flowchart of a 1-frame image display operation in the second driving method. At first, it is determined whether the signal inputted to the liquid-crystal display device is of an interlace scheme or a non-interlace scheme (step S41). In the case the signal is of a non-interlace scheme, signal processing is made on a separate menu (step S42). Incidentally, the step S42 is omitted to explain. In the case the signal is of an interlace scheme, the tone-level conversion table is locked up on a pixel-by-pixel basis, to prepare a higher-luminance video signal and a lower-luminance video signal. The prepared video signals are stored to the line memory (step S43).

Then, it is determined whether an odd-numbered frame or an even-numbered frame (step S44). In the case determined as an odd-numbered frame, the higher-luminance video signal and the lower-luminance video signal are alternately written to each pixel given by a set of red, green and blue (RGB) on the odd-numbered line (step S45). In the step S45, the higher-luminance video signal is written to a write-start pixel on each odd-numbered line. Then, the lower-luminance video signal and the higher-luminance video signal are alternately written to each pixel given by a set of RGB on the even-numbered line (step S46). In the step S46, the lower-luminance video signal is written to a write-start pixel on each even-numbered line.

Meanwhile, in the case determined as an even-numbered frame, the lower-luminance video signal and higher-luminance video signal for even-numbered line is alternately written to each pixel given by a set of RGB on the odd-numbered line (step S47). In the step S47, the lower-luminance video signal is written to a write-start pixel on each odd-numbered line. Then, the higher-luminance video signal and the lower-luminance video signal are alternately written to each pixel given by a set of RGB on the even-numbered line (step S48). In the step S48, the higher-luminance video signal is written to a write-start pixel on each even-numbered line. Depending upon the written video signal, an image is displayed on the liquid-display device (step S49), ending the 1-frame image display. Incidentally, the next frame of display operation is made by repetition from the step S43.

By this operation, the higher-luminance video signal and the lower-luminance video signal are alternately displayed at between the pixels adjacent vertically and horizontally. Furthermore, on the pixels, the higher-luminance video signal and the lower-luminance video signal are alternately displayed frame by frame. Accordingly, each pixel displays the higher-luminance and lower-luminance video signals both in space and in time. Because, in an odd-numbered frame, a video signal for odd-numbered line is displayed on a predetermined pixel, there encounters no deviation in space and in time. However, the video signal for odd-numbered line is displayed on the even-numbered line, resolution is to deteriorate. Incidentally, it is possible to change the combination of higher-luminance and lower-luminance video signals in the odd-numbered and even-numbered frames. Meanwhile, the combination may be changed frame by frame.

Example of Third Driving Method

Figure 44:
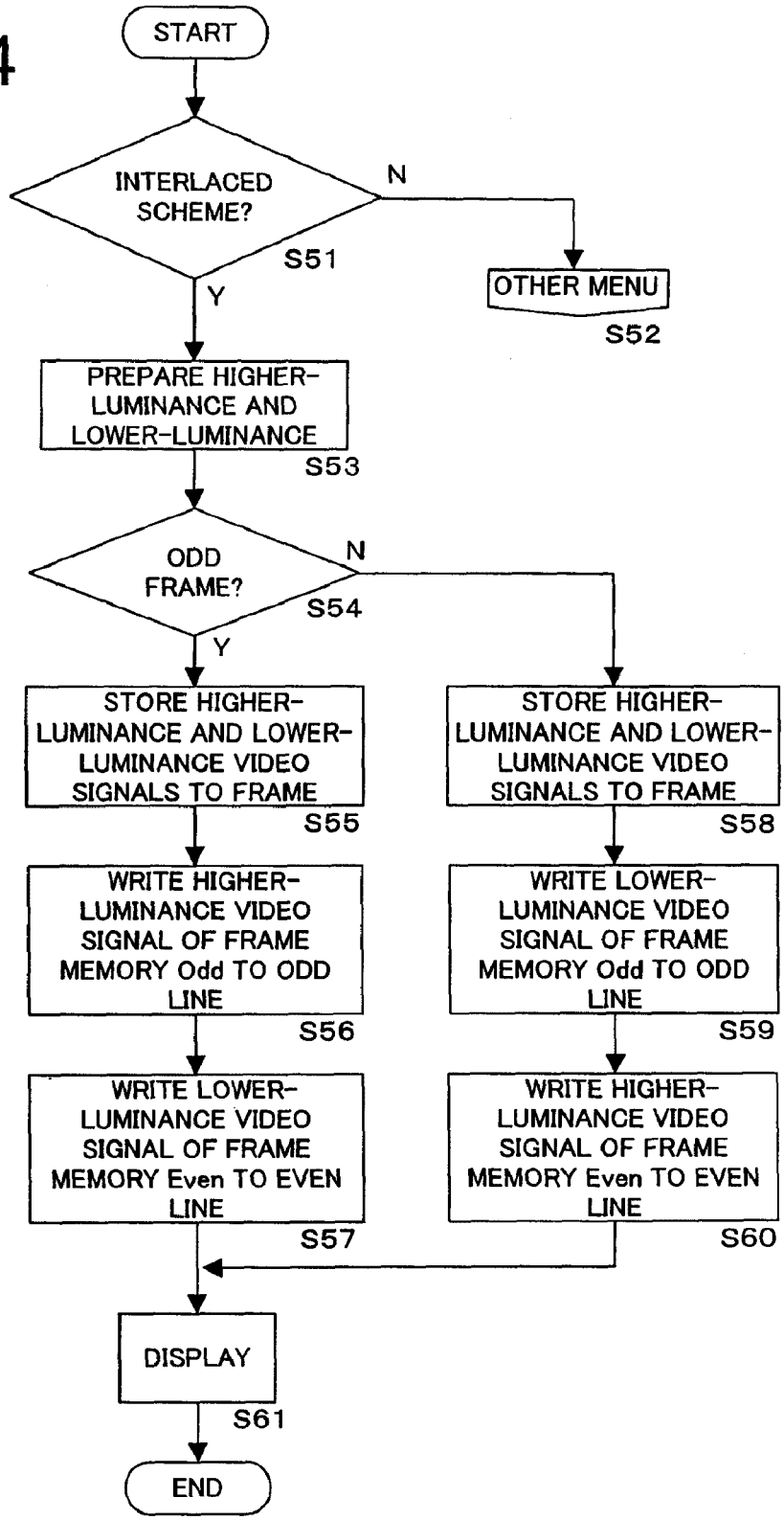
FIG. 44 is a flowchart showing an image display operation in one frame in the third driving method of the image processing method according to the fourth embodiment of the invention.

FIG. 44 shows a flowchart of a 1-frame image display operation in the third driving method. At first, it is determined whether the signal inputted to the liquid-crystal display device is of an interlace scheme or a non-interlace scheme (step S51). In the case the signal is of a non-interlace scheme, signal processing is made on a separate menu (step S52). Incidentally, the step S52 is omitted to explain. In the case the signal is of an interlace scheme, the tone-level conversion table is locked up on a pixel-by-pixel basis, to prepare a higher-luminance video signal and a lower-luminance video signal (step S53).

Then, it is determined whether an odd-numbered frame or an even-numbered frame (step S54). In the case determined as an odd-numbered frame, the higher-luminance video signal and lower-luminance video signal prepared in the step S53 is stored to the frame memory Odd (step S55). Then, the higher-luminance video signal stored in the frame memory Odd is written to the odd-numbered line (step S56). Then, the lower-luminance video signal stored in the frame memory Even is written to the even-numbered line (step S57). At this time, the frame memory Even is stored with the higher-luminance and lower-luminance video signals prepared in the even-numbered frame that is 1-frame preceding the relevant odd-numbered frame.

Meanwhile, in the case determined as an even-numbered frame, the higher-luminance video signal and lower-luminance video signal prepared in the step S53 is stored to the frame memory Even (step S58). Then the lower-luminance video signal stored in the frame memory Odd is written to the odd-numbered line (step S59). At this time, the frame memory Odd is stored with the higher-luminance and lower-luminance video signals prepared in the odd-numbered frame that is 1-frame preceding the relevant odd-numbered frame. Then, the higher-luminance video signal stored in the relevant frame Even is written to the odd-numbered line (step S60). Depending upon the written video signal, an image is displayed on the liquid-crystal display device (step S61), thus ending the 1-frame image display. Incidentally, the next frame of display operation is made by repetition from the step S53.

In the explanation of FIG. 44, in the relevant odd-numbered (or even-numbered) frame, the higher-luminance video signal is written to the odd-numbered line (or even-numbered line), to write the lower-luminance video signal of an even (or odd) numbered frame that is 1-frame preceding the relevant odd-numbered (or even-numbered) frame to the even-numbered line (or odd-numbered-line) thus carrying out image display. However, the lower-luminance video signal in the relevant odd-numbered (or even-numbered) frame may be written to the odd-numbered line (or even-numbered line), to write the higher-luminance video signal of an even (or odd) numbered frame that is 1-frame preceding the relevant odd-numbered (or even-numbered) frame to the even-numbered line (or odd-numbered-line) thus carrying out image display. Replacement is possible on the explanations of even-numbered line and odd-numbered line. Also, the combination of how to write may be changed on a frame-by-frame basis.

Example of Fourth Driving Method

Figure 45:
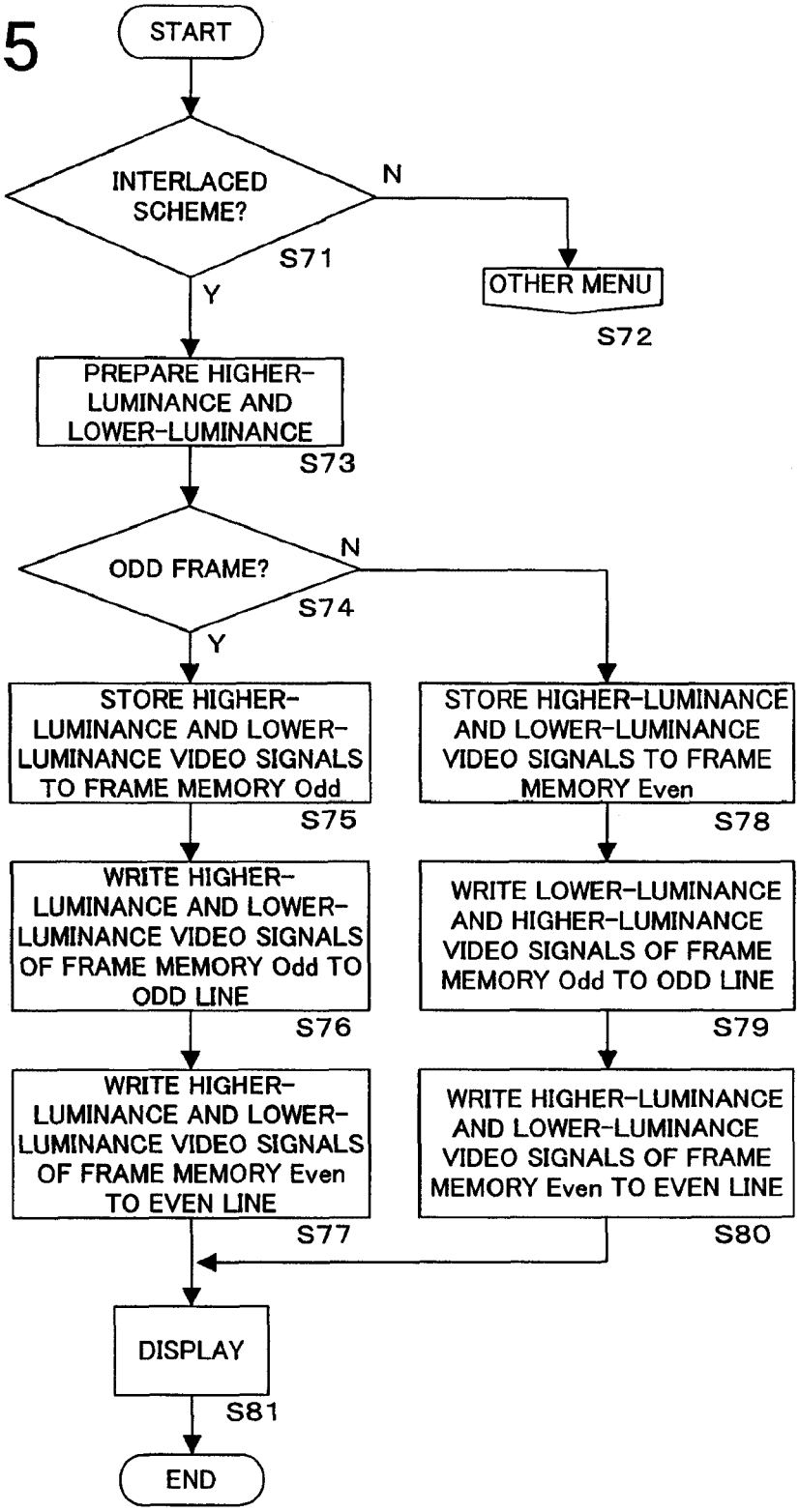
FIG. 45 is a flowchart showing an image display operation in one frame in the fourth driving method of the image processing method according to the fourth embodiment of the invention.

FIG. 45 shows a flowchart of a 1-frame image display operation in the fourth driving method. At first, it is determined whether the signal inputted to the liquid-crystal display device is of an interlace scheme or a non-interlace scheme (step S71). In the case the signal is of a non-interlace scheme, signal processing is made on a separate menu (step S72). Incidentally, the step S72 is omitted to explain. In the case the signal is of an interlace scheme, the tone-level conversion table is locked up on a pixel-by-pixel basis, to prepare a higher-luminance video signal and a lower-luminance video signal (step S73).

Then, it is determined whether an odd-numbered frame or an even-numbered frame (step S74). In the case determined as an odd-numbered frame, the higher-luminance video signal and lower-luminance video signal prepared in the step S73 is stored to the frame memory Odd (step S75). Then, the higher-luminance video signal stored in the frame memory Odd is written to the odd-numbered line. At this time, the higher-luminance video signal and the lower-luminance video signal are alternately written to the pixels each given as a set of RGB on the odd-numbered line (step S76). At the step S76, the write-start pixel on each odd-numbered line is written by the higher-luminance video signal. Then, the higher-luminance and lower-luminance video signals stored in the frame memory Even are written to the even-numbered line. At this time, the lower-luminance video signal and the higher-luminance video signal are alternately written to the pixels each given as a set of RGB on the even-numbered line (step S77). At the step S77, the write-start pixel on each even-numbered line is written by the lower-luminance video signal. Incidentally, the frame memory Even is stored with the higher-luminance and lower-luminance video signals prepared in the even-numbered frame that is 1-frame preceding the relevant odd-numbered frame.

Meanwhile, in the case determined as an even-numbered frame, the higher-luminance and lower-luminance video signals prepared in the step S73 is stored to the frame memory Even (step S78). Then, the lower-luminance video signal stored in the frame memory Odd is written to the odd-numbered line. At this time, the lower-luminance video signal and the higher-luminance video signal are alternately written to the pixels each given as a set of RGB on the odd-numbered line (step S79). At the step S79, the write-start pixel on each odd-numbered line is written by the lower-luminance video signal. Incidentally, the frame memory Odd is stored with a higher-luminance and lower-luminance video signals prepared in the odd-numbered frame that is 1-frame preceding the relevant odd-numbered frame. Then, the higher-luminance and lower-luminance video signals stored in the frame memory Even are written to the even-numbered line. At this time, the higher-luminance video signal and the lower-luminance video signal are alternately written to the pixels each given as a set of RGB on the even-numbered line (step S80). At the step S80, the write-start pixel on each even-numbered line is written by the higher-luminance video signal. Depending upon the written video signal, an image is displayed on the liquid-crystal display device (step S81), thus ending the 1-frame image display. Incidentally, the next frame of display operation is made by repetition from the step S73.

In the FIG. 45 explanation, although the pixel is based on a set of RGB, this is not limited to, i.e., higher-luminance and lower-luminance video signals may be alternately displayed based on R, G and B. Also, concerning whether the write start on each line uses a higher-luminance video signal or a lower-luminance video signal, the foregoing explanation is not limited to provided that the signals are different between the pixels adjacent vertically and horizontally. The descriptions of even-numbered line and odd-numbered line can be replaced. Meanwhile, the combination of how to write may be changed based on the frame.

Figure 46A:
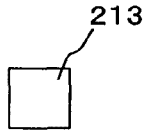
FIGS. 46A-46D are figures explaining a display method when resolution is different between the input video image and the display screen in the image processing method according to the fourth embodiment of the invention.
Figure 46B:
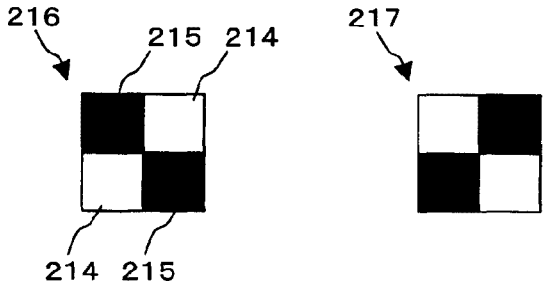

In the meanwhile, the above example explained the driving method where the input video signal and the display screen are the same in resolution. Here, explained is an image display method where the input video signal and the display screen are different in resolution. FIG. 46 is a figure explaining an image display method using HT driving in the case the input video signal and the display screen are different in resolution. Incidentally, in the below, explanation is on the example that the screen has a resolution double that of the input video signal with respect to the vertical and horizontal directions. FIG. 46A is a concept figure of an input video signal 213 in an amount of one pixel. The one-pixel input video signal 213 is to be written to four pixels of the display screen. Accordingly, as shown in FIG. 46B, the higher-luminance video signals 214 and the lower-luminance video signals 215 are written such that luminance is different between the adjacent pixels. At this time, the pixel 216 in an odd-numbered frame and the pixel 217 in an even-numbered frame are inverted in writing by the higher-luminance video signal 214 and the lower-luminance video signal 215. Accordingly, the higher-luminance video signal 214 and the lower-luminance video signal 215 are to be alternately displayed in space and in time.

Figure 46C:
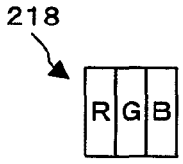
Figure 46D:
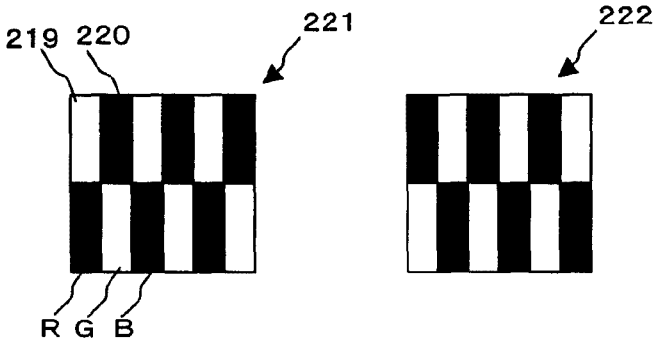

FIGS. 46C and 46D show an example the present image display method is implemented on the RGB pixel. The input video signal 218 for RGB as one set is to be written to four pixels of the display screen. As shown in FIG. 46D, the higher-luminance video signal 219 and the lower-luminance video signal 220 are alternately written based on each pixel of RGB and differently in luminance at between the adjacent pixels. Furthermore, writing the higher-luminance video signal 219 and lower-luminance video signal 220 is inverted between the odd-framed pixel 221 and the even-framed pixel 222. Accordingly, the higher-luminance video signal 219 and lower-luminance video signal 220 are alternately displayed in space and in time. This enables to display a natural image free of flicker and straw coloring.

As explained above, the present embodiment can realize an image processing method wide in viewing angle and excellent in color reproducibility even where inputted by an interlace-schemed video signal, and a liquid-crystal display device using the same.

Fifth Embodiment

Explanation is made on an image processing method according to the present embodiment, a liquid-crystal display device using the same and a driving method for a liquid-crystal display device, by using FIGS. 47 to 62. Recently, liquid-crystal display devices are broadly used on notebook personal computers, desktop personal computer monitors, liquid-crystal televisions, etc., by the requirement of energy and space saving. The market applications of liquid-crystal display devices are on continuous increase. In such situations, the liquid-crystal display device is required by the higher quality of display characteristic. The improvement of display characteristics has been attempted in liquid-crystal material characteristic, display device structure, driving scheme and so on. One of the factors to deteriorate the display characteristic of liquid-crystal display device includes the poor characteristic of viewing angle.

Improvement has been made on the viewing characteristic by improving material property and display device structure. Meanwhile, as a viewing-angle-characteristic improving technique based on image signal processing, there is used an image processing method based on driving halftone (HT) technique using two values without using the regions poor in visual characteristics. However, this image processing method has a disadvantage that image sandiness is to be visually perceived by the user because the two values are displayed fixed. Consequently, the present embodiment provides an image processing method wide in viewing angle, excellent in color reproducibility and extremely less in sandiness feeling, a liquid-crystal display device and driving method for a liquid crystal display device using the same.

Figure 47:
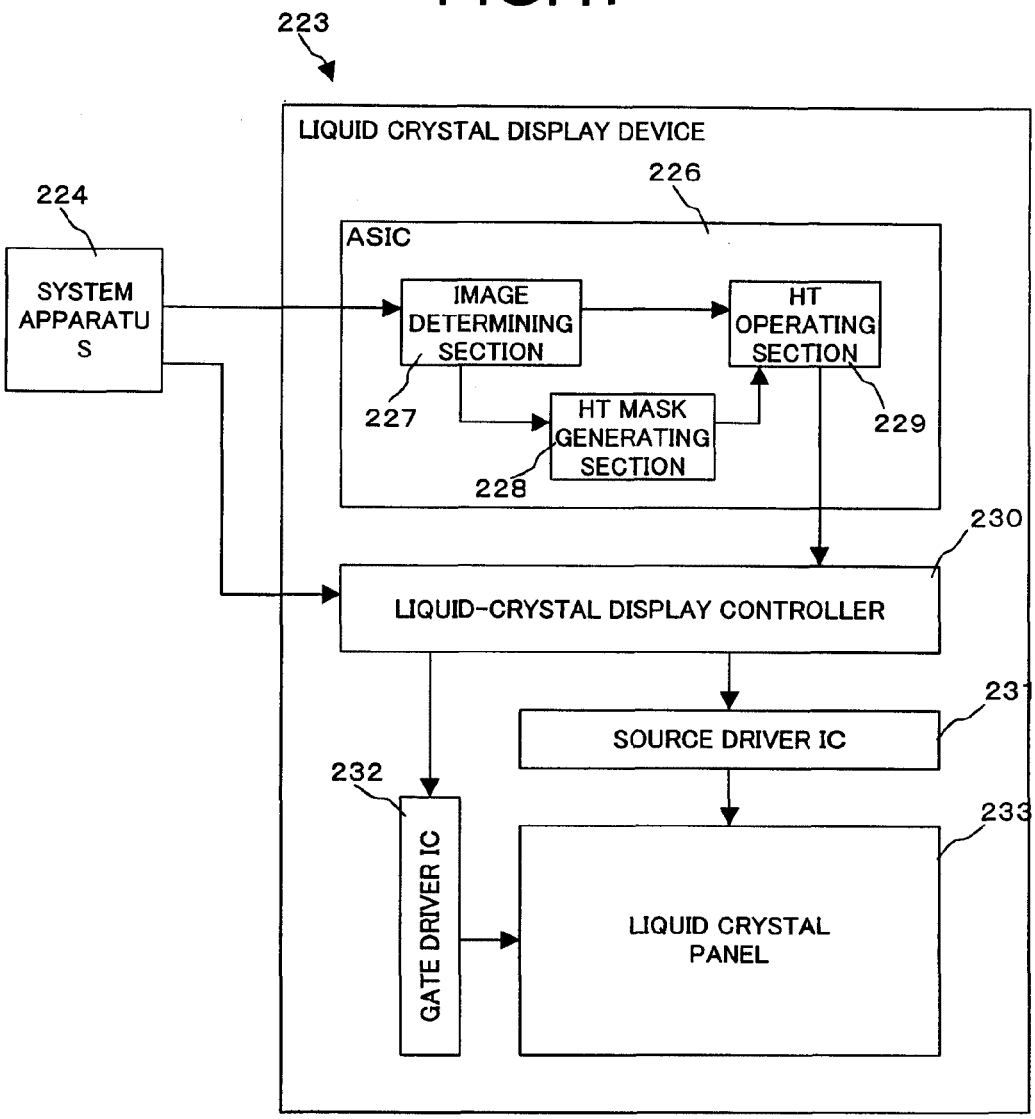
FIG. 47 is a functional block diagram of a liquid-crystal display device 223 according to a fifth embodiment of the invention.

FIG. 47 shows, by a functional block diagram, a liquid-crystal display device 223 according to the present embodiment. A system apparatus 224, such as a desktop personal computer, outputs to the liquid-crystal display device 223 a control signal for regulating the timing of driving liquid crystal and a video signal. The video signal, inputted from the system apparatus 224, is outputted to a video-signal-converting ASIC 226 as one of the constituent element of a driving circuit of the liquid-crystal display device 223. The ASIC 226 has an image determining section 227 for recognizing a tone level of an input video signal, an HT mask generating section 228 for generating a dispersion pattern in an HT level of a display image, and an HT operating section 229 for HT-processing the input video signal.

Meanwhile, the control signal outputted from the system apparatus 224 is outputted to a liquid-crystal display control section 230 as one of the constituent elements of the drive circuit of the liquid-crystal display device 223. Furthermore, the liquid-crystal display control section 230 is inputted by a video signal of after image conversion outputted from the ASIC 226. The liquid-crystal display control section 230 generates a control signal for controlling a source driver IC 231 and gate driver IC 232 for driving the liquid-crystal panel, and outputs, in predetermined timing, the control signal to the source driver IC 231 and gate driver IC 232. Furthermore, the liquid-crystal display control section 230 outputs, in predetermined timing, the video signal to the source driver IC 231.

The source driver IC 231 converts the received video signal into an analog video signal and outputs, in predetermined timing, the analog video signal to a not-shown pixel of within the liquid-crystal panel 233. The gate driver IC 232 scans the not-shown TFTs of within the liquid-crystal panel 233 and controls the TFTs to turn on/off. The liquid-crystal panel 233 controls transmission light depending upon an analog video signal stored on the pixels, thereby displaying an image.

Now explained is the operation of image conversion process to be carried out by the ASIC 226. The image determining section 227 within the ASIC 226 recognizes n tone level of an input video signal and selects an HT processing scheme suited for the relevant video signal, to output a select signal to an HT mask generating section 228. Depending upon the inputted select signal, the HT mask generating section 228 determines, frame by frame, a distribution pattern (hereinafter, referred to as an HT mask pattern) of a higher-luminance HT drive level and lower-luminance HT drive level of within a predetermined display area of the video signal to be HT-processed, thus outputting it to an HT operating section 229. The HT operating section 229 provides the higher-luminance HT drive level and lower-luminance HT drive level to the input video signal inputted from the image determining section 227 based on the HT mask pattern for each frame determined in the HT mask generating section 228. The tone-level signals image-converted by the HT process of this embodiment are forwarded sequentially from the liquid-crystal display controller 230 to the source driver IC 231 so that the liquid-crystal panel 233 can display an HT-processed image. As a result, viewing-angle characteristics are improved. Furthermore, by the in-time dispersion effect the HT mask pattern changes frame by frame, it is possible to greatly reduce the sandiness feeling to be visually perceived on the conventional driving.

Explanations are concretely made in the below by using examples.

EXAMPLE 5-1

Figure 48:
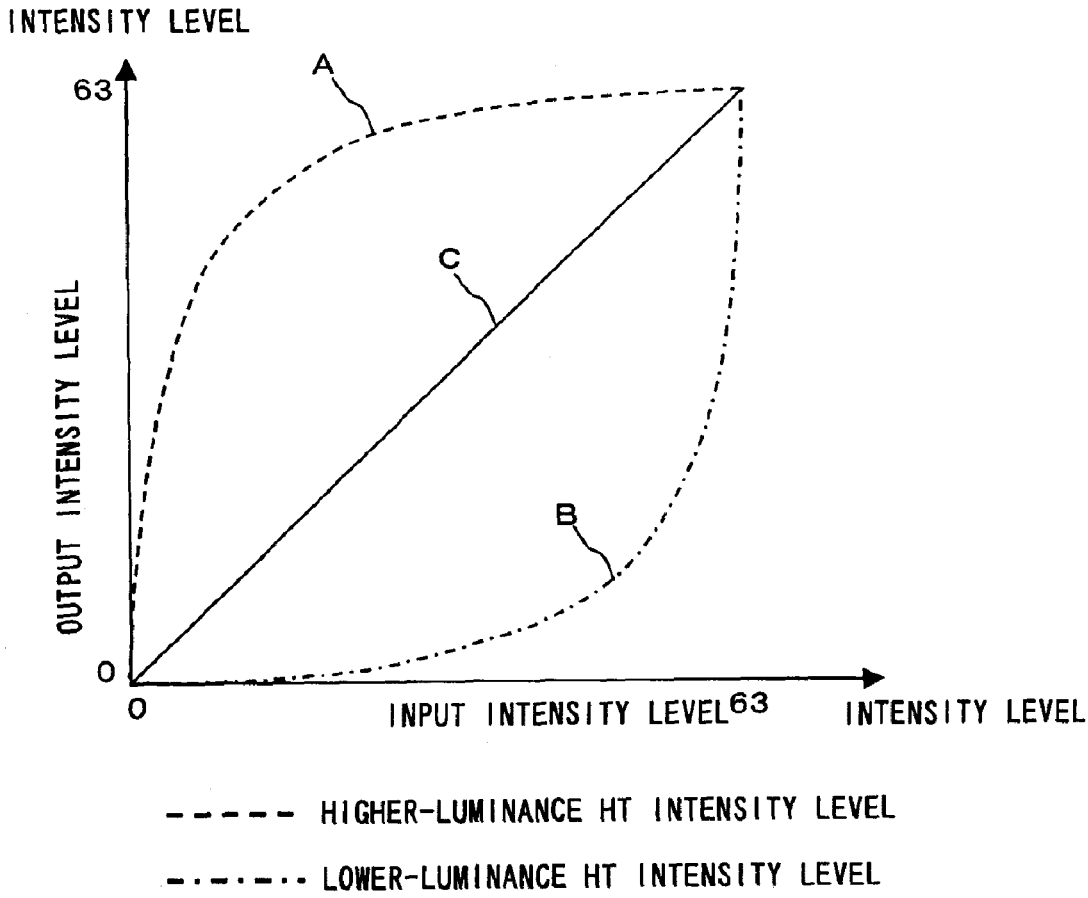
FIG. 48 is a figure explaining a concept of coefficient of a tone-level conversion table or approximate expression stored in an HT operating section 229 according to example 1 of the fifth embodiment of the invention.

Example 5-1 of the present embodiment is explained by using FIGS. 47 and 48. The HT mask generating section 228 of the ASIC 226 shown in FIG. 47 is previously stored with a plurality of kinds of HT mask patterns to be selected depending upon a select signal from the image determining section 227. Meanwhile, the HT operating section 229 is stored with a plurality of tone-level conversion tables in a lock-up table form to select a higher-luminance HT driving level and a lower-luminance HT driving level. Otherwise, in place of the conversion tables, stored are a plurality of approximate-expression coefficients for deriving, based on an approximate expression, a higher-luminance HT driving level and a lower-luminance HT driving level. The configuration like this switches over a combination of an HT mask pattern stored in the HT mask generating section 228 and a pattern of higher-luminance HT driving level and lower-luminance HT driving level stored in the HT operating section 229, depending upon a tone-level distribution of input video signal. Thus, optimal HT process is enabled.

FIG. 48 shows one example of a concept on the coefficient of a tone conversion table or approximate expression stored in the HT operating section 229. The graph shown in FIG. 48 has an abscissa representing an input tone level (exemplifying totally 64 tone levels) to be inputted from the system side to the image determining section 227. The ordinate represents an output tone level (exemplifying totally 64 tone levels) of a result of the operation by the HT operating section 229. Although FIG. 48 exemplifies an HT process having two divisional levels of higher-luminance HT driving level and lower-luminance HT driving level, it is of course possible to apply a multi-division levels having three or more of the higher-luminance to lower-luminance HT driving levels. The straight line C shown by the solid line in FIG. 48 is a conversion characteristic to be used when not carrying out an HT process, which has an intercept of 0 and a gradient of 1. The curve A shown by the broken line shows a conversion characteristic of a higher-luminance HT tone level, while the curve B shown by the one-dot chain line shows a conversion characteristic of a lower-luminance HT tone level. For a certain input tone level, two tone levels of higher-luminance and lower luminance HT driving levels are obtained on the basis of the curves A and B, as shown in FIG. 48. Incidentally, the curves A and B are different in form depending upon a ratio (area ratio) of the number of pixels for conversion into an higher-luminance HT driving level and the number of pixels for conversion into an lower-luminance HT driving level. By using the image display method of this example, high-quality display characteristics can be obtained regardless of a display image.

EXAMPLE 5-2

Figure 49A:
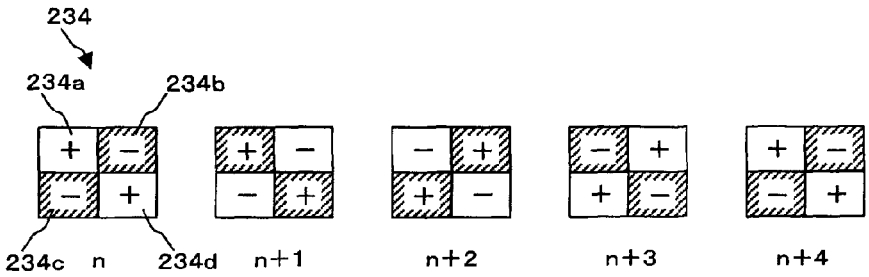
FIGS. 49A and 49B are figures showing HT-driving HT mask pattern and an optical response characteristic of a liquid crystal of a liquid-crystal panel 233 according to example 2 of the fifth embodiment of the invention.

Now example 5-2 of the present embodiment is explained by using FIG. 49, while referring to FIG. 47. FIG. 49 shows an HT mask pattern in the HT driving according to the present example and an optical response characteristic of liquid crystal of the liquid-crystal panel 233. FIG. 49A shows an HT mask pattern changing frame by frame. As shown in FIG. 49A, the HT mask pattern, in a 2×2 matrix form arrangement, is configured by a four-pixel group 234 assuming the same luminance level at the diagonal elements. The number of HT divisions is two, having an area ratio 1:1 of higher-luminance HT driving level and lower-luminance HT driving level.

The HT mask pattern in n-th frame has a higher-luminance HT drive level at the upper left pixel 234*a* and the diagonal (lower right) pixel 234*d*, and a lower-luminance HT drive level at the upper right pixel 234*b* and the diagonal (lower left) pixel 234*c*. The HT mask pattern in (n+1)-th frame has a lower-luminance HT drive level at the upper left pixel 234*a* and the diagonal (lower right) pixel 234*d*, and a higher-luminance HT drive level at the upper right pixel 234*b* and the diagonal (lower left) pixel 234*c*, conversely to the HT mask pattern in n-th frame. In the following, the HT mask pattern in n-th frame and the HT mask pattern in (n+1)-th frame are used alternately, in the similar way. Incidentally, the "+" (plus) indicated in the pixel region of the HT mask pattern in FIG. 49A means that the liquid crystal on the relevant pixel is to be driven on positive polarity while the "−" (minus) means that the liquid crystal on the relevant pixel is to be driven on reverse polarity. This is true for the designation ± in the HT mask pattern shown in the subsequent figure.

Figure 49B:
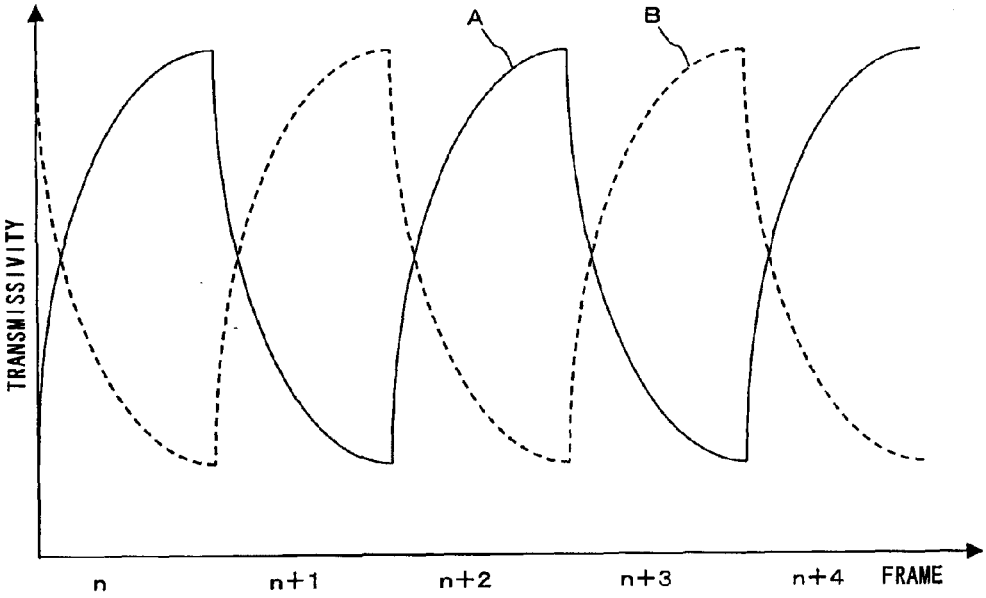

FIG. 49B shows an optical response characteristic of the liquid-crystal panel 233 in the HT processing of this example. The abscissa represents an order of a frame of from left to right while the ordinate represents a transmissivity of liquid crystal. The curve A shown by the solid line in the figure represents an optical response characteristic of the liquid crystal on the pixel 234*a*, 234*d*, the curve B shown by the broken line represents an optical response characteristic of the liquid crystal on the pixel 234*b*, 234*c*. The pixel 234*a*, 234*d* and the pixel 234*b*, 234*c* are HT-processed not only in space but also in time. The both are deviated in optical response by 1 frame. Consequently, when the screen entirety is viewed distantly, the higher-luminance part and the lower-luminance part that are displayed alternately by the curves A and B are offset with each other, making possible to reduce the low-frequency component in optical response. Accordingly, high quality display characteristics sufficiently reduced in flicker can be obtained provided that the image is not such a particular one as checkerwise pattern. Incidentally, on one pixel, the repetition period of higher-luminance and lower-luminance characteristics must not be 1:1 but is arbitrary. For example, the higher-luminance characteristic and the lower-luminance characteristic may be set in 1:3 in display period ratio.

EXAMPLE 5-3

Figure 50A:
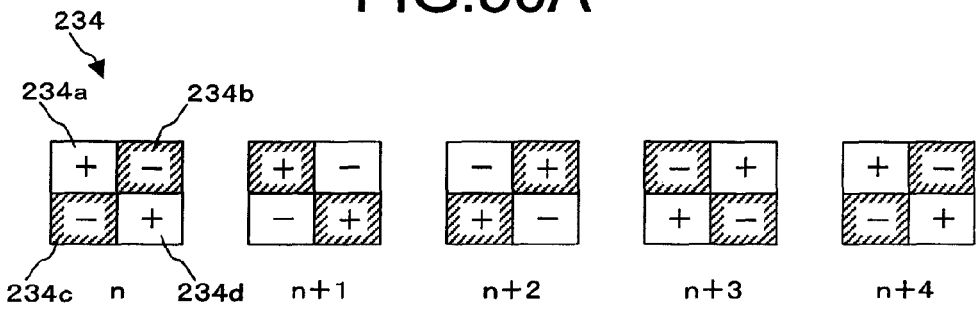
FIGS. 50A-50C are figures showing a relationship between an HT-driving HT mask pattern and a write polarity according to example 3 of the fifth embodiment of the invention.

Now example 5-3 of the present embodiment is explained by using FIG. 50. FIG. 50 shows a relationship between an HT mask pattern in HT driving according to this example and a polarity of during writing tone-level data to the pixel. FIG. 50A shows an HT mask pattern changing frame by frame, which is the same as the HT mask pattern shown in FIG. 49A. Considering this HT mask pattern from the point of data writing polarity, in n-th frame, the pixels 234*a* and 234*d* at the higher-luminance HT drive level have a data writing polarity "+" while the pixels 234*b* and 234*c* at the lower-luminance HT drive level have a data writing polarity "−". Similarly, in another frame, the pixels at the higher-luminance HT drive level are driven on the same polarity while the pixels at the lower-luminance HT drive level are driven on the same polarity reverse to the pixels at the higher-luminance HT drive level. In this manner, the HT mask pattern and polarity changing method shown in FIG. 50A causes a deviation of drive polarity in respect of higher-luminance HT drive level and lower-luminance HT drive level. Thus, flicker is ready to occur.

Figure 50B:
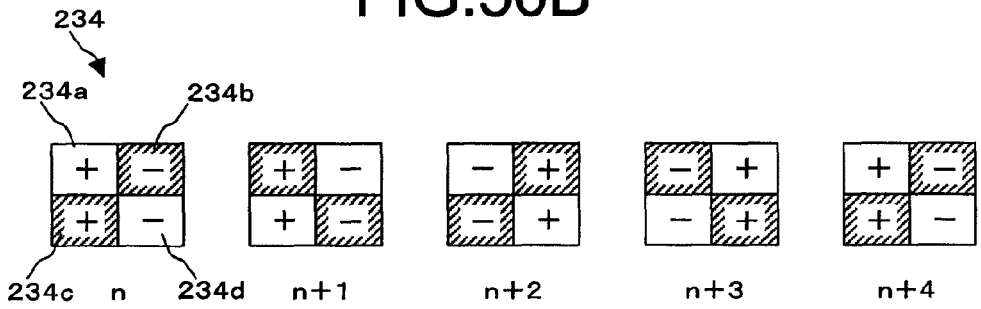
Figure 50C:
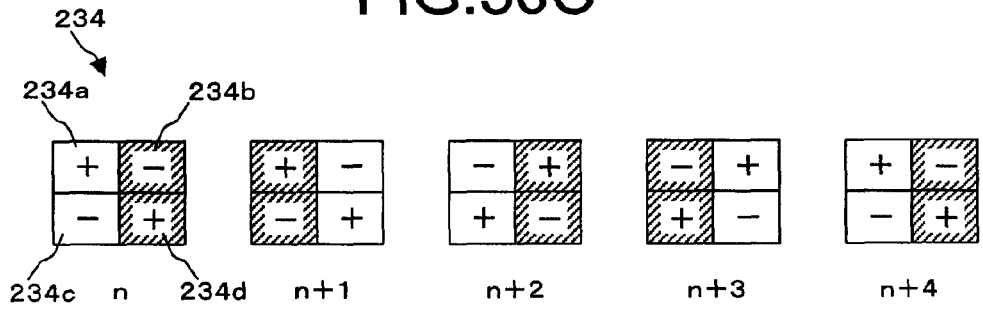

Therefore, the HT mask pattern and drive polarity is controlled to provide the frame with a drive polarity even in distribution of higher-luminance and lower-luminance HT drive levels within the frame, as shown in FIGS. 50B and 50C. The configuration shown in FIG. 50B is characterized in that, although the HT mask pattern is similar to that shown in FIG. 50A, drive polarity is changed from HV (horizontal-vertical) reverse drive to V (vertical) reverse drive or 2nHV reverse drive (n is an integer). Due to this, in n-th frame, the pixels 234*a* and 234*d* at higher-luminance HT drive level have both data writing polarities "+" and "−" in existence while the pixels 234*b* and 234*c* at lower-luminance HT drive level also have both data writing polarities "+" and "−" in existence. Similarly, in another frame, the pixels at higher-luminance HT drive level are driven on different polarities while the pixels at lower-luminance HT drive level are also driven on different polarities. In this manner, according to this example, the combination of HT mask pattern and drive polarity in the frame is entirely different between the pixels of the four-pixel group 234. Incidentally, this example carries out a V reverse drive every 2 frames. In case the liquid-crystal panel 233 is driven by this method, when the screen entirety is viewed distantly, the higher-luminance part and the lower-luminance part are offset with each other, making possible to reduce the low-frequency component in optical response. Furthermore, high quality display characteristics sufficiently reduced in flicker can be obtained even in such a particular image as checkerwise pattern.

FIG. 50C shows another method for make even the distribution of HT mask pattern and drive polarity. The configuration shown in FIG. 50C, although similar to that shown in FIG. 50A, is characterized in that the HT mask pattern is changed.

In this example, the HT mask pattern in n-th frame is at higher-luminance HT drive level on the pixel 234*a* and the lower adjacent pixel 234*c* and at lower-luminance HT drive level on the pixel 234*b* and the lower adjacent pixel 234*d*. The HT mask pattern in the next (n+1)-th frame is at lower-luminance HT drive level on the pixels 234*a* and 234*c* and at higher-luminance HT drive level on the pixels 234*b* and 234*d*, conversely to the HT mask pattern in the n-th frame. In the following, the HT mask pattern in n-th frame and the HT mask pattern in (n+1)-th frame are alternately used in the similar manner.

Due to this, in n-th frame, the pixels 234*a* and 234*d* at higher-luminance HT drive level have both data writing polarities "+" and "−" in existence while the pixels 234*b* and 234*c* at lower-luminance HT drive level also have both data writing polarities "+" and "−" in existence. Similarly, in another frame, the pixels at higher-luminance HT drive level are driven on different polarities while the pixels at lower-luminance HT drive level are also driven on different polarities. In this manner, according to this example, the combination of HT mask pattern and drive polarity in the frame is entirely different between the pixels of the four-pixel group 234. The distribution of HT mask pattern and drive polarity can be provided even. In this manner, by changing the HT mask pattern without changing drive polarity, the distribution of HT mask pattern and drive polarity can be provided even. This method can obtain a display characteristic improvement, similarly to the above.

EXAMPLE 5-4

Now example 5-4 of the present embodiment is explained by using FIG. 51. FIG. 51 shows an image pattern according to this example, an HT mask pattern in HT driving and an optical response characteristic of the liquid-crystal panel 233. FIG. 51A shows an image pattern not HT-processed, which is in a checkerwise pattern having a predetermined neutral tone display and a black display. For example, the pixels 234*a*, 234*d* are in a neutral tone display while the pixels 234*b*, 234*c* are in black display. FIG. 51B shows a state the HT mask pattern of FIG. 50A is applied to the relevant image pattern. As shown in FIG. 51B, the pixels 234*a* and 234*d* in the neutral tone are both deviated toward one of higher-luminance HT drive level and lower-luminance HT drive level. As a result, the liquid crystal on the pixel 234*a*, 234*d* shown in FIG. 51D has an optical response characteristic deviated toward any one of the curve A shown by the solid line and the curve B shown by the broken line, causing the possibility to visually perceive flicker.

Figure 51A:
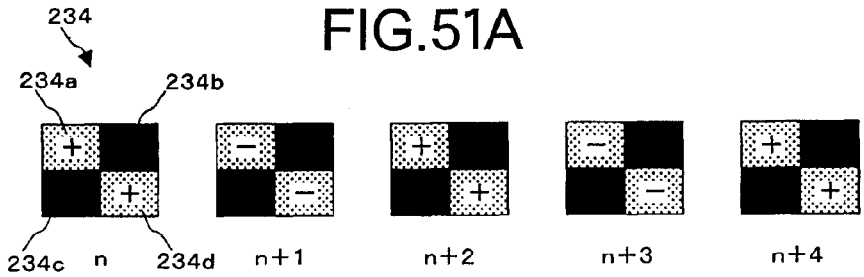
FIGS. 51A-51D are figures showing an image pattern, HT-driving HT mask pattern and an optical response characteristic of a liquid crystal of a liquid-crystal panel 233 according to example 4 of the fifth embodiment of the invention.
Figure 51B:
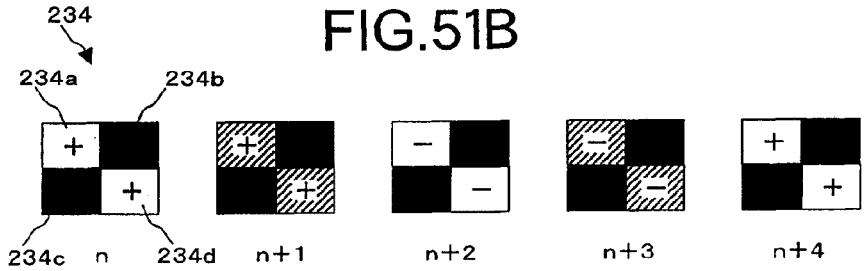
Figure 51C:
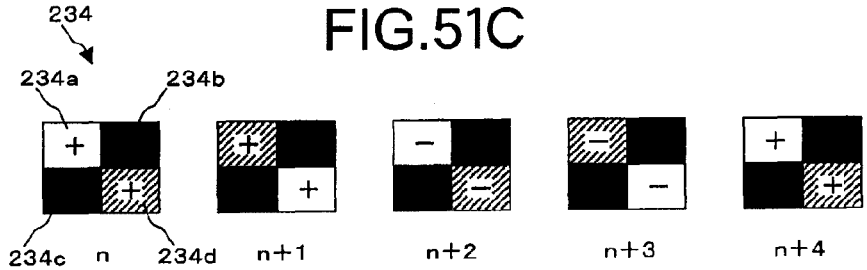
Figure 51D:
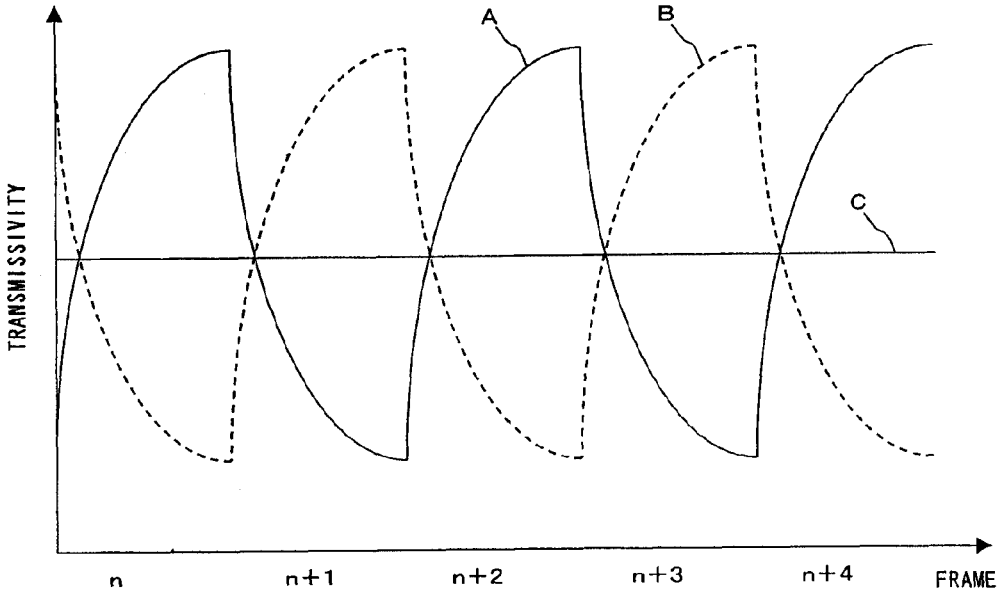

Therefore, this example is adapted for the image determining section 227 within the ASIC 226 to detect an HT mask unsuited pattern that, if making an HT processing as shown in FIG. 51B, luminance difference increases between the frames. From a plurality of HT mask patterns stored in the HT mask generating section 228, selected is an HT mask pattern for reducing the luminance difference between the frames, thereby carrying out an HT processing. FIG. 51C shows a 4-pixel group 234 HT-processed so as to reduce the luminance difference between the frames. As shown in FIG. 51C, with the HT mask pattern in n-th frame, the pixel 234*a* is made in higher-luminance HT drive level while the pixel 234*d* is made in lower-luminance HT drive level. In this case, the optical response characteristic of the pixel 234*a* is given as the curve A in FIG. 51D while that of the pixel 234*a* is given as the curve B in FIG. 51D. Consequently, when the screen entirety is viewed distantly, the higher-luminance part and the lower-luminance part that are displayed alternately by the curves A and B are offset with each other, thus reducing the low-frequency component in optical response. Meanwhile, in (n+1)-th frame, the pixel 234*a* is in lower-luminance HT drive level while the pixel 234*d* is in higher-luminance HT drive level, obtaining the similar effect to the n-th frame. In the following, the HT mask pattern in n-th frame and the HT mask pattern in (n+1)-th frame are used alternately in the similar way, thereby obtaining a high quality display characteristic that HT-processing is made in space and in time and flicker is to be fully reduced.

Incidentally, it is possible to discriminate an optical response characteristic deviation within the frame caused by the relationship between the higher-luminance HT drive level and lower-luminance HT drive level and the drive polarity and to make an HT processing such as HT mask pattern change, on a block-by-block basis of a plurality of pixels or in an arbitrary region of an image. Meanwhile, although the HT mask unsuited pattern is inherently exists on each HT mask pattern. However, in case a plurality of HT mask is previously prepared to change the HT mask pattern on each input video signal, flicker can be prevented from occurring in almost all the image patterns.

EXAMPLE 5-5

Now example 5-5 of the present embodiment is explained. This example is characterized in that, for a still image, a frame buffer is used to provide driving with a raised frame frequency in order to prevent flicker and bright line movement (moving phenomenon) due to HT mask pattern from being visually perceived by HT processing. Otherwise, driving may be made without making an HT processing to an input video signal. Meanwhile, on a moving image, unless the input video signal is integer times the frame frequency, the image is to be perceived discontinuous. Accordingly, HT processing is made at integer times the frame frequency. The mode change between a still image and a moving image maybe controlled by an image recognition circuit provided in the ASIC 226 or, of course, by an external switch signal. In this manner, driving with a raised frame frequency reduces the poor display due to flicker and moving phenomenon, obtaining high quality display characteristics.

EXAMPLE 5-6

Now example 5-6 of the present embodiment is explained. This example is characterized in that HT processing is carried out based on each pixel of R (red), G (green) and B (blue) or based on collective three pixels. The tone level is recognized in its magnitude relationship or variation, based on each of RGB of the display image, thereby carrying out an HT processing suitably to the combination of the tone levels based on collective RGB or each of RGB. Otherwise, concerning the image signal in a predetermined area including a contour-extracted region, histograms are acquired based on each of RGB, to carry out different HT processes based on collective RGB or each of RGB, according to a distribution of the histograms. In this manner, by carrying out HT processes based on each of RGB, it is possible to obtain high quality display characteristics excellent in color reproducibility.

EXAMPLE 5-7

Figure 52:
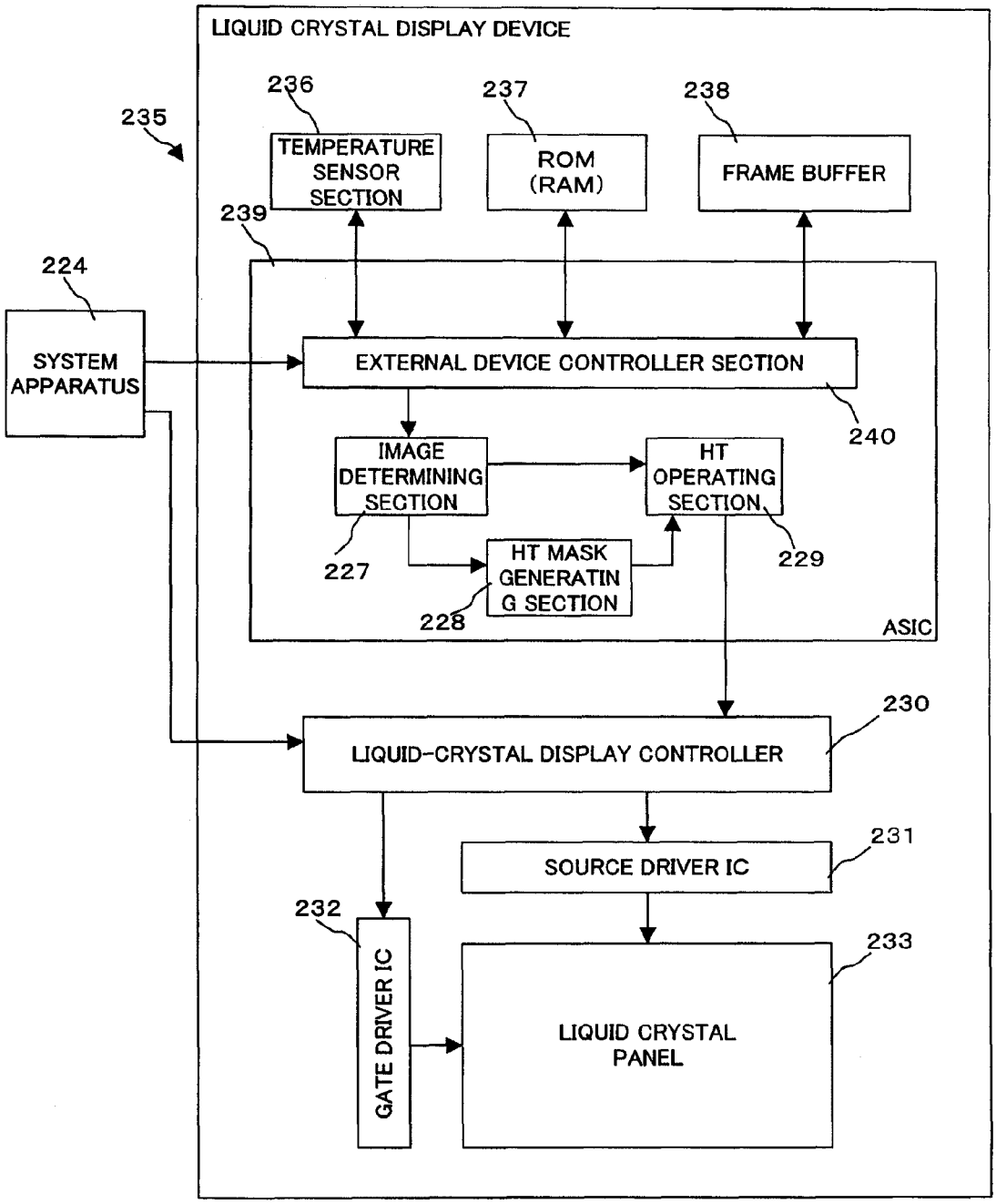
FIG. 52 is a functional block diagram of a liquid-crystal display device 235 according to example 7 of the fifth embodiment of the invention.

Now example 5-7 of the present embodiment is explained by using FIG. 52. This example is characterized in that HT processing is carried out suited in a use environment. The liquid-crystal display device 235 of this example has a temperature sensor section 236, an ROM (or RAM) 237 and a frame buffer 238, further on the liquid-crystal display device 223. The ROM 237 is stored with a tone-level conversion table, a tone-level conversion approximate expression coefficient and an HT mask pattern. Furthermore, the ASIC 239 provided on the liquid-crystal display device 235 has further an external device controller section 240 for control of the ROM 237 and the like, differently from the ASIC 226. Based on the temperature information detected by the temperature sensor section 236, an HT-processing parameter optimal for the relevant temperature is readout of the ROM 237, thereby carrying out an HT processing. The present driving method can obtain high quality display characteristics regardless of a use environment because of the capability to change the HT processing according to a characteristic change of the liquid-crystal panel 233 and the like due to a use environment.

EXAMPLE 5-8

Figure 53A:
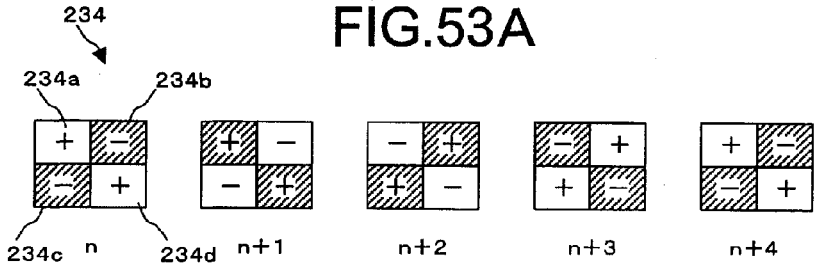
FIGS. 53A and 53B are figures showing HT-driving HT mask pattern and an optical response characteristic of a liquid crystal of a liquid-crystal panel 233 according to example 8 of the fifth embodiment of the invention.
Figure 53B:
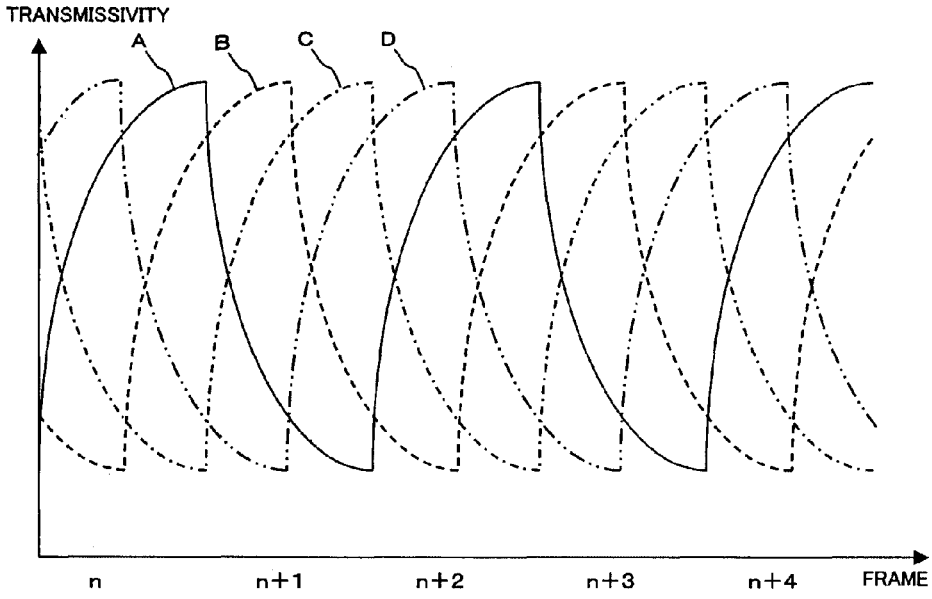

Now example 5-8 of the present embodiment is explained by using FIG. 53. FIG. 53 shows an HT mask pattern in HT driving and an optical response characteristic of the liquid-crystal panel 233. In the figure, the curve A shown by the solid line represents an optical response characteristic of the pixel 234*a*, the curve B shown by the broken line represents an optical response characteristic of the pixel 234*b*, the curve C shown by the one-dot chain line represents an optical response characteristic of the pixel 234*c*, and the curve D shown by the two-dot chain line represents an optical response characteristic of the pixel 234*d*. As shown in FIG. 53, an image signal is stored in the frame buffer such that the pixels adjacent within the frame are different in optical response characteristic, thereby write the video signal to the liquid-crystal display panel 233. At this time, the not-shown gate bus line of the liquid-crystal panel 233 is driven with the same frame period by scanning with interlacing at least 1 line. The interlaced scanning may be in a regular fashion or may be, of course, in an irregular fashion. Incidentally, in the driving, used is the liquid-crystal display device shown in FIG. 52.

By increasing the frame frequency to ×n-speed, it is possible to reduce the image deterioration in time due to HT processing.

EXAMPLE 5-9

Now example 5-9 of the present embodiment is explained. This example is characterized in that, where HT processing is carried out with two levels of higher-luminance HT drive level and lower-luminance HT drive level, the input video signal is discriminated in tone level to make an HT drive only at higher-luminance HT drive level when the number of image signals in existence having a predetermined tone level exceeds an area ratio of HT processing, and make an HT drive only at lower-luminance HT drive level when the number of image signals in existence having a predetermined tone level does not exceed an area ratio of HT processing. For example, in case a screen bright as a whole is processed with an HT mask pattern having an area ratio of higher-luminance HT drive level and lower-luminance HT drive level shown in FIG. 49A of 1:1, the pixels converted close to higher luminance become conspicuous. In this case, when the screen entirety is viewed distantly, the low frequency component of optical response is left, resulting in a possibility to cause flicker. Therefore, in case the relevant screen is discriminated in tone level to thereby make a processing only at lower-luminance HT drive level, the pixels high in luminance when HT processing has not been made are suppressed in luminance, hence making them not conspicuous. Accordingly, when the screen entirety is viewed distantly, the low frequency component of optical response is reduced, obtaining high quality display characteristics fully reduced in flicker.

EXAMPLE 5-10

Figure 54A:
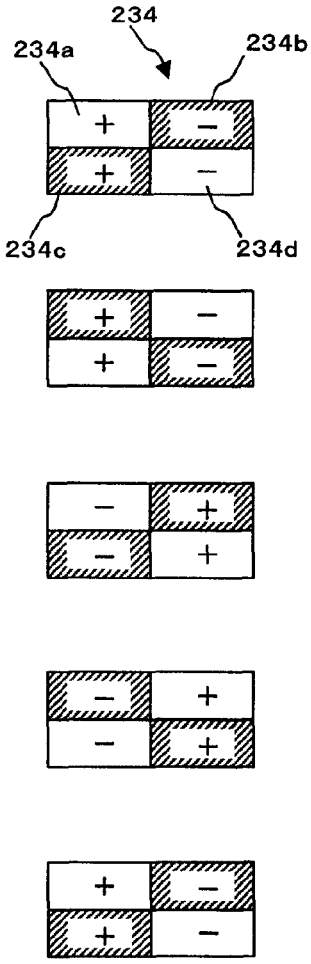
FIGS. 54A and 54B are figures showing an HT mask pattern according to example 10 of the fifth embodiment of the invention.
Figure 54B:
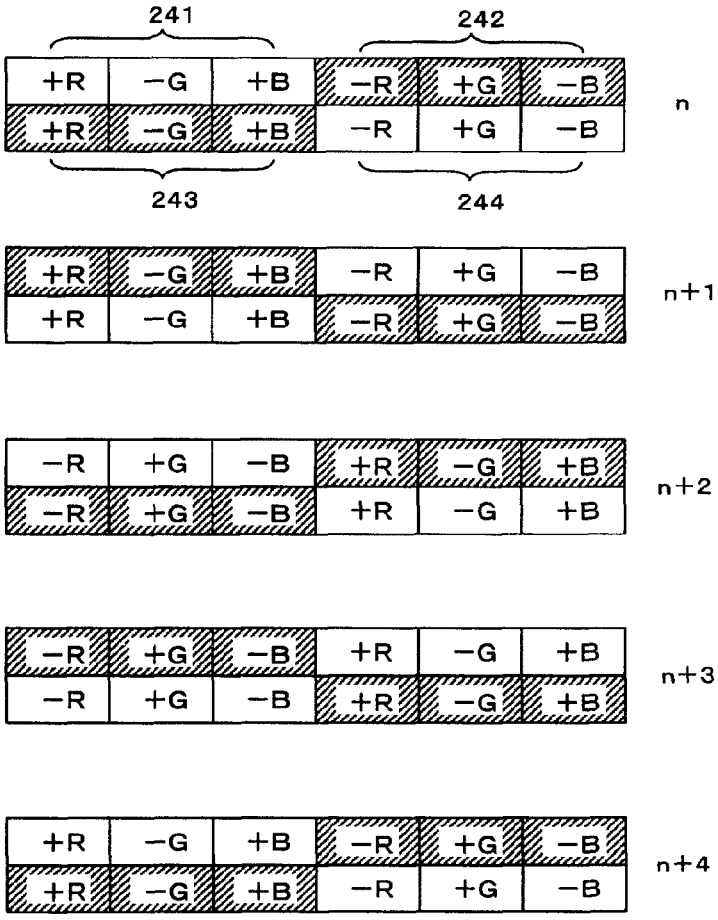

Now example 5-10 of the present embodiment is explained by using FIG. 54. FIG. 54 shows an HT mask pattern of this example. FIG. 54A shows a basic form of HT mask pattern, which is similar to the HT mask pattern shown in FIG. 50B. FIG. 54B shows an HT mask pattern of this example. As shown in FIG. 54B, this example carries out an HT processing by taking R, G and B three pixels as one pixel unit and aligning the phase of each of RGB pixels.

In n-th frame, the RGB pixel 241, 244 is in higher-luminance HT drive level while the RGB pixel 242, 243 is in lower-luminance HT drive level. In the HT mask pattern of the next (n+1)-th frame, the RGB pixel 241, 244 is in lower-luminance HT drive level while the RGB pixel 242, 243 is in higher-luminance HT drive level, conversely to the HT mask pattern of the n-th frame. In the following, the HT mask pattern of n-th frame and the HT mask pattern of (n+1)-th frame are alternately used, in a similar manner. Incidentally, relative to the basic form of HT mask pattern of FIG. 54A, in the HT mask pattern of this example, the RGB pixel 241 corresponds to the pixel 234*a*, the RGB pixel 242 corresponds to the pixel 234*b*, the RGB pixel 243 corresponds to the pixel 234*c* and the RGB pixel 244 corresponds to the pixel 234*d*.

Incidentally, the RGB pixel 241, 242, 243 and 244 has a drive polarity inverted based on color. In n-th frame and (n+1)-th frame, the RGB pixel 241 is to be driven, in order, as positive polarity, negative polarity and positive polarity, wherein the polarity is inverted at between the RGB pixels adjacent light-left. Also, the RGB pixels 241 and 243 vertically arranged and the RGB pixels 242 and 244 vertically arranged are to be driven on the same polarity, wherein the polarity inversion is V-inversion driving. In this manner, this example also can carry out an HT processing in space and in time, obtaining high quality display characteristic fully reduced in flicker.

EXAMPLE 5-11

Figure 55A:
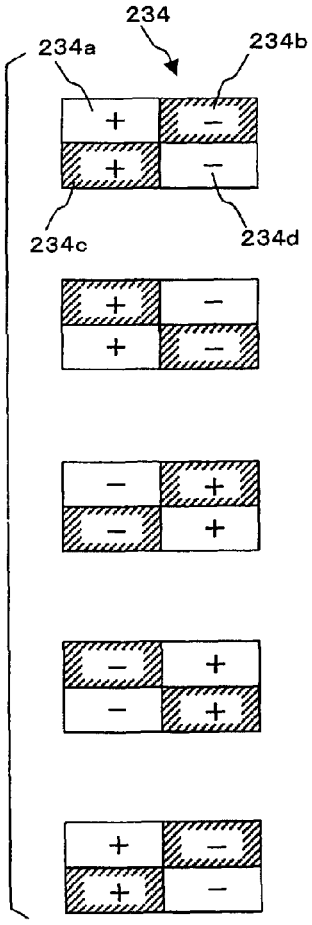
FIGS. 55A and 55B are figures showing an HT mask pattern according to example 11 of the fifth embodiment of the invention.
Figure 55B:
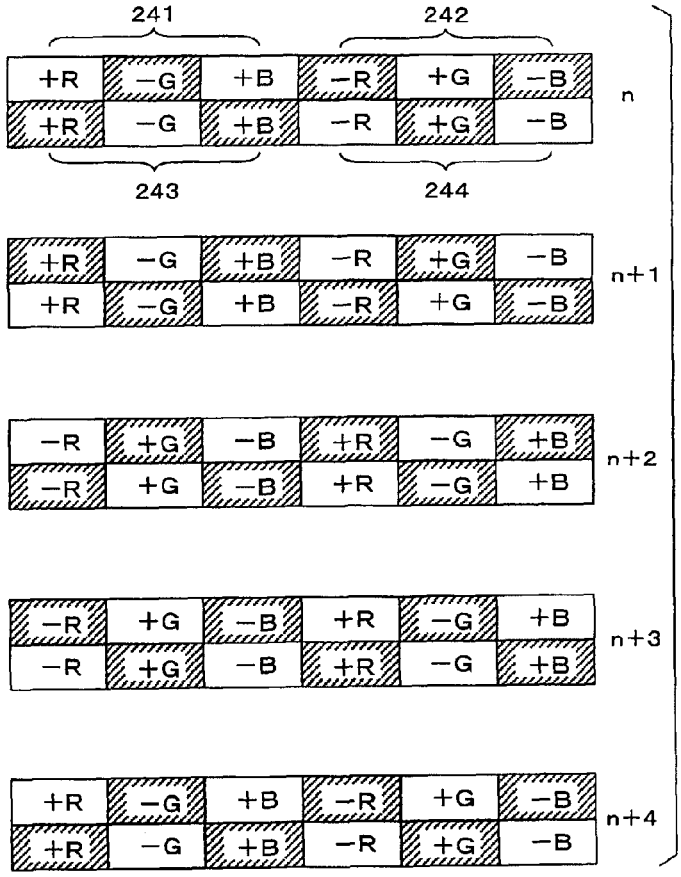

Now example 5-11 of the present embodiment is explained by using FIG. 55. FIG. 55 shows an HT mask pattern of this example. FIG. 55A shows a basic form of HT mask pattern, which is similar to the HT mask pattern shown in FIG. 50B. FIG. 55B shows an HT mask pattern of this example. As shown in FIG. 55B, this example carries out an HT processing with the R pixel and the B pixel in phase with each other, and with the G pixel out of phase with the R pixel and B pixel.

In n-th frame, the RGB pixel 241, 244, at its R and B pixels, is in higher-luminance HT drive level while at its G pixel, is in lower-luminance HT drive level. Meanwhile, the RGB pixel 242, 243, at its Rand B pixels, is in lower-luminance HT drive level while at its G pixel, is in higher-luminance HT drive level. In the HT mask pattern of the next (n+1)-th frame, the RGB pixel 241, 244 at its R and B pixels is in lower-luminance HT drive level while its G pixel is in higher-luminance HT drive level, conversely to the HT mask pattern of the n-th frame. Meanwhile, the RGB pixel 242, 243 at its R and B pixels is in higher-luminance HT drive level while its G pixel is in lower-luminance HT drive level. In the following, the HT mask pattern of n-th frame and the HT mask pattern of (n+1)-th frame are alternately used, in a similar manner.

Incidentally, because the HT mask pattern of this example corresponds, on an RGB pixel basis, to the basic form of HT mask pattern of FIG. 55A, the RGB pixel 241, 242, 243 and 244 contains three of basic form. The R pixel of RGB pixel 241 corresponds to the pixel 234*a*, the G pixel of RGB pixel 241 corresponds to the pixel 234*b*, the G pixel of RGB pixel 244 corresponds to the pixel 234*d* and the R pixel of RGB pixel 244 corresponds to the pixel 234*c*. Furthermore, the B pixel of RGB pixel 241 corresponds to the pixel 234*a*, the R pixel of RGB pixel 242 corresponds to the pixel 234*b*, the R pixel of RGB pixel 243 corresponds to the pixel 234*d* and the B pixel of RGB pixel 242 corresponds to the pixel 234*c*. Furthermore, the G pixel of RGB pixel 242 corresponds to the pixel 234*a*, the B pixel of RGB pixel 242 corresponds to the pixel 234*b*, the B pixel of RGB pixel 243 corresponds to the pixel 234*d* and the G pixel of RGB pixel 243 corresponds to the pixel 234*c*.

Incidentally, the RGB pixel 241, 242, 243 and 244 has a drive polarity inverted based on color. In n-th frame and (n+1)-th frame, the RGB pixel 241 is to be driven, in order, as positive polarity, negative polarity and positive polarity, wherein the polarity is inverted at between the RGB pixels adjacent light-left. Also, the RGB pixels 241 and 244 vertically arranged and the RGB pixels 242 and 243 vertically arranged are to be driven on the same polarity, wherein the polarity inversion is V-inversion driving. In this manner, this example also can carry out an HT processing in space and in time, obtaining high quality display characteristic fully reduced in flicker. Furthermore, because HT processing is possible based on each of RGB colors, obtained is high quality display characteristic high in color reproducibility.

EXAMPLE 5-12

Figure 56A:
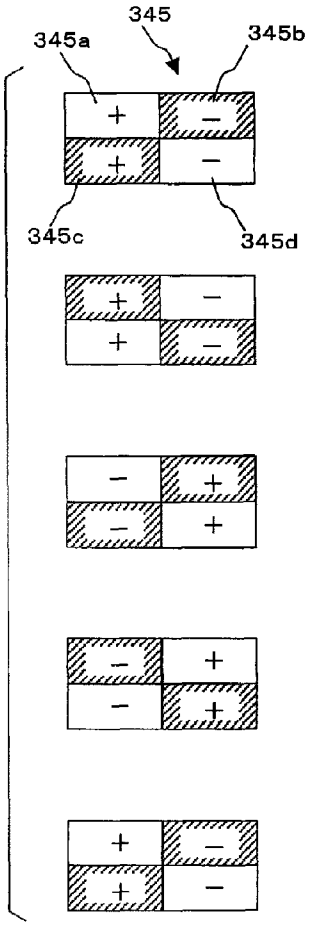
FIGS. 56A-56C are figures showing a basic form of HT mask pattern for each pixel of RGB and RGB-pixel HT mask pattern upon applying the basic-formed HT mask pattern according to example 12 of the fifth embodiment of the invention.
Figure 56B:
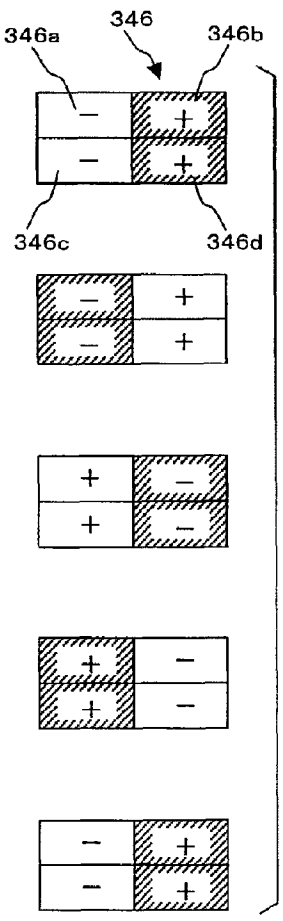

Now example 5-12 of the present embodiment is explained by using FIG. 56. This example is characterized in that an HT mask pattern is previously provided based on each of RGB pixels. In the below, explanation is on the assumption that there are provided an HT mask pattern for R and B pixel and an HT mask pattern for G pixel. FIG. 56 shows an HT mask pattern basic form for RGB pixels and an HT mask pattern for RGB pixels applied by the basic-formed HT mask pattern. FIG. 56A is a basic form of HT mask pattern to be used for R and B pixels, which is similar to the HT mask pattern shown in FIG. 50B. Meanwhile, pixel drive polarity is similar. FIG. 56B is an HT mask pattern basic form to be used for G pixel, which is similar to the HT mask pattern shown in FIG. 50C. However, pixel drive polarity is different, i.e., this example has a same drive polarity as FIG. 56A.

Figure 56C:
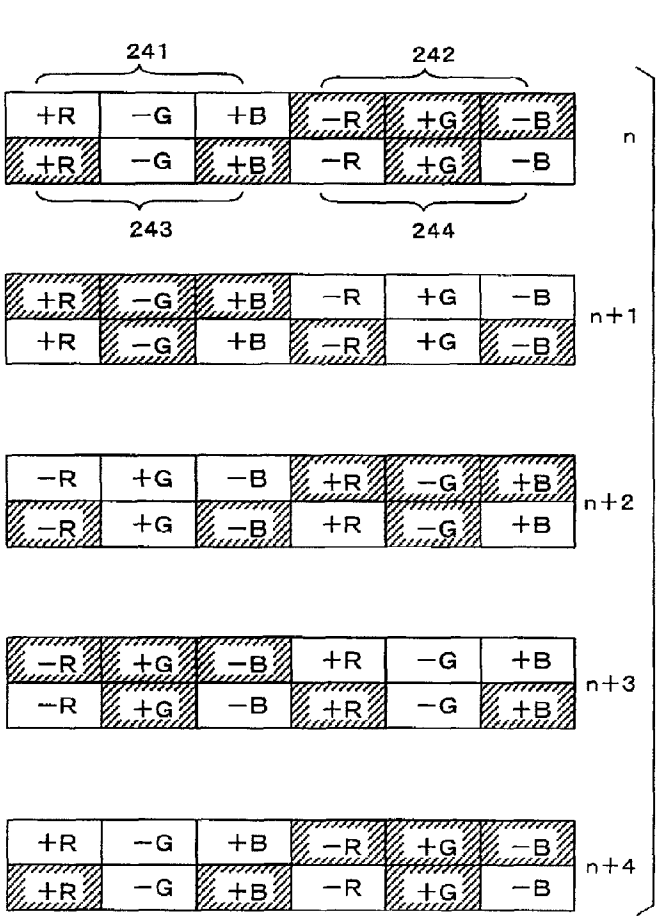

FIG. 56C shows an HT mask pattern for the RGB pixels 241, 242, 243 and 244, based on the relevant basic-formed HT mask pattern. The HT mask pattern of this example has a corresponding relation to the basic-formed HT mask pattern, as follows. Of the four-pixel group 345 in the basic-formed HT mask pattern for R and B pixels of FIG. 56A, the pixel 345*a* is corresponded to the R and B pixels of the RGB pixel 241, the pixel 345*b* is corresponded to the R and B pixels of the RGB pixel 242, the pixel 345*c* is corresponded to the R and B pixels of the RGB pixel 243 and the pixel 345*d* is corresponded to the R and B pixels of the RGB pixel 244. Also, of the four-pixel group 346 in the basic-formed HT mask pattern for G pixels of FIG. 56B, the pixel 346*a* is corresponded to the G pixel of the RGB pixel 241, the pixel 346*b* is corresponded to the G pixel of the RGB pixel 242, the pixel 346*c* is corresponded to the G pixel of the RGB pixel 243 and the pixel 346*d* is corresponded to the G pixel of the RGB pixel 244.

In n-th frame, each of the RGB pixel 241 is at higher-luminance HT drive level while each of the RGB pixel 242 is at lower-luminance HT drive level. Meanwhile, the R and B pixel of the RGB pixel 243 is at higher-luminance HT drive level while G pixel is at lower-luminance HT drive level. Furthermore, the R and B pixel of the RGB pixel 244 is at lower-luminance HT drive level while G pixel is at higher-luminance HT drive level. In the next (n+1)-th frame of the HT mask pattern, each of the RGB pixel 241 is at lower-luminance HT drive level while each of the RGB pixel 242 is at higher-luminance HT drive level, conversely to the n-th frame of the HT mask pattern. Meanwhile, the R and B pixel of the RGB pixel 243 is at lower-luminance HT drive level while G pixel is at higher-luminance HT drive level. Furthermore, the R and B pixel of the RGB pixel 244 is at higher-luminance HT drive level while G pixel is at lower-luminance HT drive level. In the following, the HT mask pattern in the n-th frame and the HT mask pattern in the (n+1)-th frame are alternately used in the similar manner.

Meanwhile, in the n-th frame and (n+1)-th frame, the RGB pixel 241, 244 has a positive drive polarity while the RGB pixel 242, 243 has a negative drive polarity. In the following, drive polarity inverts every two frame. In this manner, by providing a plurality of HT mask patterns and changing the combination of HT mask patterns, the HT mask pattern can be easily changed for the RGB pixels. Accordingly, even this example can fully reduce flicker and obtain high quality display characteristic because of the capability of HT-processing in space and in time.

Figure 57:
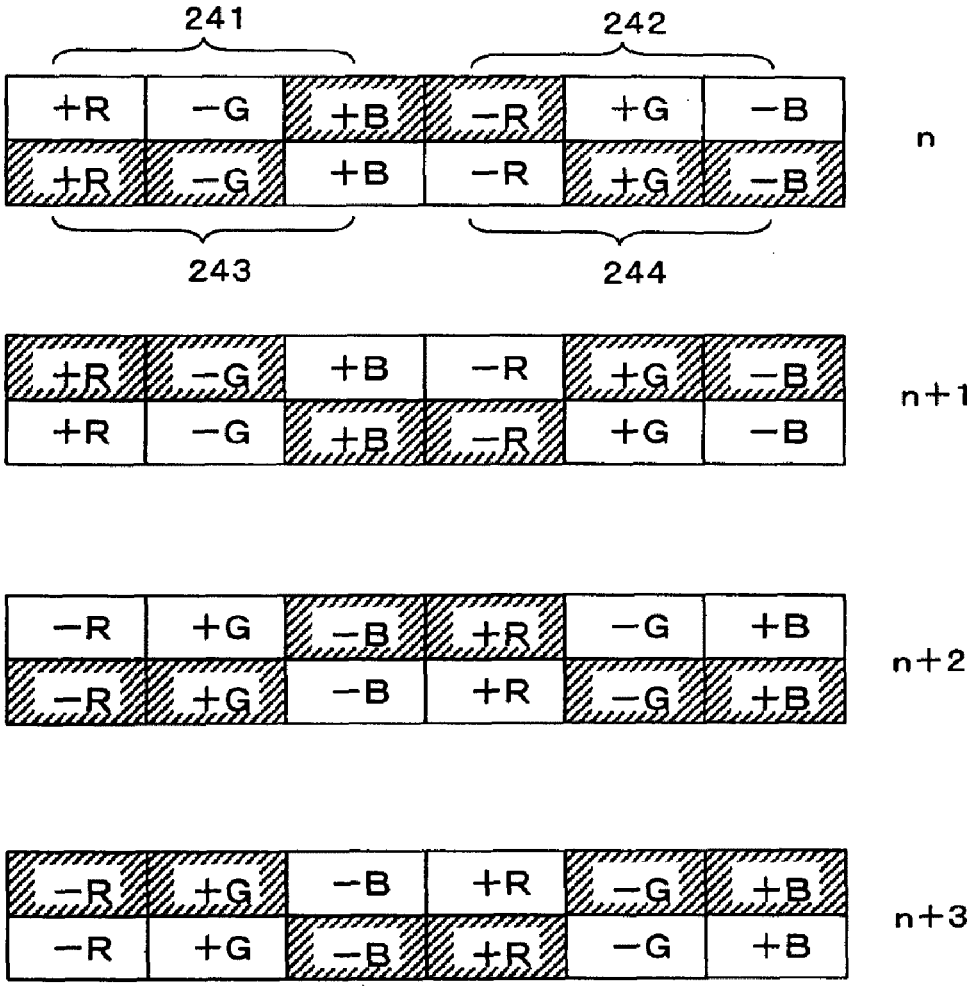
FIG. 57 is a figure showing an HT mask pattern according to example 12 of the fifth embodiment of the invention.

FIG. 57 shows another Ht mask pattern. In this HT mask pattern, higher-luminance HT drive level and lower-luminance HT drive level are repeated based on two of RGB pixels. For example, in n-th frame, R and G pixel of the RGB pixel 241 is at higher-luminance HT drive level, B pixel of the RGB pixel 241 and R pixel of the RGB pixel 242 is at lower-luminance HT drive level, and G and B pixel of the RGB pixel 242 is at higher-luminance HT drive level. Meanwhile, R and G pixel of the RGB pixel 244 is at lower-luminance HT drive level, B pixel of the RGB pixel 241 and R pixel of the RGB pixel 242 is at higher-luminance HT drive level, and G and B pixel of the RGB pixel 242 is at lower-luminance HT drive level. This driving aligns the drive level at the left and right adjacent pixels, enabling to suppress the deviation of polarity based on horizontal pixels. Thus, flicker can be fully reduced and high quality of display characteristics can be obtained. Incidentally, the HT patterns are previously stored in the HT mask generating section 228 as a functional block of the ASIC 226, 239.

EXAMPLE 5-13

Now example 5-13 of the present embodiment is explained. When carrying out HT processing on the same pixel, the state of liquid crystal changes at all times. This is because the term Ctot of field through voltage $\Delta V=\Delta Vg\times Cgs/Ctot$ changes at all times, which forms a factor making it difficult to optimize the common potential and remove the DC component. In order to avoid this, this example computes a conversion approximate expression or look-up table within the ASIC 226, 239 from the video signal relationship of around the HT processing. In case the output voltage of display video signal is sequentially shifted by using the conversion approximate expression or the like, the term Ctot can be suppressed from varying, hence making it possible to improve display quality.

EXAMPLE 5-14

Figure 58:
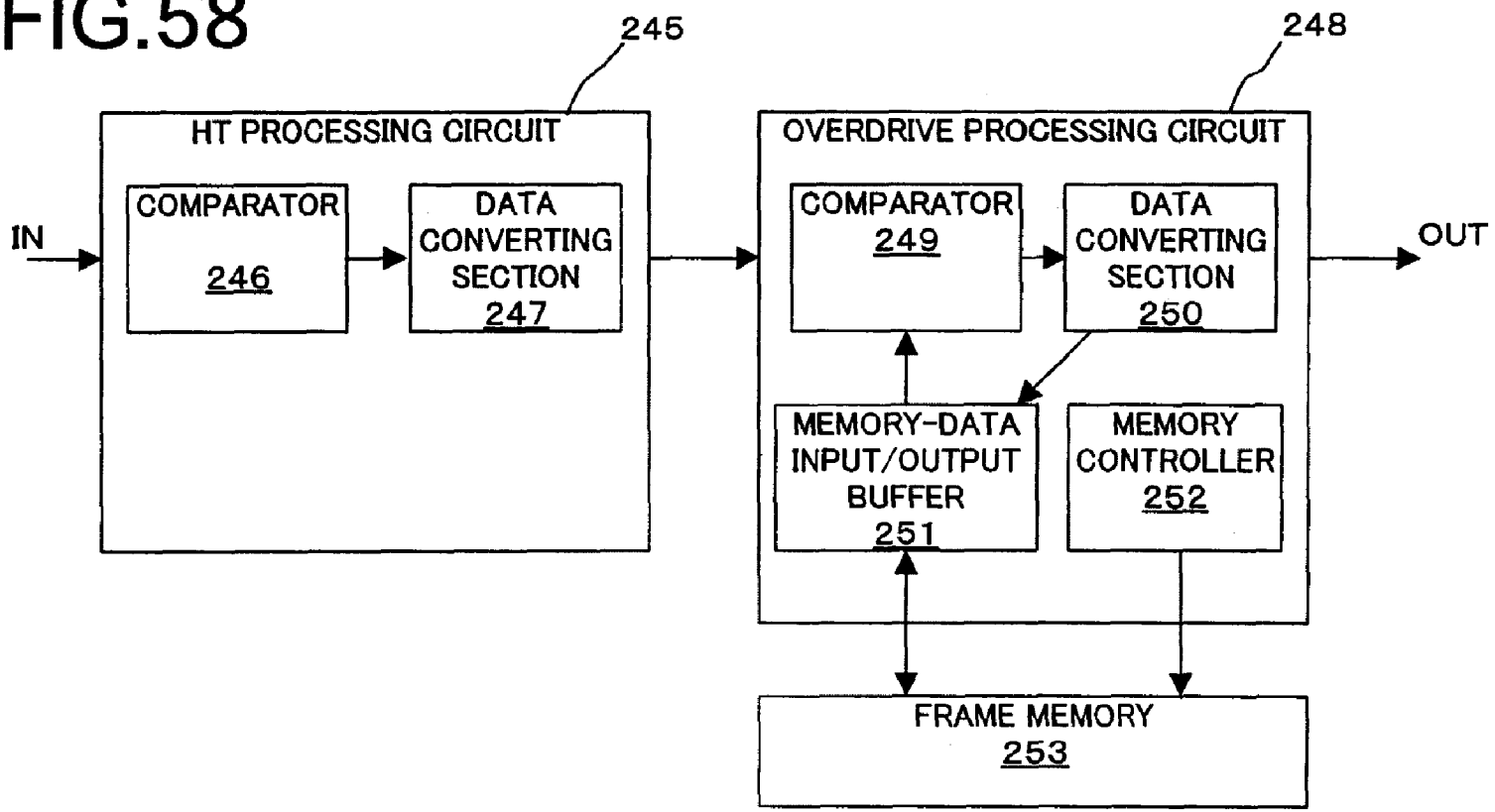
FIG. 58 is a block diagram of a first image conversion processing circuit according to example 14 of the fifth embodiment of the invention.

Now example 5-14 of the present embodiment is explained by using FIGS. 58 to 62. This example is characterized in that HT processing and response compensation based on overdrive processing are carried out simultaneously, to reduce the lower-frequency component in optical response. FIG. 58 shows a block diagram of a first image-conversion processing circuit in this example. The comparator 246 in an HT processing circuit 245 selects one tone conversion level (higher-luminance HT drive level and lower-luminance HT drive level) out of a plurality of tone conversion levels, depending upon an input video signal. A data converting section 247 carries out an HT processing, on the basis of the relevant tone conversion level and drive polarity. The video signal of after HT processing is outputted to an overdrive processing circuit 248, and inputted to a comparator of within the overdrive processing circuit 248.

In the meanwhile, the memory controller 252 within the overdrive processing circuit 248 reads out a 1-frame-preceding video signal from a frame memory 253. The 1-frame-preceding video signal read out of the frame memory 253 is inputted to a comparator 249 through a memory-data input/output buffer 251, and compared with the video signal outputted from the HT processing circuit 245. Depending upon a result of the comparison, the video signal of after HT processing outputted from the HT processing circuit 245, in the data converting section 247, is subjected to addition/subtraction at a resolution equivalent to or higher than that at the HT processing, and then outputted from the overdrive processing circuit. Incidentally, the resolution equivalent to or higher than that at the HT processing means that, if HT processing is done at 6 bits for example, the data converting section 247 carries out an addition/subtraction at 8 bits. Because the video signal outputted from the overdrive circuit 248 possesses both pieces of information about HT processing and overdrive processing, the liquid-crystal panel 233 if driven on the relevant video signal can display an image done with HT processing and response compensation based on overdrive processing at the same time.

Figure 59:
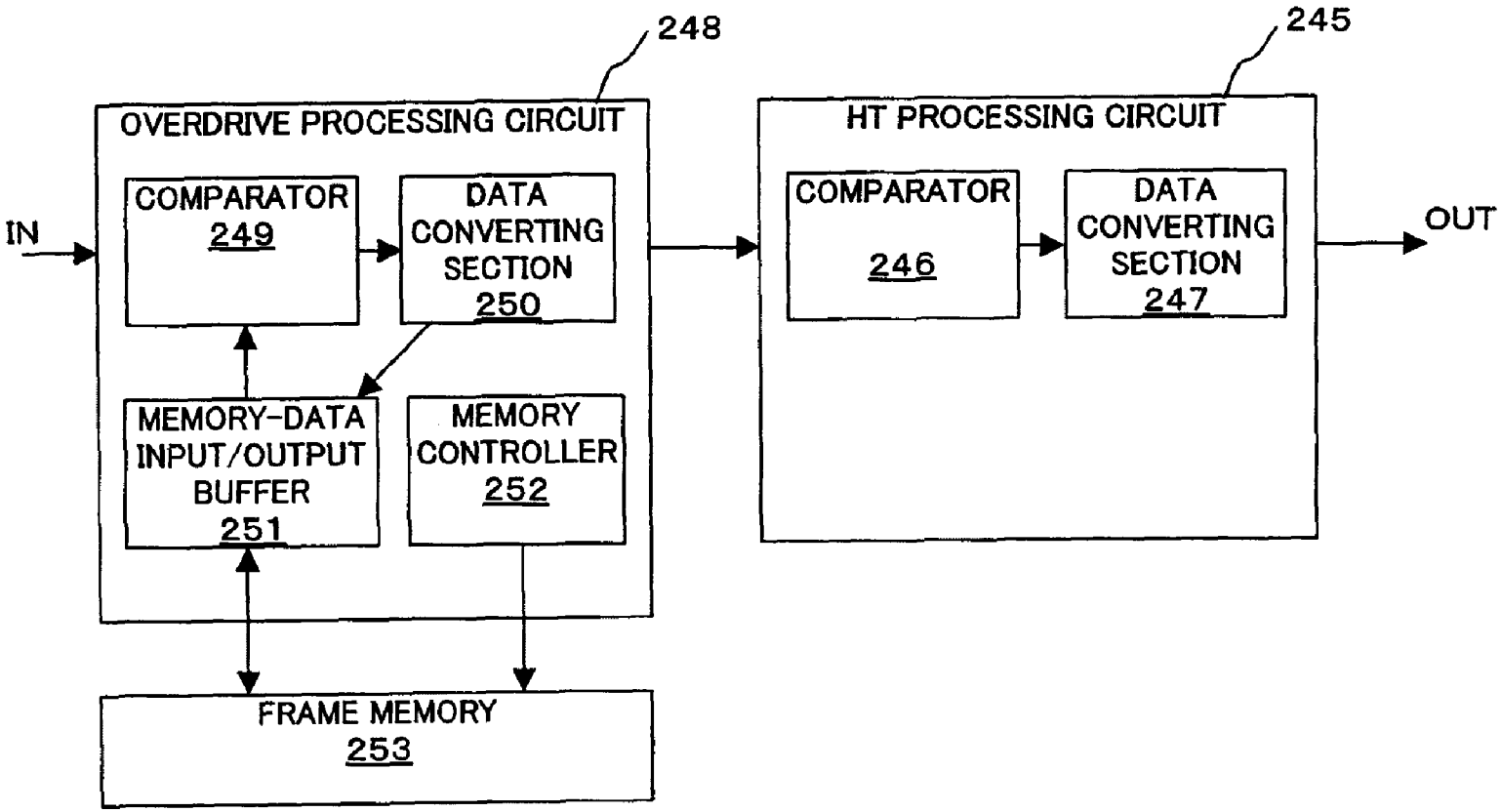
FIG. 59 is a block diagram of a second image conversion processing circuit according to example 14 of the fifth embodiment of the invention.

Now explained is a second image-conversion processing circuit in this example, by using FIG. 59. The second image-conversion processing circuit is characterized, relative to the first image conversion processing circuit, in that HT processing is carried out after making an overdrive processing to the first image-conversion processing circuit. Incidentally, the constituent elements offering the same functional operation to those of the first image-conversion processing circuit are attached with the same references. FIG. 59 shows a block diagram of the second image-conversion processing circuit. The memory controller 252 within the overdrive processing circuit 248 reads out a 1-frame-preceding video signal out of the frame memory 253. The 1-frame-preceding video signal, read out of the frame memory 253, is compared with the input video signal by the comparator 249. Depending upon a result of the comparison, the data converting section 250 makes an addition/subtraction and outputs the video signal made by addition/subtraction to the HT processing circuit 245.

The comparator 246 within the HT processing circuit 245 selects one tone conversion level comparatively low in luminance difference from a plurality of tone conversion levels depending upon the video signal outputted from the overdrive processing circuit 248. The data converting section 247 carries out an HT processing, on the basis of the relevant tone conversion level and drive polarity. In also the second image processing circuit, because the video signal outputted from the overdrive processing circuit 248 has both pieces of information of HT processing and overdrive processing, the liquid-crystal panel 233 if driven on the relevant video signal can display an image simultaneously processed by HT processing and response compensation based on overdrive processing.

Figure 60:
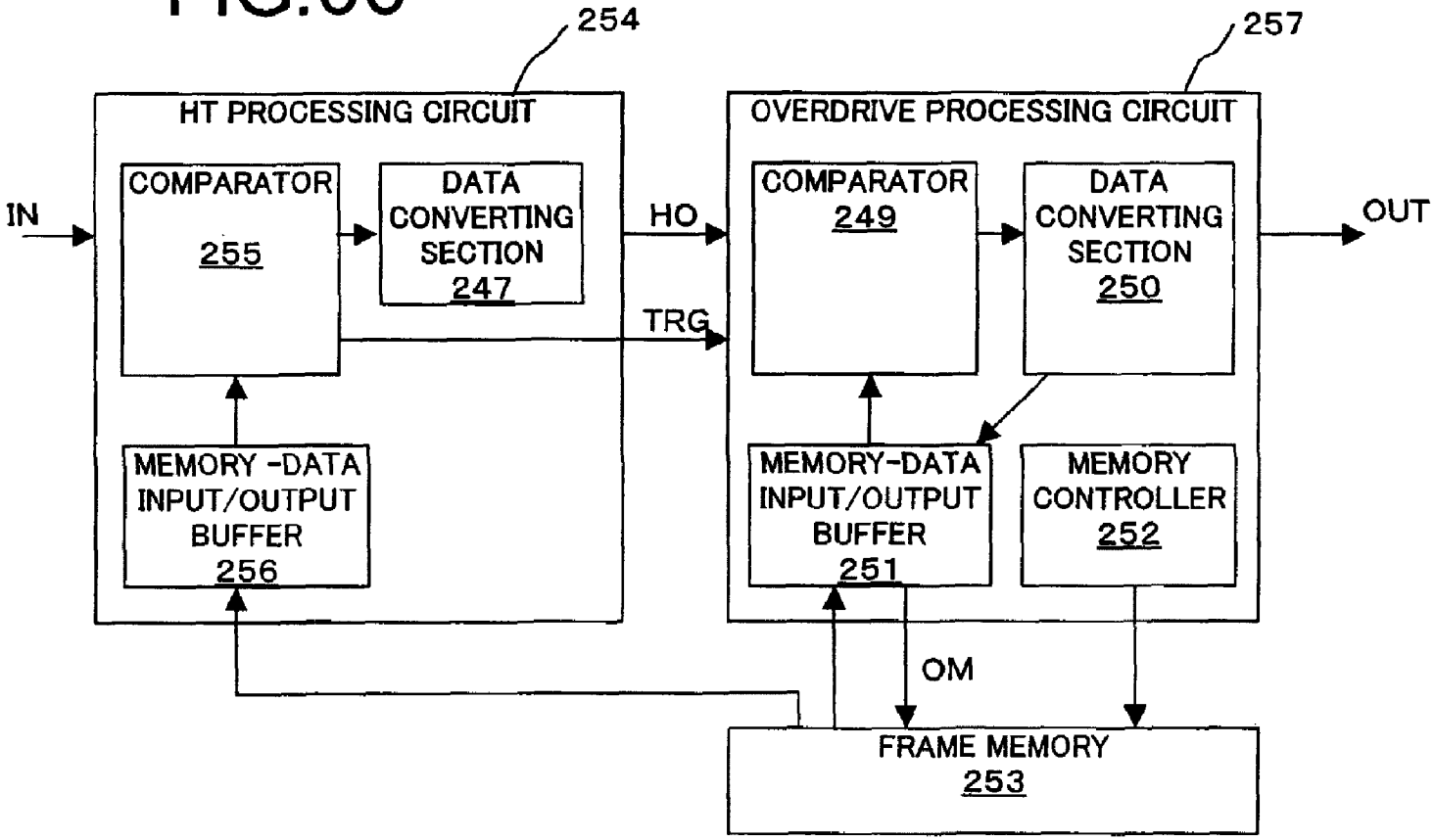
FIG. 60 is a block diagram of a third image conversion processing circuit according to example 14 of the fifth embodiment of the invention.

Now explained is a third image conversion processing circuit according to the present example with reference to FIG. 60. FIG. 60 shows a block diagram of the third image conversion processing circuit. Incidentally, the constituent elements offering the same functional operation to those of the first image-conversion processing circuit are attached with the same references. The memory data input/output buffer 256 within the HT processing circuit 254 can store a 1-frame preceding video signal. A comparator 255 compares between the 1-frame preceding video signal and the input video signal. Furthermore, the comparator 255 also compares between a tone conversion level selected based on the relevant input video signal and an 1-frame preceding tone conversion level. An HT processing circuit 254 outputs a trigger circuit to the overdrive processing circuit 257 when the difference in tone conversion level is equal to or greater than a predetermined range or greater.

In the overdrive processing circuit 257, the overdrive processing is determined as to operation/non-operation by the trigger signal. A memory controller 252 reads 1-frame preceding video signal out of the frame memory 253. In the case the overdrive processing is selected for operation, the comparator 249 compares between the 1-frame preceding video signal and the HT-processed video signal outputted from the HT processing circuit 254. Depending upon the comparison result, a data converting section 250 makes addition/subtraction for overdrive processing, to output a video signal. On the other hand, in the case the overdrive processing is selected for non-operation, the HT-processed video signal outputted from the HT processing circuit 254 is outputted from the overdrive processing circuit 257. Accordingly, in the case the overdrive processing is in operation, on the liquid-crystal panel 233 is displayed an image simultaneously processed by HT processing and response compensation based on overdrive processing. In the case the overdrive processing is in non-operation, on the liquid-crystal panel 233 is displayed an image processed only by HT processing.

Figures 61A, 61B:
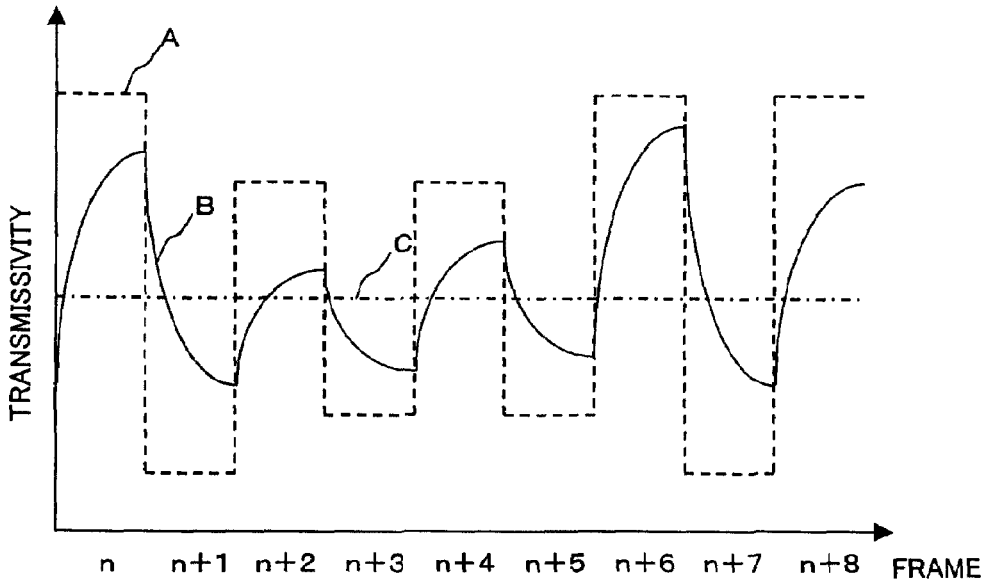
FIGS. 61A and 61B are figures showing an optical response on a pixel made by only HT process according to example 14 of the fifth embodiment of the invention.

Now concretely explained is the effect of the HT processing and overdrive-process-based response compensation by the third image conversion processing circuit, by using FIGS. 60 to 62. FIG. 61 shows an optical response on the pixel made by HT processing only. FIG. 61A shows an optical response characteristic on a predetermined one pixel having an area ratio of higher-luminance HT drive level or lower-luminance HT drive level of 1:1 and driven on two levels in HT division of higher-luminance and lower-luminance drive levels. The abscissa represents frame order of from left to right and the ordinate represents a transmissivity of liquid crystal. The straight line A shown by the broken line in the figure represents a drive level where the liquid-crystal panel 233 is driven on a video signal made by HT-processed only. The curve line B shown by the solid line represents an optical response characteristic of the liquid-crystal panel 233 where HT-processing is made. The straight line C shown by the one-dot chain line represents an optical response characteristic of the liquid-crystal panel 23 where image processing is not made. FIG. 61B shows a drive level in each frame. Incidentally, IN in the figure represents an input video signal, "HO" represents a video signal of after HT processing outputted from the HT processing circuit 254 and "FL" represents a 1-frame-preceding video signal made by one kind of HT processing. For example, in case the liquid-crystal panel 233 is driven on the HT-processed video signal HO, the driven level is 18 in (n+1)-th frame.

In order to realize a drive level 32 where no image processing is made, two kinds of HT processing (hereinafter, referred to as "HT process 46-18" and "HT process 40-24") are carried out. In (n+2)-th frame, HT processing is changed in kind from HT process 46-18 to HT process 40-24. The (n+1)-th frame has a drive level 18 while the (n+2)-th frame has a drive level 40. Accordingly, the mean drive level is given (18+40)/2=29 because of the optical response characteristic of the liquid-crystal panel 233. Accordingly, the mean drive level in (n+2)-th frame is lower than the drive level 32 that image processing is not made. On the other hand, in (n+5)-th frame, HT processing is changed in kind from HT process 40-24 to HT process 46-18. The (n+5)-th frame has a drive level 24 while the (n+6)-th frame has a drive level 46. Accordingly, the mean drive level is given 43, thus being higher than the drive level 32. In case the drive level of after HT processing changes despite the input video signal IN does not change, the low-frequency component in optical response increases to cause flicker.

Figures 62A, 62B:
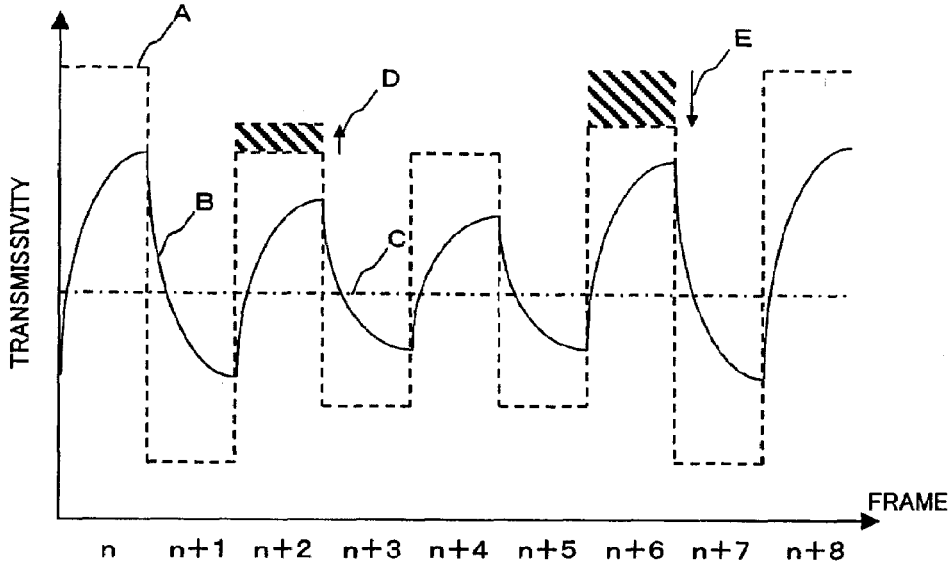
FIGS. 62A and 62B are figures showing an optical response on a pixel made by HT process and overdrive process according to example 14 of the fifth embodiment of the invention.

For this reason, overdrive processing is carried out in order to suppress the drive level on the liquid-crystal panel 233 from varying. FIG. 62 shows an optical response when the pixel explained in FIG. 61 is made by an overdrive processing. FIG. 62A shows an optical response characteristic on the relevant pixel. The straight line A shown by the broken line in the figure represents a drive level when the liquid-crystal panel 233 is driven on a video signal made by HT-processed only. The curve line B shown by the solid line represents an optical response characteristic of the liquid-crystal panel 233 where HT processing and overdrive processing are made. The straight line C shown by the one-dot chain line represents an optical response characteristic of the liquid-crystal panel 233 where image processing is not made. FIG. 62B shows a drive level in each frame. Incidentally, "IN" in the figure represents an input video signal, the letter "HO" represents a video signal of after HT processing outputted from the HT-processing circuit 254, and the letter "FL" represents a 1-frame preceding video signal made by one kind of HT processing. Furthermore, the letter "OUT" in the figure represents an output video signal to be outputted onto the liquid-crystal panel 233, "OM" represents a video signal HO to be stored to the frame memory 253, "TRG" represents a trigger signal for control of the operation/non-operation in overdrive processing and "CO" represents a correction value in overdrive processing.

In order to avoid the mean drive level explained in FIG. 61 from varying, the comparator 255 within the HT processing circuit 254 compares between the video signal HO of after HT processing and the 1-frame-preceding video signal OM stored in the frame memory 253. As a result of the comparison, in case the change amount exceeds a predetermined range, a trigger signal TRG is generated and outputted from the HT processing circuit 254. When the trigger signal TRG is inputted to the overdrive processing circuit 257, overdrive processing is carried out whereby the video signal is added or subtracted by a correction amount CO in the data conversion circuit 250. The overdrive circuit 257 outputs an output video signal OUT as a corrected video signal onto the liquid-crystal panel 233, thus adjusting the variation in the drive level.

For example, in (n+1)-th frame where there is no change in HT processing, comparison is made between the drive level (18) of the video signal HO of after HT processing in the relevant frame and the drive level (46) of the 1-frame preceding video signal OM stored in the frame memory 253, to compute a mean drive level as 32 in the relevant frame, as shown in FIG. 62B. Meanwhile, in (n+2)-th frame, comparison is made between the drive level (40) of the video signal HO of after HT processing in the relevant frame and the drive level (18) of the 1-frame preceding video signal OM stored in the frame memory 253, to compute a mean drive level as 29 in the relevant frame. Here, it is assumed that the mean drive level for selecting an overdrive processing operation/non-operation is set with a range of varying amount at 32±2. In this case, because the mean drive level in (n+2)-th frame is out of the range, a trigger signal TRG is outputted from the HT processing circuit 254, thus effecting an overdrive processing. The open circle mark in the TRG column in FIG. 62B represents an output of a trigger signal TRG. In the overdrive processing circuit 257, a correction value 2 is added to the video signal, for example, such that the mean drive level is fallen within the range of 32±2, to output an output video signal OUT (42). With driving on this output video signal OUT, the drive level rises D with respect to the drive level straight line A based only on HT processing. Accordingly, in case the liquid-crystal panel 233 is driven on this drive level, the mean drive level is at 30 thus suppressing the HT-processing mean drive level from varying. Incidentally, similar process is carried out also in (n+6)-th frame, making a correction such that the drive level lowers by E in this frame.

As discussed above, with the present example, even where there is a change in HT processing such as HT mask pattern change, the mean drive level on the liquid-crystal panel 233 is suppressed from varying, making it possible to remove low-frequency components. Therefore, it is possible to obtain a high quality display characteristic that flicker is fully reduced.

In this manner, the present embodiment can realize an image processing method, liquid-crystal display device and driving method to liquid-crystal display device using same which can provide wide viewing angle, excellent color reproducibility but extremely less sandiness feeling.

The present embodiment is not limited to the foregoing examples but can be modified in various ways.

For example, there maybe provided means for generating tone-level reference voltage as a reference voltage for driving a liquid crystal, for HT-driving and normal-driving purposes.

Figure 63:
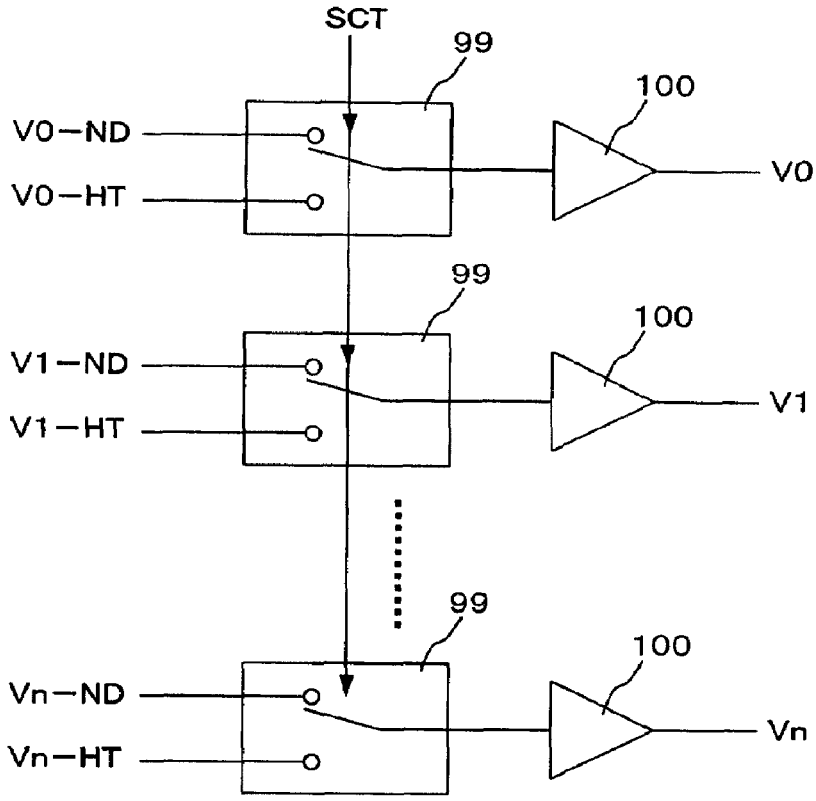
FIG. 63 is a figure showing a circuit arrangement for switching tone-level reference voltage according to the fifth embodiment of the invention.

As shown in FIG. 63, provided is a not-shown circuit for outputting an HT-driving tone-level reference voltage Vx-Ht (x=1, 2, . . . , n) and a normal-driving tone-level reference voltage Vx-ND (x=1, 2, . . . , n), wherein the tone-level reference voltage is to be selected by an analog switch 258 under control of a select control signal SCT. The tone-level reference voltage selected is inputted to a source driver IC 231 through an amplifier 259. By switching the tone-level reference voltage, different voltages can be applied to the liquid crystal even with the same tone level of video signal. Therefore, by simultaneously carrying out HT processing and tone-level reference voltage switching, the effect of image processing is enhanced to provide high quality display characteristics.

Meanwhile, although the above examples carried out HT processing on a pixel-by-pixel basis, the present embodiment is not limited to that. For example, HT processing is implemented by extracting a point having a change in display image. By doing so, higher-luminance and lower-luminance HT drive levels are repeated frame by frame on the relevant point, to increase the path of optical response at around the change of display image. The contour of that point is to be enhanced when the line of sight follows a moving image or the like. Meanwhile, by changing the luminance level of after changing between the higher-luminance and lower-luminance HT drive levels, the degree of enhancement can be put under control.

As explained in the above, the present embodiment can realize an image processing method, liquid-crystal display device using the same and driving method to liquid-crystal display device which can provide wide viewing angle, excellent color reproducibility but extremely less sandiness feeling.

As in the above, the fourth and fifth embodiments can carry out an image processing wide in viewing angle and excellent in color reproducibility even where an interlace-schemed video signal is inputted.

The invention claimed is:

1. A liquid crystal display device comprising:

a liquid crystal sealed between an array substrate and an opposite substrate that are oppositely arranged with a predetermined cell gap;

a one unit having a plurality of pixels;

one or more of higher luminance pixels included in the plurality of pixels, to which a voltage higher than an applied voltage of an unprocessed image is applied; and one or more of lower luminance pixels included in the plurality of pixels, to which a voltage lower than the applied voltage of the unprocessed image is applied, wherein the one or more of lower luminance pixels are arranged so as to surround the one or more of higher luminance pixels, wherein in the one unit, a total area of the one or more of higher luminance pixels is smaller than that of the one or more of lower luminance pixels, and wherein the one unit performs a display such that a luminance of the one unit represents a luminance of the unprocessed image.

2. A liquid crystal display device comprising:

a liquid crystal sealed between an array substrate and an opposite substrate that are oppositely arranged with a predetermined cell gap;

a one unit having a plurality of pixels;

one or more of higher luminance pixels included in the plurality of pixels, to which a voltage higher than an applied voltage of an unprocessed image is applied; and one or more of lower luminance pixels included in the plurality of pixels, to which a voltage lower than the applied voltage of the unprocessed image is applied, wherein the one or more of lower luminance pixels are arranged so as to surround the one or more of higher luminance pixels, wherein in the one unit, a ratio of a total area of the one or more of higher luminance pixels and the one or more of lower luminance pixels is from 1:1 to 1:15 (1:1 is not inclusive), and wherein the one unit performs a display such that a luminance of the one unit represents a luminance of the unprocessed image.

3. A liquid crystal display device comprising:

a liquid crystal sealed between an array substrate and an opposite substrate that are oppositely arranged with a predetermined cell gap;

a one unit having a plurality of pixels;

one or more of higher luminance pixels included in the plurality of pixels, to which a voltage higher than an applied voltage of an unprocessed image is applied; and one or more of lower luminance pixels included in the plurality of pixels, to which a voltage lower than the applied voltage of the unprocessed image is applied, wherein the one or more of lower luminance pixels are arranged so as to surround the one or more of higher luminance pixels, wherein in the one unit, a ratio of a total area of the one or more of higher luminance pixels and the one or more of lower luminance pixels is from 1:7 to 1:3, and wherein the one unit performs a display such that a luminance of the one unit represents a luminance of the unprocessed image.

4. A liquid-crystal display device according to anyone of claims 1 to 3, further comprising:

a drive circuit for driving the one or more of higher luminance pixels and the one or more of lower luminance pixels.

5. A liquid-crystal display device according to claim 4, wherein the liquid crystal has a negative dielectric anisotropy and is in a vertical alignment under no application of voltage.

* * * * *